US009359853B2

(12) United States Patent
Nas et al.

(10) Patent No.: US 9,359,853 B2
(45) Date of Patent: Jun. 7, 2016

(54) ACOUSTICALLY CONTROLLED SUBSEA LATCHING AND SEALING SYSTEM AND METHOD FOR AN OILFIELD DEVICE

(75) Inventors: Stephanus Wilhelmus Maria Nas, Kuala Lumpur (MY); Waybourn "Bo" J. Anderson, Jr., Houston, TX (US); Kevin L. Gray, Friendswood, TX (US); Thomas F. Bailey, Abilene, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 650 days.

(21) Appl. No.: 13/233,846

(22) Filed: Sep. 15, 2011

(65) Prior Publication Data

US 2012/0000664 A1 Jan. 5, 2012

Related U.S. Application Data

(63) Continuation-in-part of application No. 12/643,093, filed on Dec. 21, 2009, now Pat. No. 8,322,432.

(60) Provisional application No. 61/394,155, filed on Oct. 18, 2010, provisional application No. 61/205,209, filed on Jan. 15, 2009.

(51) Int. Cl.
*E21B 7/12* (2006.01)
*E21B 33/08* (2006.01)
(Continued)

(52) U.S. Cl.
CPC ..... *E21B 33/085* (2013.01); *E21B 33/03* (2013.01); *E21B 47/14* (2013.01)

(58) Field of Classification Search
USPC ..... 166/338, 344, 360, 368, 378; 340/853.1; 367/133
See application file for complete search history.

(56) References Cited

U.S. PATENT DOCUMENTS 517,509 A 4/1894 Williams
1,157,644 A 10/1915 London
(Continued)

FOREIGN PATENT DOCUMENTS

AU 199927822 B2 9/1999
AU 200028183 A1 9/2000
(Continued)

OTHER PUBLICATIONS

Patent Cooperation Treaty International Searching Authority Invitation to Pay Additional Fees and, where Applicable, Protest Fee with Communication relating to the Results of the Partial International Search mailed Mar. 28, 2013, International Application No. PCT/EP2011/068111, now published as WO2012/052402 A2 (8 pages).
(Continued)

*Primary Examiner* — Matthew R Buck
*Assistant Examiner* — Aaron Lembo
(74) *Attorney, Agent, or Firm* — Smith IP Services, P.C.

(57) ABSTRACT

An acoustic control system wirelessly operates a subsea latching assembly or other subsea device, such as an active seal. The acoustic control system may control a subsea first accumulator to release its stored hydraulic fluid to operate the latch assembly or other subsea device, such as an active seal. An RCD or other oilfield device may be unlatched or latched with the latching assembly. The acoustic control system may have a surface control unit, a subsea control unit, and two or more acoustic signal devices. A valve may allow switching from an umbilical line system to the acoustic control system accumulator.

43 Claims, 36 Drawing Sheets

(51) Int. Cl.
*E21B 47/14* (2006.01)
*E21B 33/03* (2006.01)

(56) References Cited

U.S. PATENT DOCUMENTS 1,472,952 A 11/1923 Anderson
1,503,476 A 8/1924 Childs et al.
1,528,560 A 3/1925 Myers et al.
1,546,467 A 7/1925 Bennett
1,560,763 A 11/1925 Collins
1,700,894 A 2/1929 Joyce et al.
1,708,316 A 4/1929 MacClatchie
1,769,921 A 7/1930 Hansen
1,776,797 A 9/1930 Sheldon
1,813,402 A 7/1931 Hewitt
2,038,140 A 7/1931 Stone
1,831,956 A 11/1931 Harrington
1,836,470 A 12/1931 Humason et al.
1,902,906 A 3/1933 Seamark
1,942,366 A 1/1934 Seamark
2,036,537 A 4/1936 Otis
2,071,197 A 2/1937 Burns et al.
2,124,015 A 7/1938 Stone et al.
2,126,007 A 8/1938 Gulberson et al.
2,144,682 A 1/1939 MacClatchie
2,148,844 A 2/1939 Stone et al.
2,163,813 A 6/1939 Stone et al.
2,165,410 A 7/1939 Penick et al.
2,170,915 A 8/1939 Schweitzer
2,170,916 A 8/1939 Schweitzer et al.
2,175,648 A 10/1939 Roach
2,176,355 A 10/1939 Otis
2,185,822 A 1/1940 Young
2,199,735 A 5/1940 Beckman
2,211,122 A 8/1940 Howard
2,222,082 A 11/1940 Leman et al.
2,233,041 A 2/1941 Alley
2,243,340 A 5/1941 Hild
2,243,439 A 5/1941 Pranger et al.
2,287,205 A 6/1942 Stone
2,303,090 A 11/1942 Pranger et al.
2,313,169 A 3/1943 Penick et al.
2,325,556 A 7/1943 Taylor, Jr. et al.
2,338,093 A 1/1944 Caldwell
2,480,955 A 9/1949 Penick
2,506,538 A 5/1950 Bennett
2,529,744 A 11/1950 Schweitzer, Jr.
2,609,836 A 9/1952 Knox
2,628,852 A 2/1953 Voytech
2,646,999 A 7/1953 Barske
2,649,318 A 8/1953 Skillman
2,731,281 A 1/1956 Knox
2,746,781 A 5/1956 Jones
2,760,750 A 8/1956 Schweitzer, Jr. et al.
2,760,795 A 8/1956 Vertson
2,764,999 A 10/1956 Stanbury
2,808,229 A 10/1957 Bauer et al.
2,808,230 A 10/1957 McNeil et al.
2,846,178 A 8/1958 Minor
2,846,247 A 8/1958 Davis
2,853,274 A 9/1958 Collins
2,862,735 A 12/1958 Knox
2,886,350 A 5/1959 Horne
2,904,357 A 9/1959 Knox
2,927,774 A 3/1960 Ormsby
2,929,610 A 3/1960 Stratton
2,962,096 A 11/1960 Knox
2,995,196 A 8/1961 Gibson et al.
3,023,012 A 2/1962 Wilde
3,029,083 A 4/1962 Wilde
3,032,125 A 5/1962 Hiser et al.
3,033,011 A 5/1962 Garrett
3,052,300 A 9/1962 Hampton
3,096,999 A 7/1963 Ahlstone et al.
3,100,015 A 8/1963 Regan
3,128,614 A 4/1964 Auer
3,134,613 A 5/1964 Regan
3,176,996 A 4/1965 Barnett
3,203,358 A 8/1965 Regan et al.
3,209,829 A 10/1965 Haeber
3,216,731 A 11/1965 Dollison
3,225,831 A 12/1965 Knox
3,259,198 A 7/1966 Montgomery et al.
3,268,233 A 8/1966 Brown
3,285,352 A 11/1966 Hunter
3,288,472 A 11/1966 Watkins
3,289,761 A 12/1966 Smith et al.
3,294,112 A 12/1966 Watkins
3,302,048 A 1/1967 Gray
3,313,345 A 4/1967 Fischer
3,313,358 A 4/1967 Postlewaite et al.
3,323,773 A 6/1967 Walker
3,333,870 A 8/1967 Watkins
3,347,567 A 10/1967 Watkins
3,360,048 A 12/1967 Watkins
3,372,761 A 3/1968 van Gils
3,387,851 A 6/1968 Cugini
3,397,928 A 8/1968 Galle
3,400,938 A 9/1968 Williams
3,401,600 A 9/1968 Wood
3,405,387 A 10/1968 Koomey et al.
3,405,763 A 10/1968 Pitts et al.
3,421,580 A 1/1969 Fowler et al.
3,424,197 A 1/1969 Yanagisawa
3,443,643 A 5/1969 Jones
3,445,126 A 5/1969 Watkins
3,452,815 A 7/1969 Watkins
3,472,518 A 10/1969 Harlan
3,476,195 A 11/1969 Galle
3,481,610 A 12/1969 Slator et al.
3,485,051 A 12/1969 Watkins
3,492,007 A 1/1970 Jones
3,493,043 A 2/1970 Watkins
3,503,460 A 3/1970 Gadbois
3,516,492 A * 6/1970 Petersen ..... 166/343
3,522,709 A 8/1970 Vilain
3,529,835 A 9/1970 Lewis
3,561,723 A 2/1971 Cugini
3,583,480 A 6/1971 Regan
3,587,734 A 6/1971 Shaffer
3,603,409 A 9/1971 Watkins
3,621,912 A 11/1971 Wooddy, Jr.
3,631,834 A 1/1972 Gardner et al.
3,633,667 A * 1/1972 Falkner, Jr. ..... 166/366
3,638,721 A 2/1972 Harrison
3,638,742 A 2/1972 Wallace
3,653,350 A 4/1972 Koons et al.
3,661,409 A 5/1972 Brown et al.
3,664,376 A 5/1972 Watkins
3,667,721 A 6/1972 Vujasinovic
3,677,353 A 7/1972 Baker
3,724,862 A 4/1973 Biffle
3,741,296 A 6/1973 Murman et al.
3,779,313 A 12/1973 Regan
3,815,673 A 6/1974 Bruce et al.
3,827,511 A 8/1974 Jones
3,847,215 A 11/1974 Herd
3,868,832 A 3/1975 Biffle
3,872,717 A 3/1975 Fox
3,891,037 A 6/1975 Well et al.
3,924,678 A 12/1975 Ahlstone
3,934,887 A 1/1976 Biffle
3,952,526 A 4/1976 Watkins et al.
3,955,622 A 5/1976 Jones
3,965,987 A 6/1976 Biffle
3,976,148 A 8/1976 Maus et al.
3,984,990 A 10/1976 Jones
3,992,889 A 11/1976 Watkins et al.
3,999,766 A 12/1976 Barton
4,037,890 A 7/1977 Kurita et al.
4,046,191 A 9/1977 Neath
4,052,703 A 10/1977 Collins, Sr. et al.
4,053,023 A 10/1977 Herd et al.
4,063,602 A 12/1977 Howell et al.

(56) References Cited

U.S. PATENT DOCUMENTS 4,065,747 A 12/1977 Patten et al.
4,087,097 A 5/1978 Bossens et al.
4,091,881 A 5/1978 Maus
4,095,421 A * 6/1978 Silcox ..... 60/398
4,098,341 A 7/1978 Lewis
4,099,583 A 7/1978 Maus
4,109,712 A 8/1978 Regan
4,143,880 A 3/1979 Bunting et al.
4,143,881 A 3/1979 Bunting
4,149,603 A 4/1979 Arnold
4,154,448 A 5/1979 Biffle
4,157,186 A 6/1979 Murray et al.
4,183,562 A 1/1980 Watkins et al.
4,193,449 A * 3/1980 Lochte et al. ..... 166/72
4,200,312 A 4/1980 Watkins
4,208,056 A 6/1980 Biffle
4,216,835 A 8/1980 Nelson
4,222,590 A 9/1980 Regan
4,234,043 A * 11/1980 Roberts ..... 166/336
4,249,600 A 2/1981 Bailey
4,281,724 A 8/1981 Garrett
4,282,939 A 8/1981 Maus et al.
4,285,406 A 8/1981 Garrett et al.
4,291,772 A 9/1981 Beynet
4,293,047 A 10/1981 Young
4,304,310 A 12/1981 Garrett
4,310,058 A 1/1982 Bourgoyne, Jr.
4,312,404 A 1/1982 Morrow
4,313,054 A 1/1982 Martini
4,326,584 A 4/1982 Watkins
4,335,791 A 6/1982 Evans
4,336,840 A 6/1982 Bailey
4,337,653 A 7/1982 Chauffe
4,345,769 A 8/1982 Johnston
4,349,204 A 9/1982 Malone
4,353,420 A 10/1982 Miller
4,355,784 A 10/1982 Cain
4,361,185 A 11/1982 Biffle
4,363,357 A 12/1982 Hunter
4,367,795 A 1/1983 Biffle
4,375,239 A 3/1983 Barrington et al.
4,378,849 A 4/1983 Wilks
4,383,577 A 5/1983 Pruitt
4,384,724 A 5/1983 Derman
4,386,667 A 6/1983 Millsapps, Jr.
4,387,771 A 6/1983 Jones
4,398,599 A 8/1983 Murray
4,406,333 A 9/1983 Adams
4,407,375 A 10/1983 Nakamura
4,413,653 A 11/1983 Carter, Jr.
4,416,340 A 11/1983 Bailey
4,423,776 A 1/1984 Wagoner et al.
4,424,861 A 1/1984 Carter, Jr. et al.
4,427,072 A 1/1984 Lawson
4,439,068 A 3/1984 Pokladnik
4,440,232 A 4/1984 LeMoine
4,440,239 A 4/1984 Evans
4,441,551 A 4/1984 Biffle
4,444,250 A 4/1984 Keithahn et al.
4,444,401 A 4/1984 Roche et al.
4,448,255 A 5/1984 Shaffer et al.
4,456,062 A 6/1984 Roche et al.
4,456,063 A 6/1984 Roche
4,457,489 A 7/1984 Gilmore
4,478,287 A 10/1984 Hynes et al.
4,480,703 A 11/1984 Garrett
4,484,753 A 11/1984 Kalsi
4,486,025 A 12/1984 Johnston
4,488,703 A 12/1984 Jones
4,497,592 A 2/1985 Lawson
4,500,094 A 2/1985 Biffle
4,502,534 A 3/1985 Roche et al.
4,508,313 A 4/1985 Jones
4,509,405 A 4/1985 Bates
4,519,577 A 5/1985 Jones
4,524,832 A 6/1985 Roche et al.
4,526,243 A 7/1985 Young
4,527,632 A 7/1985 Chaudot
4,529,210 A 7/1985 Biffle
4,531,580 A 7/1985 Jones
4,531,591 A 7/1985 Johnston
4,531,593 A 7/1985 Elliott et al.
4,531,951 A 7/1985 Burt et al.
4,533,003 A 8/1985 Bailey
4,540,053 A 9/1985 Baugh et al.
4,546,828 A 10/1985 Roche
4,553,591 A 11/1985 Mitchell
D282,073 S 1/1986 Bearden et al.
4,566,494 A 1/1986 Roche
4,575,426 A 3/1986 Bailey et al.
4,595,343 A 6/1986 Thompson et al.
4,597,447 A 7/1986 Roche et al.
4,597,448 A 7/1986 Baugh
4,610,319 A 9/1986 Kalsi
4,611,661 A 9/1986 Hed et al.
4,615,544 A 10/1986 Baugh
4,618,314 A 10/1986 Hailey
4,621,655 A 11/1986 Roche
4,623,020 A 11/1986 Nichols
4,626,135 A 12/1986 Roche
4,630,680 A 12/1986 Elkins
4,632,188 A 12/1986 Schuh et al.
4,636,934 A * 1/1987 Schwendemann et al. ..... 700/3
4,646,826 A 3/1987 Bailey et al.
4,646,844 A 3/1987 Roche et al.
4,651,830 A 3/1987 Crotwell
4,660,863 A 4/1987 Bailey
4,688,633 A 8/1987 Barkley
4,690,220 A 9/1987 Braddick
4,697,484 A 10/1987 Klee et al.
4,709,900 A 12/1987 Dyhr
4,712,620 A 12/1987 Lim et al.
4,719,937 A 1/1988 Roche et al.
4,722,615 A 2/1988 Bailey et al.
4,727,942 A 3/1988 Galle et al.
4,736,799 A 4/1988 Ahlstone
4,745,970 A 5/1988 Bearden et al.
4,749,035 A 6/1988 Cassity
4,754,820 A 7/1988 Watts et al.
4,757,584 A 7/1988 Pav et al.
4,759,413 A 7/1988 Bailey et al.
4,765,404 A 8/1988 Bailey et al.
4,783,084 A 11/1988 Biffle
4,805,657 A * 2/1989 Carman et al. ..... 137/68.13
4,807,705 A 2/1989 Henderson et al.
4,813,495 A 3/1989 Leach
4,817,724 A 4/1989 Funderburg, Jr. et al.
4,822,212 A 4/1989 Hall et al.
4,825,938 A 5/1989 Davis
4,828,024 A 5/1989 Roche
4,832,126 A 5/1989 Roche
4,836,289 A 6/1989 Young
4,844,406 A 7/1989 Wilson
4,865,137 A 9/1989 Bailey
4,882,830 A 11/1989 Cartensen
4,909,327 A 3/1990 Roche
4,949,796 A 8/1990 Williams
4,955,436 A 9/1990 Johnston
4,955,949 A 9/1990 Bailey et al.
4,962,819 A 10/1990 Bailey et al.
4,971,148 A 11/1990 Roche et al.
4,984,636 A 1/1991 Bailey et al.
4,995,464 A 2/1991 Watkins et al.
5,009,265 A 4/1991 Bailey et al.
5,022,472 A 6/1991 Bailey et al.
5,028,056 A 7/1991 Bemis et al.
5,035,292 A 7/1991 Bailey
5,040,600 A 8/1991 Bailey et al.
5,048,621 A 9/1991 Bailey
5,062,450 A 11/1991 Bailey
5,062,479 A 11/1991 Bailey et al.
5,072,795 A 12/1991 Delgado et al.
5,076,364 A 12/1991 Hale et al.
5,082,020 A 1/1992 Bailey

(56) References Cited

U.S. PATENT DOCUMENTS 5,085,277 A 2/1992 Hopper
5,101,897 A 4/1992 Leismer et al.
5,137,084 A 8/1992 Gonzales et al.
5,147,559 A 9/1992 Brophey et al.
5,154,231 A 10/1992 Bailey et al.
5,163,514 A 11/1992 Jennings
5,165,480 A 11/1992 Wagoner et al.
5,178,215 A 1/1993 Yenulis et al.
5,182,979 A 2/1993 Morgan
5,184,686 A 2/1993 Gonzalez
5,195,754 A 3/1993 Dietle
5,205,165 A 4/1993 Jardine et al.
5,213,158 A 5/1993 Bailey et al.
5,215,151 A 6/1993 Smith et al.
5,224,557 A 7/1993 Yenulis et al.
5,230,520 A 7/1993 Dietle et al.
5,243,187 A 9/1993 Hettlage
5,251,869 A 10/1993 Mason
5,255,745 A 10/1993 Czyrek
5,277,249 A 1/1994 Yenulis et al.
5,279,365 A 1/1994 Yenulis et al.
5,305,839 A 4/1994 Kalsi et al.
5,320,325 A 6/1994 Young et al.
5,322,137 A 6/1994 Gonzales
5,325,925 A 7/1994 Smith et al.
5,348,107 A 9/1994 Bailey et al.
5,375,476 A 12/1994 Gray
5,427,179 A 6/1995 Bailey
5,431,220 A 7/1995 Bailey
5,443,129 A 8/1995 Bailey et al.
5,495,872 A 3/1996 Gallagher et al.
5,529,093 A 6/1996 Gallagher et al.
5,540,523 A * 7/1996 Foret et al. ..... 405/232
5,588,491 A 12/1996 Tasson et al.
5,607,019 A 3/1997 Kent
5,647,444 A 7/1997 Williams
5,657,820 A 8/1997 Bailey
5,662,171 A 9/1997 Brugman et al.
5,662,181 A 9/1997 Williams et al.
5,671,812 A 9/1997 Bridges
5,678,829 A 10/1997 Kalsi et al.
5,735,502 A 4/1998 Levett et al.
5,738,358 A 4/1998 Kalsi et al.
5,755,372 A 5/1998 Cimbura
5,788,418 A 8/1998 Kuehn
5,823,541 A 10/1998 Dietle et al.
5,829,531 A 11/1998 Hebert et al.
5,848,643 A 12/1998 Carbaugh et al.
5,873,576 A 2/1999 Dietle et al.
5,878,818 A 3/1999 Hebert et al.
5,901,964 A 5/1999 Williams et al.
5,944,111 A 8/1999 Bridges
5,952,569 A 9/1999 Jervis
5,957,195 A 9/1999 Bailey et al.
5,960,881 A 10/1999 Allamon et al.
6,007,105 A 12/1999 Dietle et al.
6,016,880 A 1/2000 Hall et al.
6,017,168 A 1/2000 Fraser, Jr.
6,036,192 A 3/2000 Dietle et al.
6,039,118 A 3/2000 Carter et al.
6,050,348 A 4/2000 Richarson et al.
6,070,655 A 6/2000 Heikkilä
6,070,670 A 6/2000 Carter et al.
6,076,606 A 6/2000 Bailey
6,102,123 A 8/2000 Bailey et al.
6,102,673 A 8/2000 Mott et al.
6,109,348 A 8/2000 Caraway
6,109,618 A 8/2000 Dietle
6,112,810 A 9/2000 Bailey
6,120,036 A 9/2000 Kalsi et al.
6,125,938 A 10/2000 Garcia-Soule et al.
6,129,152 A 10/2000 Hosie et al.
6,138,774 A 10/2000 Bourgoyne, Jr. et al.
6,142,230 A 11/2000 Smalley et al.
6,170,576 B1 1/2001 Bailey
6,202,745 B1 3/2001 Reimert et al.
6,202,752 B1 3/2001 Kuck et al.
6,209,663 B1 4/2001 Hosie
6,213,228 B1 4/2001 Saxman
6,227,547 B1 5/2001 Dietle et al.
6,230,824 B1 5/2001 Peterman et al.
6,244,359 B1 6/2001 Bridges et al.
6,263,982 B1 7/2001 Hannegan et al.
6,273,193 B1 8/2001 Hermann
6,315,302 B1 11/2001 Conroy et al.
6,315,813 B1 11/2001 Morgan et al.
6,318,482 B1 11/2001 Fidtje
6,325,159 B1 12/2001 Peterman et al.
6,334,619 B1 1/2002 Dietle et al.
6,352,129 B1 3/2002 Best
6,354,385 B1 3/2002 Ford et al.
6,361,830 B1 3/2002 Schenk
6,375,895 B1 4/2002 Daemen
6,382,634 B1 5/2002 Dietle et al.
6,386,291 B1 5/2002 Short
6,413,297 B1 7/2002 Morgan et al.
6,450,262 B1 9/2002 Regan
6,454,007 B1 9/2002 Bailey
6,457,529 B2 10/2002 Calder et al.
6,470,975 B1 10/2002 Bourgoyne et al.
6,478,303 B1 11/2002 Radcliffe
6,494,462 B2 12/2002 Dietle
6,504,982 B1 1/2003 Greer, IV
6,505,691 B2 1/2003 Judge
6,520,253 B2 2/2003 Calder
6,536,520 B1 3/2003 Snider et al.
6,536,525 B1 3/2003 Haugen et al.
6,547,002 B1 4/2003 Bailey et al.
6,547,006 B1 4/2003 Kuck et al.
6,554,016 B2 4/2003 Kinder
6,561,520 B2 5/2003 Kalsi et al.
6,581,681 B1 6/2003 Zimmerman et al.
6,607,042 B2 8/2003 Hoyer et al.
RE38,249 E 9/2003 Tasson et al.
6,655,460 B2 12/2003 Bailey et al.
6,685,194 B2 2/2004 Dietle et al.
6,702,012 B2 3/2004 Bailey et al.
6,702,025 B2 * 3/2004 Meaders ..... 166/335
6,708,762 B2 3/2004 Haugen et al.
6,720,764 B2 4/2004 Relton et al.
6,725,951 B2 4/2004 Looper
6,732,804 B2 5/2004 Hosie et al.
6,749,172 B2 6/2004 Kinder
6,767,016 B2 7/2004 Gobeli et al.
6,843,313 B2 1/2005 Hult
6,851,476 B2 2/2005 Gray et al.
6,877,565 B2 4/2005 Edvardsen
6,886,631 B2 5/2005 Wilson et al.
6,896,048 B2 5/2005 Mason et al.
6,896,076 B2 5/2005 Nelson et al.
6,904,981 B2 6/2005 van Riet
6,913,092 B2 7/2005 Bourgoyne
6,945,330 B2 9/2005 Wilson et al.
7,004,444 B2 2/2006 Kinder
7,007,913 B2 3/2006 Kinder
7,011,167 B2 3/2006 Ebner
7,025,130 B2 4/2006 Bailey et al.
7,028,777 B2 4/2006 Wade et al.
7,032,691 B2 4/2006 Humphreys
7,040,394 B2 5/2006 Bailey et al.
7,044,237 B2 5/2006 Leuchtenberg
7,073,580 B2 7/2006 Wilson et al.
7,073,594 B2 * 7/2006 Stegemeier et al. ..... 166/369
7,077,212 B2 7/2006 Roesner et al.
7,080,685 B2 7/2006 Bailey et al.
7,086,481 B2 8/2006 Hosie et al.
7,123,162 B2 10/2006 Mackenzie et al.
7,152,680 B2 12/2006 Wilson et al.
7,156,169 B2 * 1/2007 Bartlett ..... 166/66.7
7,159,669 B2 1/2007 Bailey et al.
7,165,610 B2 * 1/2007 Hopper ..... 166/84.4
7,174,956 B2 2/2007 Williams et al.
7,178,600 B2 2/2007 Luke et al.
7,191,840 B2 3/2007 Bailey et al.

(56) References Cited

U.S. PATENT DOCUMENTS

| | | | | |
|---|---|---|---|---|
| 7,198,098 | B2 | 4/2007 | Williams | |
| 7,204,315 | B2 | 4/2007 | Pia | |
| 7,219,729 | B2 | 5/2007 | Bostick et al. | |
| 7,237,618 | B2 | 7/2007 | Williams | |
| 7,237,623 | B2 | 7/2007 | Hannegan | |
| 7,240,727 | B2 | 7/2007 | Williams | |
| 7,243,958 | B2 | 7/2007 | Williams | |
| 7,255,173 | B2 | 8/2007 | Hosie et al. | |
| 7,258,171 | B2 | 8/2007 | Bailey | |
| 7,261,162 | B2 * | 8/2007 | Deans et al. | 166/336 |
| 7,270,185 | B2 | 9/2007 | Fontana et al. | |
| 7,278,494 | B2 | 10/2007 | Williams | |
| 7,278,496 | B2 | 10/2007 | Leuchtenberg | |
| 7,278,497 | B2 | 10/2007 | Terry et al. | |
| 7,296,628 | B2 | 11/2007 | Robichaux | |
| 7,308,954 | B2 | 12/2007 | Martin-Marshall | |
| 7,318,480 | B2 * | 1/2008 | Hosie et al. | 166/367 |
| 7,325,610 | B2 | 2/2008 | Giroux et al. | |
| 7,334,633 | B2 | 2/2008 | Williams et al. | |
| 7,347,261 | B2 | 3/2008 | Markel et al. | |
| 7,350,590 | B2 | 4/2008 | Hosie et al. | |
| 7,363,860 | B2 | 4/2008 | Wilson et al. | |
| 7,367,411 | B2 | 5/2008 | Leuchtenberg | |
| 7,377,334 | B2 | 5/2008 | May | |
| 7,380,590 | B2 | 6/2008 | Hughes | |
| 7,380,591 | B2 | 6/2008 | Williams | |
| 7,380,610 | B2 | 6/2008 | Williams | |
| 7,383,876 | B2 | 6/2008 | Gray et al. | |
| 7,389,183 | B2 | 6/2008 | Gray | |
| 7,392,860 | B2 | 7/2008 | Johnston | |
| 7,413,018 | B2 | 8/2008 | Hosie et al. | |
| 7,416,021 | B2 | 8/2008 | Williams | |
| 7,416,226 | B2 | 8/2008 | Williams | |
| 7,448,454 | B2 | 11/2008 | Bourgoyne et al. | |
| 7,451,809 | B2 | 11/2008 | Noske et al. | |
| 7,475,732 | B2 | 1/2009 | Hosie et al. | |
| 7,487,837 | B2 | 2/2009 | Bailey et al. | |
| 7,513,300 | B2 | 4/2009 | Pietras et al. | |
| 7,513,308 | B2 * | 4/2009 | Hosie et al. | 166/338 |
| 7,559,359 | B2 | 7/2009 | Williams | |
| 7,635,034 | B2 | 12/2009 | Williams | |
| 7,650,950 | B2 | 1/2010 | Leuchtenberg | |
| 7,654,325 | B2 | 2/2010 | Giroux et al. | |
| 7,669,649 | B2 | 3/2010 | Williams | |
| 7,699,109 | B2 | 4/2010 | May et al. | |
| 7,699,110 | B2 | 4/2010 | Anderson et al. | |
| 7,708,089 | B2 | 5/2010 | Williams | |
| 7,712,523 | B2 | 5/2010 | Snider et al. | |
| 7,717,169 | B2 | 5/2010 | Williams | |
| 7,717,170 | B2 | 5/2010 | Williams | |
| 7,726,416 | B2 | 6/2010 | Williams | |
| 7,743,823 | B2 | 6/2010 | Hughes et al. | |
| 7,762,320 | B2 | 7/2010 | Williams | |
| 7,762,338 | B2 * | 7/2010 | Fenton et al. | 166/348 |
| 7,766,100 | B2 | 8/2010 | Williams | |
| 7,779,903 | B2 | 8/2010 | Bailey et al. | |
| 7,789,132 | B2 | 9/2010 | Williams | |
| 7,789,172 | B2 | 9/2010 | Williams | |
| 7,793,719 | B2 | 9/2010 | Snider et al. | |
| 7,798,250 | B2 | 9/2010 | Williams | |
| 7,802,635 | B2 | 9/2010 | Leduc et al. | |
| 7,819,204 | B2 | 10/2010 | Bamford | |
| 7,823,665 | B2 | 11/2010 | Sullivan | |
| 7,836,946 | B2 | 11/2010 | Bailey et al. | |
| 7,836,973 | B2 | 11/2010 | Belcher et al. | |
| 7,878,242 | B2 | 2/2011 | Gray | |
| 7,918,273 | B2 | 4/2011 | Snider et al. | |
| 7,926,501 | B2 * | 4/2011 | Springett et al. | 137/14 |
| 7,926,560 | B2 | 4/2011 | Bailey et al. | |
| 7,926,593 | B2 | 4/2011 | Bailey et al. | |
| 7,934,545 | B2 | 5/2011 | Bailey et al. | |
| 8,016,033 | B2 | 9/2011 | Iblings et al. | |
| 8,033,335 | B2 | 10/2011 | Orbell et al. | |
| 8,082,988 | B2 | 12/2011 | Redlinger et al. | |
| 8,113,291 | B2 | 2/2012 | Bailey et al. | |
| 8,286,734 | B2 | 10/2012 | Hannegan et al. | |
| 8,322,432 | B2 | 12/2012 | Bailey et al. | |
| 8,464,525 | B2 * | 6/2013 | Springett et al. | 60/398 |
| 8,511,389 | B2 * | 8/2013 | Fenton | 166/368 |
| 8,770,297 | B2 | 7/2014 | Bailey et al. | |
| 2003/0047317 | A1 * | 3/2003 | Powers | 166/373 |
| 2003/0106712 | A1 | 6/2003 | Bourgoyne et al. | |
| 2003/0164276 | A1 | 9/2003 | Snider et al. | |
| 2004/0017190 | A1 | 1/2004 | McDearmon et al. | |
| 2005/0000698 | A1 | 1/2005 | Bailey et al. | |
| 2005/0151107 | A1 | 7/2005 | Shu | |
| 2005/0161228 | A1 | 7/2005 | Cook et al. | |
| 2006/0037782 | A1 | 2/2006 | Martin-Marshall | |
| 2006/0108119 | A1 | 5/2006 | Bailey et al. | |
| 2006/0144622 | A1 | 7/2006 | Bailey et al. | |
| 2006/0157282 | A1 | 7/2006 | Tilton et al. | |
| 2006/0191716 | A1 | 8/2006 | Humphreys | |
| 2007/0039738 | A1 | 2/2007 | Fenton et al. | |
| 2007/0051512 | A1 | 3/2007 | Markel et al. | |
| 2007/0095540 | A1 | 5/2007 | Kozicz | |
| 2007/0163784 | A1 | 7/2007 | Bailey | |
| 2007/0173957 | A1 | 7/2007 | Johansen et al. | |
| 2008/0017384 | A1 | 1/2008 | Anderson et al. | |
| 2008/0105462 | A1 | 5/2008 | May et al. | |
| 2008/0169107 | A1 | 7/2008 | Redlinger et al. | |
| 2008/0210471 | A1 | 9/2008 | Bailey et al. | |
| 2008/0236819 | A1 | 10/2008 | Foster et al. | |
| 2008/0245531 | A1 | 10/2008 | Noske et al. | |
| 2009/0025930 | A1 | 1/2009 | Iblings et al. | |
| 2009/0050373 | A1 | 2/2009 | Loretz | |
| 2009/0101351 | A1 | 4/2009 | Hannegan et al. | |
| 2009/0101411 | A1 | 4/2009 | Hannegan et al. | |
| 2009/0139724 | A1 | 6/2009 | Gray et al. | |
| 2009/0152006 | A1 | 6/2009 | Leduc et al. | |
| 2009/0166046 | A1 | 7/2009 | Edvardsen et al. | |
| 2009/0200747 | A1 | 8/2009 | Williams | |
| 2009/0211239 | A1 | 8/2009 | Askeland | |
| 2009/0236144 | A1 | 9/2009 | Todd et al. | |
| 2009/0301723 | A1 | 12/2009 | Gray | |
| 2010/0008190 | A1 | 1/2010 | Gray et al. | |
| 2010/0025047 | A1 | 2/2010 | Sokol | |
| 2010/0175882 | A1 | 7/2010 | Bailey et al. | |
| 2011/0024195 | A1 | 2/2011 | Hoyer | |
| 2011/0036629 | A1 | 2/2011 | Bailey et al. | |
| 2011/0036638 | A1 | 2/2011 | Sokol | |
| 2011/0155379 | A1 | 6/2011 | Bailey et al. | |
| 2011/0162835 | A1 | 7/2011 | Gray | |
| 2011/0168392 | A1 | 7/2011 | Bailey et al. | |
| 2011/0220357 | A1 | 9/2011 | Segura et al. | |
| 2011/0232919 | A1 | 9/2011 | Snider et al. | |
| 2011/0253445 | A1 | 10/2011 | Hannegan et al. | |
| 2011/0315404 | A1 | 12/2011 | Bailey et al. | |
| 2012/0000664 | A1 | 1/2012 | Nas et al. | |
| 2012/0013133 | A1 | 1/2012 | Rios, III et al. | |
| 2012/0061087 | A1 | 3/2012 | Iblings et al. | |
| 2012/0067594 | A1 | 3/2012 | Noske et al. | |
| 2012/0067595 | A1 | 3/2012 | Noske et al. | |
| 2012/0138366 | A1 | 6/2012 | Bailey et al. | |
| 2012/0318496 | A1 | 12/2012 | Bailey et al. | |

FOREIGN PATENT DOCUMENTS

| | | | |
|---|---|---|---|
| AU | 200028183 | B2 | 9/2000 |
| AU | 2010200137 | A1 | 7/2010 |
| AU | 2011317657 | A1 | 5/2013 |
| CA | 2363132 | A1 | 9/2000 |
| CA | 2447196 | A1 | 4/2004 |
| CA | 2690289 | | 7/2010 |
| CA | 2815101 | | 4/2012 |
| CA | 2815101 | A1 | 4/2012 |
| EP | 0290250 | A2 | 11/1988 |
| EP | 0290250 | A3 | 11/1988 |
| EP | 267140 | B1 | 3/1993 |
| EP | 0 896 125 | A2 | 2/1999 |
| EP | 1375817 | A1 | 1/2004 |
| EP | 1519003 | A1 | 3/2005 |
| EP | 1659260 | A2 | 5/2006 |
| EP | 2208855 | A2 | 7/2010 |
| GB | 1161299 | | 8/1969 |

(56) References Cited

FOREIGN PATENT DOCUMENTS

| | | | |
|---|---|---|---|
| GB | 1426622 | A | 3/1976 |
| GB | 2019921 | A | 11/1979 |
| GB | 2067235 | A | 7/1981 |
| GB | 2 362 668 | A | 11/2001 |
| GB | 2394738 | A | 5/2004 |
| GB | 2394741 | A | 5/2004 |
| GB | 2449010 | A | 8/2007 |
| WO | WO 93/06335 | | 4/1993 |
| WO | WO 94/10421 | A1 | 5/1994 |
| WO | WO 99/45228 | A1 | 9/1999 |
| WO | WO 99/49180 | A1 | 9/1999 |
| WO | WO 99/50524 | A2 | 10/1999 |
| WO | WO 99/51852 | A1 | 10/1999 |
| WO | WO 99/50524 | A3 | 12/1999 |
| WO | WO 00/52299 | A1 | 9/2000 |
| WO | WO 00/52300 | A1 | 9/2000 |
| WO | WO 01/23702 | A1 | 4/2001 |
| WO | WO 01/79654 | A1 | 10/2001 |
| WO | WO 02/36928 | A1 | 5/2002 |
| WO | WO 02/50398 | A1 | 6/2002 |
| WO | WO 03/071091 | A1 | 8/2003 |
| WO | WO 2006/088379 | A1 | 8/2006 |
| WO | WO 2007/092956 | A2 | 8/2007 |
| WO | WO 2008/133523 | A1 | 11/2008 |
| WO | WO 2008/156376 | A1 | 12/2008 |
| WO | WO 2009/017418 | A1 | 2/2009 |
| WO | WO 2009/123476 | A1 | 10/2009 |
| WO | WO 2012/052402 | A2 | 4/2012 |
| WO | WO2012/052402 | A2 | 4/2012 |

OTHER PUBLICATIONS

US 6,708,780, 11/2001, Bourgoyne, et al. (withdrawn).
U.S. Appl. No. 60/079,641, filed Mar. 27, 1998.
U.S. Appl. No. 60/122,530, filed Mar. 2, 1999.
U.S. Appl. No. 61/205,209, filed Jan. 15, 2009.
The Modular T BOP Stack System, Cameron Iron Works © 1985 (5 pages).
Cameron HC Collet Connector, © 1996 Cooper Cameron Corporation, Cameron Division (12 pages).
Riserless drilling: circumventing the size/cost cycle in deepwater—Conoco, Hydril project seek enabling technologies to drill in deepest water depths economically, May 1986 Offshore Drilling Technology (pp. 49, 50, 52, 53, 54 and 55).
Williams Tool Company—Home Page—Under Construction Williams Rotating Control Heads (2 pages); Seal-Ability for the pressures of drilling (2 pages); Williams Model 7000 Series Rotating Control Heads (1 page); Williams Model 7000 & 7100 Series Rotating Control Heads (2 pages); Williams Model IP1000 Rotating Control Head (2 pages); Williams Conventional Models 8000 & 9000 (2 pages); Applications Where Using a Williams rotating control head while drilling is a plus (1 page); Williams higher pressure rotating control head systems are Ideally Suited for New Technology Flow Drilling and Closed Loop Underbalanced Drilling (UBD) Vertical and Horizontal (2 pages); and How to Contact US (2 pages).
Offshore—World Trends and Technology for Offshore Oil and Gas Operations, Mar. 1998, Seismic: Article entitled, "Shallow Flow Diverter JIP Spurred by Deepwater Washouts" (3 pages including cover page, table of contents and p. 90).
Williams Tool Co., Inc. Rotating Control Heads and Strippers for Air, Gas, Mud, and Geothermal Drilling Worldwide—Sales Rental Service, © 1988 (19 pages).
Williams Tool Co., Inc. 19 page brochure © 1991 Williams Tool Co., Inc. (19 pages).
Fig. 19 Floating Piston Drilling Choke Design: May 1997.
Blowout Preventer Testing for Underbalanced Drilling by Charles R. "Rick" Stone and Larry A. Cress, Signa Engineering Corp., Houston, Texas (24 pages) Sep. 1997.
Williams Tool Co., Inc. Instructions, Assemble & Disassemble Model 9000 Bearing Assembly (cover page and 27 numbered pages).
Williams Tool Co., Inc. Rotating Control Heads Making Drilling Safer While Reducing Costs Since 1968, © 1989 (4 pages).
Williams Tool Company, Inc. International Model 7000 Rotating Control Head, 1991 (4 pages).
Williams Rotating Control Heads, Reduce Costs Increase Safety Reduce Environmental Impact, 4 pages, (© 1995).
Williams Rotating Control Heads, Reduce Costs Increase Safety Reduce Environmental Impact (4 pages).
Williams Tool Co., Inc. Sales-Rental-Service, Williams Rotating Control Heads and Strippers for Air, Gas, Mud, and Geothermal Drilling, © 1982 (7 pages).
Williams Tool Co., Inc., Rotating Control Heads and Strippers for Air, Gas, Mud, Geothermal and Pressure Drilling, © 1991 (19 pages).
An article—The Brief Jan. '96, The Brief's Guest Columnists, Williams Tool Co., Inc., Communicating Dec. 13, 1995 (Fort Smith, Arkansas), The When? and Why? of Rotating Control Head Usage, Copyright © Murphy Publishing, Inc. 1996 (2 pages).
A reprint from the Oct. 9, 1995 edition of Oil & Gas Journal, "Rotating control head applications increasing," by Adam T. Bourgoyne, Jr., Copyright 1995 by PennWell Publishing Company (6 pages).
1966-1967 Composite Catalog-Grant Rotating Drilling Head for Air, Gas or Mud Drilling (1 page).
1976-1977 Composite Catalog Grant Oil Tool Company Rotating Drilling Head Models 7068, 7368, 8068 (Patented), Equally Effective with Air, Gas, or Mud Circulation Media (3 pages).
A Subsea Rotating Control Head for Riserless Drilling Applications; Daryl A. Bourgoyne, Adam T. Bourgoyne, and Don Hannegan—1998 (International Association of Drilling Contractors International Deep Water Well Control Conference held in Houston, Texas, Aug. 26-27, 1998) (14 pages).
Hannegan, "Applications Widening for Rotating Control Heads," Drilling Contractor, cover page, table of contents and pp. 17 and 19, Drilling Contractor Publications Inc., Houston, Texas, Jul. 1996.
Composite Catalog, Hughes Offshore 1986-87 Subsea Systems and Equipment, Hughes Drilling Equipment Composite Catalog (pp. 2986-3004).
Williams Tool Co., Inc. Technical Specifications Model for The Model 7100, (3 pages).
Williams Tool Co., Inc. Website, Underbalanced Drilling (UBD), The Attraction of UBD (2 pages).
Williams Tool Co., Inc. Website,. "Applications, Where Using a Williams Rotating Control Head While Drilling is a Plus" (2 pages).
Williams Tool Co., Inc. Website, "Model 7100," (3 pages).
Composite Catalog, Hughes Offshore 1982/1983, Regan Products, © Copyright 1982 (Two cover sheets and 4308-27 thru 4308-43, and end sheet). See p. 4308-36 Type KFD Diverter.
Coflexip Brochure; 1—Coflexip Sales Offices, 2—the Flexible Steel Pipe for Drilling and Service Applications, 3—New 5" I.D. General Drilling Flexible, 4—Applications, and 5—Illustration (5 unnumbered pages).
Baker, Ron, "A Primer of Oilwell Drilling," Fourth Edition, Published Petroleum Extension Service, The University of Texas at Austin, Austin, Texas, in cooperation with International Association of Drilling Contractors Houston, Texas © 1979 (3 cover pages and pp. 42-49 re Circulation System).
Brochure, Lock down Lubricator System, Dutch Enterprises, Inc., "Safety with Savings" (cover sheet and 16 unnumbered pages); see above U.S. Pat. No. 4,836,289 referred to therein.
Hydril GL series Annual Blowout Preventers (Patented—see Roche patents above), (cover sheet and 2 pages).
Other Hydril Product Information (The GH Gas Handler Series Product is Listed), © 1996, Hydri Company (Cover sheet and 19 pages).
Brochure, Shaffer Type 79 Rotating Blowout Preventer, NL Rig Equipment/NL Industries, Inc., (6 unnumbered pages).
Shaffer, A Varco Company, (Cover page and pages 1562-1568).
Avoiding Explosive Unloading of Gas in a Deep Water Riser When SOBM in Use; Colin P. Leach & Joseph R. Roche—1998 (The Paper Describes an Application for the Hydril Gas Handler, The Hydril GH 211-2000 Gas Handler is Depicted in Figure 1 of the Paper) (9 unnumbered pages).
Feasibility Study of Dual Density Mud System for Deepwater Drilling Operations; Clovis A. Lopes & A.T. Bourgoyne, Jr.—1997 (Offshore Technology Conference Paper No. 8465); (pp. 257-266).

(56) References Cited

OTHER PUBLICATIONS

Apr. 1998 Offshore Drilling with Light Weight Fluids Joint Industry Project Presentation (9 unnumbered pages).
Nakagawa, Edson Y., Santos, Helio and Cunha, J.C., "Application of Aerated-Fluid Drilling in Deepwater," SPE/IACDC 52787 Presented by Don Hannegan, P.E., SPE © 1999 SPE/IADC Drilling Conference, Amsterdam, Holland, Mar. 9-11, 1999 (5 unnumbered pages).
Brochure: "Inter-Tech Drilling Solutions, Ltd.'s RBOP™ Means Safety and Experience for Underbalanced Drilling," Inter-Tech Drilling Solutions Ltd./Big D Rentals & Sales (1981) Ltd. and Color Copy of "Rotating BOP" (2 unnumbered pages).
"Pressure Control While Drilling," Shaffer® A Varco Company, Rev. A (2 unnumbered pages).
Field Exposure (As of Aug. 1998), Shaffer® A Varco Company (1 unnumbered page).
Graphic: "Rotating Spherical BOP" (1 unnumbered page).
"JIP's Worl Brightens Outlook for UBD in Deep Waters" by Edson Yoshihito Nakagawa, Helio Santos and Jose Carlos Cunha, American Oil & Gas Reporter, Apr. 1999, pp. 53, 56, 58-60 and 63.
"Seal-Tech 1500 PSI Rotating Blowout Preventer," Undated, 3 pages.
"RPM System 3000™ Rotating Blowout Preventer, Setting a new standard in Well Control," by Techcorp Industries, Undated, 4 pages.
"RiserCap™ Materials Presented at the 1999 LSU/MMS/IADC Well Control Workshop", by Williams Tool Company, Inc., Mar. 24-25, pp. 1-14.
"The 1999 LSU/MMS Well Control Workshop: An overview," by John Rogers Smith. World Oil, Jun. 1999. Cover page and pp. 4, 41-42, and 44-45.
Dag Oluf Nessa, "Offshore underbalanced drilling system could revive field developments," World Oil, vol. 218, No. 10, Oct. 1997, 1 unnumbered page and pp. 83-84, 86, and 88.
D.O. Nessa, "Offshore underbalanced drilling system could revive field developments," World Oil Exploration Drilling Production, vol. 218, No. 7, Color pages of Cover Page and pp. 3, 61-64, and 66, Jul. 1997.
PCT Search Report, International Application No. PCT/US99/06695, 4 pages (Date of Completion May 27, 1999).
PCT Search Report, International Application No. PCT/GB00/00731, 3 pages (Date of Completion Jun. 16, 2000).
National Academy of Sciences—National Research Council, "Design of a Deep Ocean Drilling Ship," Cover Page and pp. 114-121. Undated but cited in above U.S. Pat. No. 6,230,824B1.
"History and Development of a Rotating Preventer," by A. Cress, Rick Stone, and Mike Tangedahl, IADC/SPE 23931, 1992 IADC/SPE Drilling Conference, Feb. 1992, pp. 757-773.
Helio Santos, Email message to Don Hannegan, et al., 1 page (Aug. 20, 2001).
Rehm, Bill, "Practical Underbalanced Drilling and Workover," Petroleum Extension Service, The University of Texas at Austin Continuing & Extended Education, Cover page, title page, copyright page, and pp. 6-6, 11-2, 11-3, G-9, and G-10 (2002).
Williams Tool Company Inc., "RISERCAP™: Rotating Control Head System for Floating Drilling Rig Applications," 4 unnumbered pages, (© 1999 Williams Tool Company, Inc.).
Antonio C.V.M. Lage, Helio, Santos and Paulo R.C. Silva, Drilling With Aerated Drilling Fluid From a Floating Unit Part 2: Drilling the Well, SPE 71361, 11 pages (© 2001, Society of Petroleum Engineers, Inc.).
Helio Santos, Fabio Rosa, and Christian Leuchtenberg, Drilling and Aerated Fluid from a Floating Unit, Part 1: Planning, Equipment, Tests, and Rig Modifications, SPE/IADC 67748, 8 pages (© 2001 SPE/IADC Drilling Conference).
E.Y. Nakagawa, H. Santos, J.C. Cunha and S. Shayegi, Planning of Deepwater Drilling Operations with Aerated Fluids, SPE 54283, 7 pages, (© 1999, Society of Petroleum Engineers).
E.Y. Nakagawa, H.M.R. Santos and J.C. Cunha, Implementing the Light-Weight Fluids Drilling Technology in Deepwater Scenarios, 1999 LSU/MMS Well Control Workshop Mar. 24-25, 1999, 12 pages (1999).
Press Release, "Stewart & Stevenson Introduces First Dual Gradient Riser," Stewart & Stevenson, http:/www.ssss/com/ssss/20000831.asp, 2 pages (Aug. 31, 2000).
Press Release: "Stewart & Stevenson introduces First Dual Gradient Riser," Stewart & Stevenson, http:www/ssss/com/ssss/20000831.asp, 2 pages (Aug. 31, 2000).
Williams Tool Company Inc., "Williams Tool Company Introduces the . . . Virtual Riser™," 4 unnumbered pages, (© 1998 Williams Tool Company, Inc.).
"PETEX Publications," Petroleum Extension Service, University of Texas at Austin, 12 pages, (last modified Dec. 6, 2002).
"BG in the Caspian region," SPE Review, Issue 164, 3 unnumbered pages (May 2003).
"Field Cases as of Mar. 3, 2003," Impact Fluid Solutions, 6 pages (Mar. 3, 2003).
"Determine in the Safe Application of Underbalanced Drilling Technologies in Marine Environments—Technical Proposal," Maurer Technology, Inc., Cover Page and pp. 2-13 (Jun. 17, 2002).
Colbert, John W., "John W. Colbert, P.E. Vice President Engineering Biographical Data," Signa Engineering Corp., 2 unnumbered pages (undated).
"Technical Training Courses," Parker Drilling Co., http:/www.parkerdrilling.com/news/tech.html, 5 pages (last visited, Sep. 5, 2003).
"Drilling equipment: Improvements from data recording to slim hole," Drilling Contractor, pp. 30-32, (Mar./Apr. 2000).
"Drilling conference promises to be informative," Drilling Contractor, p. 10 (Jan./Feb. 2002).
"Underbalanced and Air Drilling," OGCI, Inc., http:/www.ogci.com/course_info.asp?counseID=410, 2 pages, (2003).
"2003 SPE Calendar," Society of Petroleum Engineers, Google cache of http:/www.spe.org/spe/cda/views/events/eventMaster/0,1470,1648_2194_632303.00.html; for "mud cap drilling", 2 pages (2001).
"Oilfield Glossary: reverse-circulating valve," Schlumberger Limited, 1 page (2003).
Murphy, Ross D. and Thompson, Paul B., "A drilling contractor's view of underbalanced drilling," World Oil Magazine, vol. 223, No. 5, 9 pages (May 2002).
"Weatherford UnderBalanced Services: General Underbalance Presentation to the DTI," 71 unnumbered pages, © 2002.
Rach, Nina M., "Underbalanced near-balanced drilling are possible offshore," Oil & Gas Journal, Color Copies, pp. 39-44, (Dec. 1, 2003).
Forrestt, Neil; Bailey, Tom; Hannegan, Don; "Subsea Equipment for Deep Water Drilling Using Dual Gradient Mud System," SPE/IADC 67707, pp. 1-8, (© 2001, SPE/IADC Drilling Conference) held in Amsterdam, The Netherlands, Feb. 27, 2001 to Mar. 1, 2001, Paper SPE/IADC 67707, © 2001 SPE/IADC Drilling Conference (8 pages); particularly see p. 3, col. 1, ¶ 4 and col. 2, ¶ 5 and Figs. 4-6.
Hannegan, D.M.; Bourgoyne, Jr., A.T.: "Deepwater Drilling with Lightweight Fluids—Essential Equipment Required," SPE/IADC 67708, pp. 1-6 (© 2001, SPE/IADC Drilling Conference).
Hannegan, Don M., "Underbalanced Operations Continue Offshore Movement," SPE 68491, pp. 1-3, (© 2001, Society of Petroleum Engineers, Inc.).
Hannegan, D. and Divine, R., "Underbalanced Drilling—Perceptions and Realities of Today's Technology in Offshore Applications," IADC/SPE 74448, p. 1-9, (© 2002, IADC/SPE Drilling Conference).
Hannegan, Don M. and Wanzer, Glen: "Well Control Considerations—Offshore Applications of Underbalanced Drilling Technology," SPE/IADC 79854, pp. 1-14, (© 2003, SPE/IADC Drilling Conference).
Bybee, Karen, "Offshore Applications of Underbalanced—Drilling Technology," Journal of Petroleum Technology, Cover Page and pp. 51-52, (Jan. 2004).
Bourgoyne, Darryl A.; Bourgoyne, Adam T.; Hannegan, Don; "A Subsea Rotating Control Head for Riserless Drilling Applications," IADC International Deep Water Well Control Conference, pp. 1-14, (Aug. 26-27, 1998).

(56) References Cited

OTHER PUBLICATIONS

Lage, Antonio C.V.M.; Santos, Helio; Silva, Paulo R.C.; "Drilling With Aerated Drilling Fluid From a Floating Unit Part 2: Drilling the Well," Society of Petroleum Engineers, SPE 71361, pp. 1-11 (Sep. 30-Oct. 3, 2001).
Furlow, William; "Shell's seafloor pump, solids removal key to ultra-deep, dual-gradient drilling (Skid ready for commercialization), "Offshore World Trends and Technology for Offshore Oil and Gas Operations, Cover page, table of contents, pp. 54, 2 unnumbered pages, and 106 (Jun. 2001).
Rowden, Michael V.: "Advances in riserless drilling pushing the deepwater surface string envelope (Alternative to seawater, CaCl2 sweeps); "Offshore World Trends and Technology for Offshore Oil and Gas Operations, Cover page, table of contents, pp. 56, 58, and 106 (Jun. 2001).
Boye, John: "Multi Purpose Intervention Vessel Presentation," M.O. S.T. Multi Operational Service Tankers, Weatherford International, Jan. 2004, 43 pages (© 2003)
GB Search Report, International Application No. GB 0324939.8, 1 page (Jan. 21, 2004).
MicroPatent® list of patents citing U.S. Pat. No. 3,476,195, printed on Jan. 24, 2003.
PCT Search Report, International Application No. PCT/EP2004/052167, 4 pages (Date of Completion Nov. 25, 2004).
PCT Written Opinion of the International Searching Authority, International Application No. PCT/EP2004/052167, 6 pages.
Supplementary European Search Report No. EP 99908371, 3 pages (Date of Completion Oct. 22, 2004).
*General Catalog*, 1970-1971, Vetco Offshore, Inc., Subsea Systems; cover page, company page and numbered pp. 4800, 4816-4818; 6 pages total, in particular see numbered p. 4816 for "patented" Vetco H-4 connectors.
*General Catalog*, 1972-73, Vetco Offshore, Inc., Subsea Systems; cover page; company page and numbered pp. 4498, 4509-4510; 5 pages total.
*General Catalog*, 1974-75, Vetco Offshore, Inc.; cover page, company page and numbered pp. 5160, 5178-5179; 5 pages total.
*General Catalog*, 1976-1977, Vetco Offshore, Inc., Subsea Drilling and Completion Systems; cover page and numbered pp. 5862-5863; 4 pages total.
*General Catalog*, 1982-1983, Vetco; cover page and numbered pp. 8454-8455, 8479; 4 pages total.
*Shaffer, A Varco Company: Pressure Control While Drilling System*, http:/www.tulsaequipm.com printed Jun. 21, 2004; 2 pages.
*Performance Drilling by Precision Drilling. A Smart Equation*, Precision Drilling, © 2002 Precision Drilling Corporation; 12 pages, in particular see 9th page for "Northland's patented RBOP . . . "
*RPM System, 3000™ Rotating Blowout Preventer: Setting a New Standard in Well Control*, Weatherford, Underbalanced Systems: © 2002-2005 Weatherford; Brochure #333.01, 4 pages.
*Managed Pressure Drilling in Marine Environments*, Don Hannegan, P.E.; Drilling Engineering Association Workshop, Moody Gardens, Galveston, Jun. 22-23, 2004; © 2004 Weatherford, 28 pages.
Hold™ 2500 RCD Rotating Control Device web page and brochure, http://www.smith.com/hold2500; printed Oct. 27, 2004, 5 pages.
Rehm, Bill, "Practical Underbalanced Drilling and Workover," Petroleum Extension Service, The University of Texas at Austin Continuing & Extended Education, cover page, title page, copyright page and pp. 6-1 to 6-9, 7-1 to 7-9 (2002).
"Pressured Mud Cap Drilling from a Semi-Submersible Drilling Rig," J.H. Terwogt, SPE, L.B. Makiaho and N. van Beelen, SPE, Shell Malaysia Exploration and Production; B.J. Gedge, SPE, and J. Jenkins, Weatherford Drilling and Well Services (6 pages total); © 2005 (This paper was prepared for presentation at the SPE/IADC Drilling Conference held in Amsterdam, The Netherlands, Feb. 23-25, 2005).
Tangedahl, M.J., et al., "Rotating Preventers: Technology for Better Well Control," World Oil, Gulf Publishing Company, Houston, TX, US, vol. 213, No. 10, Oct. 1992, numbered pp. 63-64 and 66 (3 pages).
European Search Report for EP 05 27 0083, Application No. 05270083.8-2315, European Patent Office, Mar. 2, 2006, corresponding to U.S. Appl. No. 10/995,980, published as US2006/0108119 A1 (now U.S. Pat. No. 7,487,837 B2) (5 pages).
Netherlands Search Report for NL No. 1026044, dated Dec. 14, 2005 (3 pages).
Int'l Search Report for PCT/GB 00/00731 corresponding to U.S. Pat. No. 6,470,975 (Jun. 16, 2000) (2 pages).
GB0324939.8 Examination Report corresponding to U.S. Pat. No. 6,470,975 (Mar. 21, 2006) (6 pages).
GB0324939.8 Examination Report corresponding to U.S. Pat. No. 6,470,975 Jan. 22, 2004) (3 pages).
2003/0106712 Family Lookup Report (Jun. 15, 2006) (5 pages).
U.S. Pat. No. 6,470,975 Family Lookup Report (Jun. 15, 2006) (5 pages).
AU S/N 28183/00 Examination Report corresponding to U.S. Pat. No. 6,470,975 (1 page) (Sep. 9, 2002).
NO S/N 20013953 Examination Report corresponding to U.S. Pat. No. 6,470,975 w/one page of English translation (3 pages) (Apr. 29, 2003).
Nessa, D.O. & Tangedahl, M.L. & Saponia, J: Part 1: "Offshore underbalanced drilling system could revive field developments," World Oil, vol. 218, No. 7, Cover Page, 3, 61-64 and 66 (Jul. 1997); and Part 2: "Making this valuable reservoir drilling/completion technique work on a conventional offshore drilling platform." World Oil, vol. 218 No. 10, Cover Page, 3, 83, 84, 86 and 88 (Oct. 1997).
Int'l Search Report for PCT/GB 00/00731 corresponding to U.S. Pat. No. 6, 470,975 (4 pages) (Jun. 27, 2000).
Int'l. Preliminary Examination Report for PCT/GB 00/00731 corresponding to U.S. Pat. No. 6,470,975 (7 pages) (Dec. 14, 2000).
NL Examination Report for WO 00/52299 corresponding to this U.S. Appl. No. 10/281,534 (3 pages) (Dec. 19, 2003).
AU S/N 28181/00 Examination Report corresponding to U.S. Pat. No. 6,263,982 (1 page) (Sep. 6, 2002).
EU Examination Report for WO 00/906522.8-2315 corresponding to U.S. Pat. No. 6,263,982 (4 pages) (Nov. 29, 2004).
NO S/N 20013952 Examination Report w/two pages of English translation corresponding to U.S. Pat. No. 6,263,982 (4 pages) (Jul. 2, 2005).
PCT/GB00/00726 Int'l. Preliminary Examination Report corresponding to U.S. Pat. No. 6,263,982 (10 pages) (Jun. 26, 2001).
PCT/GB00/00726 Written Opinion corresponding to U.S. Pat. No. 6,263,982 (7 pages) (Dec. 18, 2000).
PCT/GB00/00726 International Search Report corresponding to U.S. Pat. No. 6,263,982 (3 pages (Mar. 2, 1999).
AU S/N 27822/99 Examination Report corresponding to U.S. Pat. No. 6,138,774 (1 page) (Oct. 15, 2001).
EU 99908371.0-1266-US99/03888 European Search Report corresponding to U.S. Pat. No. 6,138,774 (3 pages) (Nov. 2, 2004).
NO S/N 20003950 Examination Report w/one page of English translation corresponding to U.S. Pat. No. 6,138,774 (3 pages) (Nov. 1, 2004).
PCT/US990/03888 Notice of Transmittal of International Search Report corresponding to U.S. Pat. No. 6,138,774 (6 pages) (Aug. 4, 1999).
PCT/US99/03888 Written Opinion corresponding to U.S. Pat. No. 6,138,744 (5 pages) (Dec. 21, 1999).
PCT/US99/03888 Notice of Transmittal of International Preliminary Examination Report corresponding to U.S. Pat. No. 6,138,774 (15 pages) (Jun. 12, 2000).
EU Examination Report for 05270083.8-2315 corresponding to U.S. Appl. No. 10/995,980, published as US 2006/0108119 A1 (now U.S. Pat. No. 7,487,837 B2) (11 pages) (May 10, 2006).
Tangedahl, M.J., et al. "Rotating Preventers: Technology for Better Well Control," World Oil, Gulf Publishing Company, Houston, TX, US, vol. 213, No. 10, Oct. 1992, (Oct. 1, 1992) numbered pp. 63-64 and 66 (3 pages) XP 000288328 ISSN: 0043-8790.
UK Search Report for Application No. GB 0325423.2, searched Jan. 30, 2004 corresponding to above U.S. Pat. No. 7,040,394 (one page).
UK Examination Report for Application No. GB 0325423.2 (4 pages).

(56) References Cited

OTHER PUBLICATIONS

Dietle, Lannie L., et al., Kalsi Seals Handbook, Document. 2137 Revision 1, © 1992-2005 Kalsi Engineering, Inc. of Sugar Land, Texas USA; front and back covers and 164 total pages; in particular forward p. ii for "Patent Rights"; Appendix A-6 for Kalsi seal part No. 381-6- and A-10 for Kalsi seal part No. 432-32-. as discussed in U.S. Appl. No. 11/366,078 application (now U.S. Pat. No. 7,836,946 B2) at No. paragraph 70 and 71.
Fig. 10 and discussion in U.S. Appl. No. 11/366,078 application, published as US2006/0144622 A1 (now U.S. Pat. No. 7,836,946 B2) of Background of Invention.
Partial European search report R.46 EPC dated Jun. 27, 2007 for European Patent Application EP07103416.9-2315 corresponding to U.S. Appl. No. 11/366,078, published as US 2006/0144622 A1, now U.S. Pat. No. 7,836,946 (5 pages).
Extended European search report R.44 EPC dated Oct. 9, 2007 for European Patent Application 07103416.9-2315 corresponding to U.S. Appl. No. 11/366,078, published as US-2006/0144622 A1, now U.S. Pat. No. 7,836,946 (8 pages).
U.S. Appl. No. 60/079,641, Mudlift System for Deep Water Drilling, filed Mar. 27, 1998, abandoned, but priority claimed in above U.S. Pat. No. 6,230,824 B1 and U.S. Pat. No. 6,102,673 and PCT WO-99/50524 (54 pages).
U.S. Appl. No. 60/122,530, Concepts for the Application of Rotating Control Head Technology to Deepwater Drilling Operations, filed Mar. 2, 1999, abandoned, but priority claimed in above U.S. Pat. No. 6,470,975 B1 (54 pages).
PCT/GB2008/050239 (corresponding to US2008/0210471 A1; now issued as U.S. Pat. No. 7,926,593) Annex to Form PCT/ISA/206 Communication Relating to the Results of the Partial International Search dated Aug. 26, 2008 (4 pages).
PCT/GB2008/050239 (corresponding to US2008/0210471 A1; now issued as U.S. Pat. No. 7,926,593) International Search Report and Written Opinion of the International Searching Authority (19 pages).
Vetco Gray Product Information CDE-PI-0007 dated Mar. 1999 for 59.0" Standard Bore CSO Diverter (2 pages) © 1999 by Vetco Gray Inc.
Vetco Gray Capital Drilling Equipment KFDJ and KFDJ Model "J" Diverters (1 page) (no date).
Hydril Blowout Preventers Catalog M-9402 D (44 pages) © 2004 Hydrill Company LP; see annular and ram BOP seals on p. 41.
Hydril Compact GK® 7 1/16"-3000 & 5000 psi Annular Blowout Preventers, Catalog 9503B © 1999 Hydril Company (4 pages).
Weatherford Controlled Pressure Drilling Williams® Rotating Marine Diverter Insert (2 pages).
Weatherford Controlled Pressure Drilling Model 7800 Rotating Control Device © 2007 Weatherford(5 pages).
Weatherford Controlled Pressure Drilling® and Testing Services Williams® Model 8000/9000 Conventional Heads © 2002-2006 Weatherford(2 pages).
Weatherford "Real Results Rotating Control Device Resolves Mud Return Issues in Extended-Reach Well, Saves Equipment Costs and Rig Time" © 2007 Weatherford and "Rotating Control Device Ensures Safety of Crew Drilling Surface-Hole Section" © 2008 Weatherford (2 pages).
Washington Rotating Control Heads, Inc. Series 1400 Rotating Control Heads ("Shorty") printed Nov. 21, 2008 (2 pages).
Smith Services product details for Rotating Control Device—RDH 500® printed Nov. 24, 2008 (4 pages).
American Petroleum Institute Specification for Drill Through Equipment—Rotating Control Devices, API Specification 16RCD, First Edition, Feb. 2005 (84 pages).
Weatherford Drilling & Intervention Services Underbalanced Systems RPM System 3000™ Rotating Blowout Preventer, Setting a New Standard in Well Control, An Advanced Well Control System for Underbalanced Drilling Operations, Brochure #333.00, © 2002 Weatherford (4 pages).
Medley, George; Moore, Dennis; Nauduri, Sagar; Signa Engineering Corp.; SPE/IADC Managed Pressure Drilling & Underbalanced Operations (PowerPoint presentation; 22 pages).
Secure Drilling Well Controlled, Secure Drilling™ System using Micro-Flux Control Technology, © 2007 Secure Drilling (12 pages).
The LSU Petroleum Engineering Research & Technology Transfer Laboratory, 10-rate Step Pump Shut-down and Start-up Example Procedure for Constant Bottom Hole Pressure Manage Pressure Drilling Applications (8 pages).
United States Department of the Interior Minerals Management Service Gulf of Mexico OCS Region NTL No. 2008-G07; Notice to Lessees and Operators of Federal Oil, Gas, and Sulphur Leases in the Outer Continental Shelf, Gulf of Mexico OCS Region, Managed Pressure Drilling Projects; Issue Date: May 15, 2008; Effective Date: Jun. 15, 2008; Expiration Date: Jun. 15, 2013 (9 pages).
Gray, Kenneth; Dynamic Density Control Quantifies Well Bore Conditions in Real Time During Drilling; American Oil & Gas Reporter, Jan. 2009 (4 pages).
Kotow, Kenneth J.; Pritchard, David M.; Riserless Drilling with Casing: A New Paradigm for Deepwater Well Design, OTC-19914-PP, © 2009 Offshore Technology Conference, Houston, TX May 4-7, 2009 (13 pages).
Hannegan, Don M.; Managed Pressure Drilling—A New Way of Looking at Drilling Hydraulics—Overcoming Conventional Drilling Challenges; SPE 2006-2007 Distinguished Lecturer Series presentation (29 pages); see all but particularly see Figs. 14-20.
Turck Works Industrial Automation; Factor 1 Sensing for Metal Detection, cover page, first page and numbered pp. 1.157 to 1.170 (16 pages) (printed in Jan. 2009).
Balluff Sensors Worldwide; Object Detection Catalog 08/09—Industrial Proximity Sensors for Non-Contact Detection of Metallic Targets at Ranges Generally under 50mm (2 inches); Linear Position and Measurement; Linear Position Transducers; Inductive Distance Sensors; Photoelectric Distance Sensors; Magneto-Inductive Linear Position Sensors; Magnetic Linear/Rotary Encoder System; printed Dec. 23, 2008 (8 pages).
Inductive Sensors AC 2-Wire Tubular Sensors, Balluff product catalog pp. 1.109-1.120 (12 pages) (no date).
Inductive Sensors DC 2-Wire Tubular Sensors, Balluff product catalog pp. 1.125-1.136 (12 pages) (no date).
Inductive Sensors Analog Inductive Sensors, Balluff product catalog pp. 1.157-1.170 (14 pages) (no date).
Inductive Sensors DC 3-/4-Wire Inductive Sensors, Balluff product catalog pp. 1.72-1.92 (21 pages).
Selecting Position Transducers: How to Choose Among Displacement Sensor Technologies; How to Choose Among Draw Wire, LVDT, RVDT, Potentiometer, Optical Encoder, Ultrasonic, Magnetostrictive, and Other Technologies; © 1996-2010, Space Age Control, Inc., printed Jan. 11, 2009 (7 pages) (www..spaceagecontrol.com/selpt.htm).
Liquid Flowmeters, Omega.com website; printed Jan. 26, 2009 (13 pages).
Super Autochoke—Automatic Pressure Regulation Under All Conditions ©2009 M-I, LLC; MI Swaco website; printed Apr. 2, 2009 (1 page).
Extended European Search Report R.61 EPC dated Sep. 16, 2010 for European Patent Application 08166660.4-1266/2050924 corresponding to U.S. Appl. No. 11/975,554, now US 2009/0101351 A1 (7 pages).
Office Action from the Canadian Intellectual Property Office dated Nov. 13, 2008 for Canadian Application No. 2,580,177 corresponding to U.S. Appl. No. 11/366,078, published as US-2006/0144622 A1, now U.S. Pat. No. 7,836,946 B2 (3 pages).
Response to 70 above, European Patent Application No. 08719084.9 (corresponding to the present published application US2008/0210471 A1, now issued as U.S. Pat. No. 7,926,593) dated Nov. 16, 2010 (4 pages).
Office Action from the Canadian Intellectual Property Office dated Apr. 15, 2008 for Canadian Application No. 2,527,395 corresponding to U.S. Appl. No. 10/995,980, published as US-2006/0108119 A1, now U.S. Pat. No. 7,487,837 B2 (3 pages).
Office Action from the Canadian Intellectual Property Office dated Apr. 9, 2009 for Canadian Application No. 2,527,395 corresponding to U.S. Appl. No. 10/995,980, published as US-2006/0108119 A1, now U.S. Pat. No. 7,487,837 B2 (2 pages).

(56) References Cited

OTHER PUBLICATIONS

Office Action from the Canadian Intellectual Property Office dated Dec. 15, 2009 for Canadian Application No. 2,681,868 corresponding to U.S. Appl. No. 10/995,980, published as US-2006/0108119 A1, now U.S. Pat. No. 7,487,837 B2 (2 pages).
Examiner's First Report on Australian Patent Application No. 2005234651 from the Australian Patent Office dated Jul. 22, 2010 corresponding to U.S. Appl. No. 10/995,980, published as US-2006/0108119 A1, now U.S. Pat. No. 7,487,837 B2 (2 pages).
Office Action from the Canadian Intellectual Property Office dated Sep. 9, 2010 for Canadian Application No. 2,707,738 corresponding to U.S. Appl. No. 10/995,980, published as US-2006/0108119 A1, now U.S. Pat. No. 7,487,837 B2 (2 pages).
Web page of Ace Wire Spring & Form Company, Inc. printed Dec. 8, 2009 for "Garter Springs—Helical Extension & Compression" www..acewirespring.com/garter-springs.html (1 page).
Extended European Search Report (R 61 EPC) dated Mar. 4, 2011 for European Application No. 08166658.8-1266/2053197 corresponding to U.S. Appl. No. 11/975,946, published as US 2009-0101411 A1 (13 pages).
Canadian Intellectual Property Office Office Action dated Dec. 7, 2010, Application No. 2,641,238 entitled "Fluid Drilling Equipment" for Canadian Application corresponding to U.S. Appl. No. 11/975,946, published as US 2009-0101411 A1 (4 pages).
Grosso, J.A., "An Analysis of Well Kicks on Offshore Floating Drilling Vessels," SPE 4134, Oct. 1972, pp. 1-20, @ 1972 Society of Petroleum Engineers (20 pages).
Bourgoyne, Jr., Adam T., et al., "Applied Drilling Engineering," pp. 168-171, © 1991 Society of Petroleum Engineers (6 pages).
Wagner, R.R., et al., "Surge Field Tests Highlight Dynamic Fluid Response," SPE/IADC 25771, Feb. 1993, pp. 883-892, © 1993 SPE/IADC Drilling, Conference (10 pages).
Solvang, S.A., et al., "Managed Pressure Drilling Resolves Pressure Depletion Related Problems in the Development of the HPHT Kristin Field," SPE/IADC 113672, Jan. 2008, pp. 1-9, © 2008 IADC/SPE Managed Pressure Drilling and Underbalanced Operations Conference and Exhibition (9 pages).
Rasmussen, Ovle Sunde, et al., "Evaluation of MPD Methods for Compensation of Surge-and-Swab Pressures in Floating Drilling Operations," IADC/SPE 108346, Mar. 2007, pp. 1-11, © 2007 IADC/SPE Managed Pressure Drilling and Underbalanced Operations Conference and Exhibition (11 pages).
Shaffer Drill String Compensator available from National Oilwell Varco of Houston, Texas, printed Mar. 23, 2010 from http://www.nov.com/ProductDisplay.aspx?ID=4954&taxID=121 &terms=drill+string+compensators (1 page).
Shaffer Crown Mounted Compensator available from National Oilwell Varco of Houston, Texas, printed Mar. 23, 2010 from http://www.nov.com/ProductDisplay.aspx?ID=4949&taxID=121 &terms=active+drill+string+compensator (3 pages).
Active heave compensator available from National Oilwell Varco of Houston, Texas, printed Mar. 23, 2010 from http://www.nov.com/ProductDisplay.aspx?ID=3677&taxID=740 &terms=active+heave+compensator (3 pages).
Durst, Doug, et al., "Subsea Downhole Motion Compensator (SDMC): Field History, Enhancements, and the Next Generation," IADC/SPE 59152, Feb. 2000, pp. 1-12, © 2000 Society of Petroleum Engineers, Inc. (12 pages).
Sensoy, Taner, et al., Weatherford Secure Drilling Well Controlled Report "Surge and Swab effects due to the Heave motion of floating rigs", Nov. 10, 2009 (7 pages).
Hargreaves, David, et al., "Early Kick Detection for Deepwater Drilling: New Probabilistic Methods Applied in the Field", SPE 71369, © 2001, Society of Petroleum Engineers, Inc. (11 pages).
HH Heavy-Duty Hydraulic Cylinders catalog, The Sheffer Corporation, printed Mar. 5, 2010 from http://www.sheffercorp.com/layout_contact.shtm (27 pages).
Unocal Baroness Surface Stack Upgrade Modifications (5 pages).
Thomson, William T., Professor of Engineering, University of California, "Vibration Theory and Applications", © 1848, 1953, 1965 by Prentice-Hall, Inc. title page, copyright page, contents page and numbered pp. 3-9 (10 pages).
Active Heave Compensator, Ocean Drilling Program, www.oceandrilling.org (3 pages).
3.3 Floating Offshore Drilling Rigs (Floaters); 3.3.1. Technologies Required by Floaters; 3.3.2. Drillships; 3.3.3. Semisubmersible Drilling Rig; 4.3.4. Subsea Control System; 4.4. Prospect of Offshore Production System (5 pages).
Weatherford® Real Results First Rig Systems Solutions for Thailand Provides Safer, More Efficient Operations with Stabmaster® and Automated Side Doors, © 2009 Weatherford document No. 6909.00 discussing Weatherford's Integrated Safety Interlock System (ISIS) (1 page).
U.S. Appl. No. 61/205,209, filed Jan. 15, 2009; Abandoned, but priority claimed in US2010/0175882A1 (24 pages).
Smalley® Steel Ring Company, Spirolox®; pages from website http://www.spirolox.com/what_happened.php printed Apr. 27, 2010 (5 pages).
Extended European Search Report (R 61 EPC) dated Aug. 25, 2011 for European Application No. 11170537.2-2315 corresponding to U.S. Appl. No. 13/048,497 published as US2011/0168932 A1 on Jul. 14, 2011 and its divisional of U.S. Appl. No. 12/080,170, filed Mar. 31, 2008, now U.S. Pat. No. 7,926,593 (5 pages).
Canadian Intellectual Property Office Action dated Feb. 24, 2012, Application No. 2,711,621 entitled "Rotating Control Device" for Canadian Application corresponding to U.S. Appl. No. 12/462,266, published as US-2011-0024195 A1 on Feb. 3, 2011 (2 pages).
Extended European Search Report (R 61 EPC) dated Feb. 22, 2012 for European Application No. 10152946.9-2315/2216498 corresponding to U.S. Appl. No. 12/322,860, published as US2009-0139724 A1 on Jun. 4, 2009 (our matter 63) (7 pages).
Extended European Search Report (R 61 EPC) dated Feb. 28, 2012 for European Application No. 10150906.5-2315/2208855 corresponding to U.S. Appl. No. 12/643,093, published as US2010-0175882 A1 on Jul. 15, 2010 (our matter 64) (8 pages).
Patent Cooperation Treaty Notification of Transmittal of the International Search Report and Written Opinion of the International Searching Authority, or the Declaration, mailed May 7, 2013; International Applicaition No. PCT/EP2011/068111, now published as WO2012/052402 A2 (21 pages).
Canadian Intellectual Property Office Action dated May 13, 2013, for Application No. 2,690,289 entitled "Subsea Internal Riser Rotating Control Device System and Method", corresponding to U.S. Appl. No. 12/643,093, issued as U.S. Pat. No. 8,322,432 on Dec. 4, 2012 (2 pages).
Response dated Nov. 13, 2013 to Canadian Intellectual Property Office Action dated May 13, 2013 (NPL 8W), for Application No. 2,690,289 entitled "Subsea Internal Riser Rotating Control Device System and Method", corresponding to U.S. Appl. No. 12/643,093, issued as U.S. Pat. No. 8,322,432 on Dec. 4, 2012 (15 pages).
Canadian Intellectual Property Office Action dated Jan. 13, 2014 (Reply to NPL-8X), for Application No. 2,690,289 entitled "Subsea Internal Riser Rotating Control Device System and Method", corresponding to U.S. Appl. No. 12/643,093, issued as U.S. Pat. No. 8,322,432 on Dec. 4, 2012 (2 pages).
Response dated Jun. 3, 2014 to Canadian Intellectual Property Office Action dated Jan. 13, 2014 (NPL 8Y), for Application No. 2,690,289 entitled "Subsea Internal Riser Rotating Control Device System and Method", corresponding to U.S. Appl. No. 12/643,093, issued as U.S. Pat. No. 8,322,432 on Dec. 4, 2012 (12 pages).
Canadian Intellectual Property Office Action dated Feb. 25, 2014, for Application No. 2,815,101 entitled "Latching Apparatus and Method", corresponding to this present U.S. Appl. No. 13/233,846, published as US-2012-0000664 A1 on Jan. 5, 2012 (2 pages).
Extended European Patent Office Search Report mailed on Jul. 4, 2014 for European Application No. 13196963.6 , published as 2762671 on Aug. 6, 2014, corresponding to U.S. Appl. No. 12/643,093, issued as U.S. Pat. No. 8,322,432 (4 pages).

(56) References Cited

OTHER PUBLICATIONS

Australian Government IP Australia Office Action dated Oct. 16, 2014, for Application No. 2010200137 entitled "Subsea Internal Riser Rotating Control Device System and Method", corresponding to U.S. Appl. No. 12/643,093, issued as U.S. Pat. No. 8,322,432 on Dec. 4, 2012 (4 pages).

Australian Government IP Australia Office Action dated Jan. 21, 2015, for Application No. 2011317657 entitled "Subsea Internal Riser Rotating Control Device System and Method", corresponding to U.S. Appl. No. 12/643,093, issued as U.S. Pat. No. 8,322,432 on Dec. 4, 2012 (4 pages).

Canadian Intellectual Property Office Action dated Sep. 17, 2015, for Application No. 2,815,101 entitled "Latching Apparatus and Method", corresponding to this present U.S. Appl. No. 13/233,846, published as US-2012-0000664 A1 on Jan. 5, 2012 (3 pages).

* cited by examiner

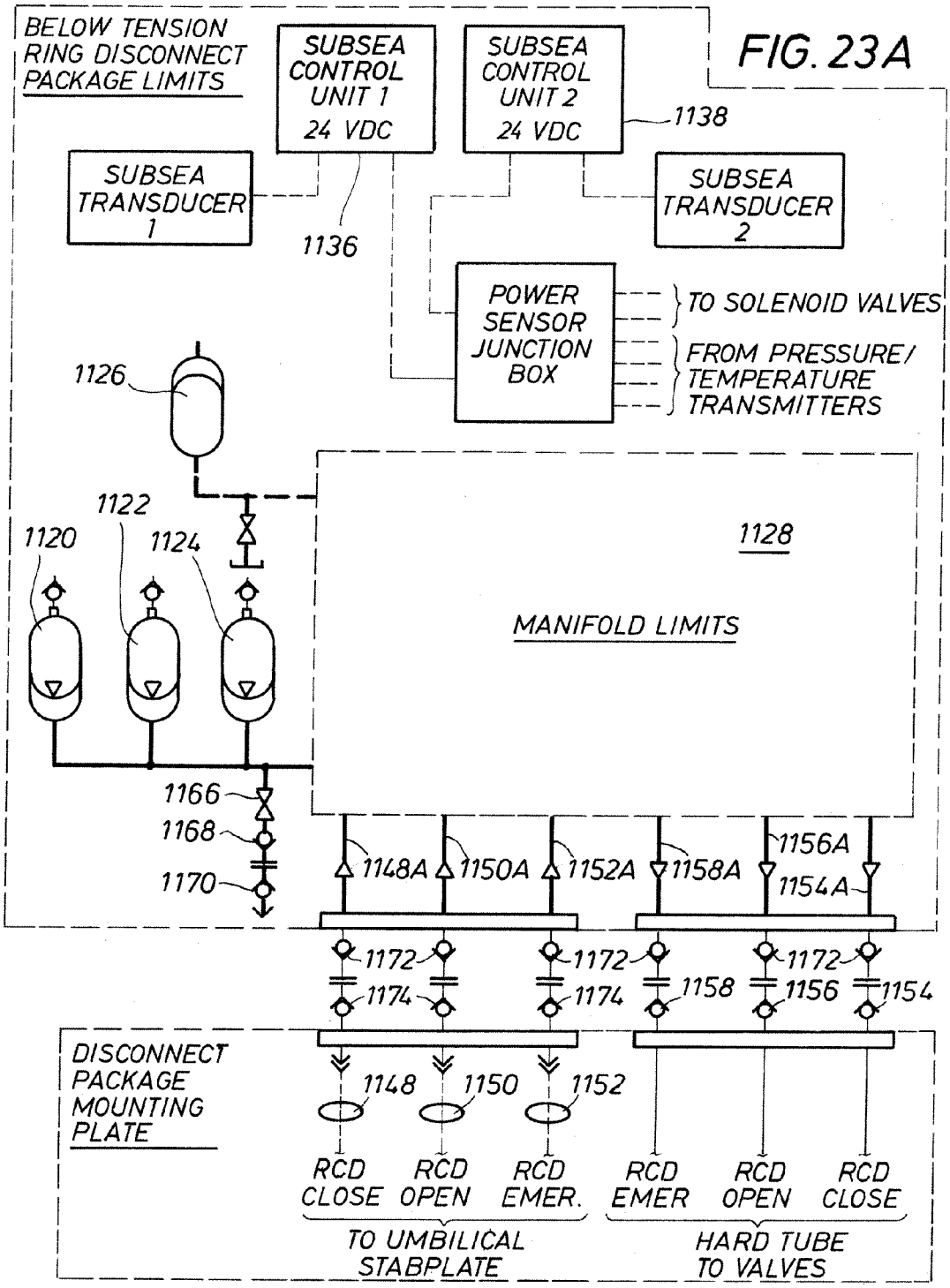
FIG. 23A
BELOW TENSION RING DISCONNECT PACKAGE LIMITS
SUBSEA CONTROL UNIT 1 24 VDC
SUBSEA CONTROL UNIT 2 24 VDC
1138
SUBSEA TRANSDUCER 1
SUBSEA TRANSDUCER 2
1136
POWER SENSOR JUNCTION BOX
TO SOLENOID VALVES
FROM PRESSURE/ TEMPERATURE TRANSMITTERS
1126
1122
1120
1124
1128
MANIFOLD LIMITS
1166
1168
1170
1148A
1150A
1152A
1158A
1156A
1154A
1172
1174
1158
1156
1154
DISCONNECT PACKAGE MOUNTING PLATE
1148
1150
1152
RCD CLOSE
RCD OPEN
RCD EMER.
RCD EMER
RCD OPEN
RCD CLOSE
TO UMBILICAL STABPLATE
HARD TUBE TO VALVES

ACOUSTICALLY CONTROLLED SUBSEA LATCHING AND SEALING SYSTEM AND METHOD FOR AN OILFIELD DEVICE

CROSS-REFERENCE TO RELATED APPLICATIONS

This application is a continuation-in-part of application Ser. No. 12/643,093 filed Dec. 21, 2009, which claims the benefit of U.S. Provisional Application No. 61/205,209 filed Jan. 15, 2009, which are hereby incorporated by reference for all purposes in their entirety.

This application claims the benefit of U.S. Provisional Application No. 61/394,155 filed on Oct. 18, 2010, which is hereby incorporated by reference for all purposes in its entirety.

STATEMENT REGARDING FEDERALLY SPONSORED RESEARCH OR DEVELOPMENT

N/A

REFERENCE TO MICROFICHE APPENDIX

N/A

BACKGROUND OF THE INVENTION

1. Field of the Invention

This invention generally relates to subsea drilling, and in particular to a system and method for unlatching and/or latching a rotating control device (RCD) or other oilfield device.

2. Description of Related Art

Marine risers extending from a wellhead fixed on the floor of an ocean have been used to circulate drilling fluid back to a structure or rig. An example of a marine riser and some of the associated drilling components is proposed in U.S. Pat. Nos. 4,626,135 and 7,258,171. RCDs have been proposed to be positioned with marine risers. U.S. Pat. No. 6,913,092 proposes a seal housing with a RCD positioned above sea level on the upper section of a marine riser to facilitate a mechanically controlled pressurized system. U.S. Pat. No. 7,237,623 proposes a method for drilling from a floating structure using an RCD positioned on a marine riser. U.S. Pat. Nos. 6,470,975; 7,159,669; and 7,258,171 propose positioning an RCD assembly in a housing disposed in a marine riser. In the '171 patent, the system for drilling in the floor of an ocean uses a RCD with a bearing assembly and a holding member for removably positioning the bearing assembly in a subsea housing. Also, an RCD has also been proposed in U.S. Pat. No. 6,138,774 to be positioned subsea without a marine riser.

More recently, the advantages of using underbalanced drilling, particularly in mature geological deepwater environments, have become known. RCD's, such as disclosed in U.S. Pat. No. 5,662,181, have provided a dependable seal between a rotating pipe and the riser while drilling operations are being conducted. U.S. Pat. No. 6,138,774 proposes the use of a RCD for overbalanced drilling of a borehole through subsea geological formations. U.S. Pat. No. 6,263,982 proposes an underbalanced drilling concept of using a RCD to seal a marine riser while drilling in the floor of an ocean from a floating structure. Additionally, U.S. Provisional Application No. 60/122,350, filed Mar. 2, 1999, entitled "Concepts for the Application of Rotating Control Head Technology to Deepwater Drilling Operations" proposes use of a RCD in deepwater drilling. U.S. Pat. No. 4,813,495 proposes a subsea RCD as an alternative to the conventional drilling system and method when used in conjunction with a subsea pump that returns the drilling fluid to a drilling vessel.

Conventional RCD assemblies have been sealed with a subsea housing active sealing mechanisms in the subsea housing. Pub. No. US 2010/0175882 proposes a mechanically extrudable seal or a hydraulically expanded seal to seal the RCD with the riser. Additionally, conventional RCD assemblies, such as proposed by U.S. Pat. No. 6,230,824, have used powered latching mechanisms in the subsea housing to position the RCD. U.S. Pat. No. 7,487,837 proposes a latch assembly for use with a riser for positioning an RCD. U.S. Pat. No. 7,836,946 B2 proposes a latching system to latch an RCD to a housing and active seals. U.S. Pat. No. 7,926,593 proposes a docking station housing positioned above the surface of the water for latching with an RCD. Pub. No. US 2009/0139724 proposes a latch position indicator system for remotely determining whether a latch assembly is latched or unlatched.

U.S. Pat. No. 6,129,152 proposes a flexible rotating bladder and seal assembly that is hydraulically latchable with its rotating blow-out preventer housing. U.S. Pat. No. 6,457,529 proposes a circumferential ring that forces dogs outward to releasably attach an RCD with a manifold. U.S. Pat. No. 7,040,394 proposes inflatable bladders/seals. U.S. Pat. No. 7,080,685 proposes a rotatable packer that may be latchingly removed independently of the bearings and other non-rotating portions of the RCD. The '685 patent also proposes the use of an indicator pin urged by a piston to indicate the position of the piston.

Latching assemblies for RCDs have been proposed to be operated subsea with an electro-hydraulic umbilical line from the surface. A remotely operated vehicle (ROV) and a human diver have also been proposed to operate the latching assemblies. However, an umbilical line may become damaged. It is also possible for sea depths and/or conditions to be unsafe and/or impractical for a diver or a ROV. In such situations, the marine riser may have to be removed to extract the RCD.

U.S. Pat. No. 3,405,387 proposes an acoustical control apparatus for controlling the operation of underwater valve equipment from the surface. U.S. Pat. No. 4,065,747 proposes an apparatus for transmitting command or control signals to underwater equipment. U.S. Pat. No. 7,123,162 proposes a subsea communication system for communicating with an apparatus at the seabed. Pub. No. US 2007/0173957 proposes a modular cable unit positioned subsea for the attachment of devices such as sensors and motors.

The above discussed U.S. Pat. Nos. 3,405,387; 4,065,747; 4,626,135; 4,813,495; 5,662,181; 6,129,152; 6,138,774; 6,230,824; 6,263,982; 6,457,529; 6,470,975; 6,913,092; 7,040,394; 7,080,685; 7,123,162; 7,159,669; 7,237,623; 7,258,171; 7,487,837; 7,836,946 B2; and 7,926,593 and Pub. Nos. US 2007/0173957; 2009/0139724; and 2010/0175882; and U.S. Provisional Application No. 60/122,350, filed Mar. 2, 1999, entitled "Concepts for the Application of Rotating Control Head Technology to Deepwater Drilling Operations" are all hereby incorporated by reference for all purposes in their entirety.

It would be desirable to have a system and method to unlatch an RCD or other oilfield device from a subsea latching assembly when the umbilical line primarily responsible for operating the latching assembly is damaged or use of the umbilical line is impractical or not desirable, and using a diver or an ROV may be unsafe or impractical.

BRIEF SUMMARY OF THE INVENTION

An acoustic control system may remotely operate a subsea latch assembly. In one embodiment, the acoustic control system may control a subsea first accumulator storing hydraulic fluid. The hydraulic fluid may be pressurized. The first accumulator may be remotely and/or manually charged and purged. In response to an acoustic signal, the first accumulator may release its fluid to operate the subsea latching assembly. The released fluid may move a piston in the latching assembly to unlatch an RCD or other oilfield device. The latching assembly may be disposed with a marine riser and/or a subsea wellhead if there is no marine riser. If there is a marine riser, the latching assembly may be disposed below the tension lines or tension ring supporting the top of the riser from the drilling structure or rig.

The acoustic control system may have a surface control unit, a subsea control unit, and two or more acoustic signal devices. One of the acoustic signal devices may be capable of transmitting an acoustic signal, and the other acoustic signal device may be capable of receiving the acoustic signal. In one embodiment, acoustic signal devices may be transceivers connected with transducers each capable of transmitting and receiving acoustic signals between each other to provide for two-way communication between the surface control unit and the subsea control unit. The subsea control unit may control the first accumulator.

A second accumulator or a compensator may be used to capture hydraulic fluid moving out of the latching system to prevent its escape into the environment. The acoustic control system may be used as a secondary or back-up system in case of damage to the primary electro-hydraulic umbilical line, or it may be used as the primary system for operating the latching assembly. In one embodiment, one or more valves or a valve pack may be disposed with the accumulators and the umbilical line to switch to the secondary acoustic control system as needed.

In other embodiments, the acoustic control system may be used to both latch and/or unlatch the RCD or other oilfield device with the subsea housing or marine riser, including by moving primary and/or secondary pistons within the latch assembly. In another embodiment, the system may be used to operate active seals to retain and/or release a RCD or other oilfield device disposed with a subsea housing or marine riser.

BRIEF DESCRIPTION OF THE DRAWINGS

A better understanding of the present invention can be obtained with the following detailed descriptions of the various disclosed embodiments in the drawings, which are given by way of illustration only, and thus are not limiting the invention, and wherein:

FIG. 23A is a schematic view of the accumulators and valve pack of FIG. 14 disposed with hydraulic lines, check valves, and sensors.

DETAILED DESCRIPTION OF THE INVENTION

Generally, a system and method for unlatching and/or latching an RCD or other oilfield device positioned with a latching assembly is disclosed. Also, a system and method for sealing and/or unsealing an RCD or other oilfield device using an active seal is disclosed. The latching assembly may be disposed with a marine riser and/or subsea housing. If there is a marine riser, it is contemplated that the latching assembly be disposed below the tension lines or tension ring supporting the top of the riser from the drilling structure or rig. An RCD may have an inner member rotatable relative to an outer member about thrust and axial bearings, such as RCD Model 7875, available from Weatherford International of Houston, Tex., and other RCDs proposed in the '181, '171 and '774 patents. Although certain RCD types and sizes are shown in the embodiments, other RCD types and sizes are contemplated for all embodiments, including RCDs with different numbers, configurations and orientations of passive seals, and/or RCDs with one or more active seals. It is also contemplated that the system and method may be used to operate these active seals.

Figure 1:
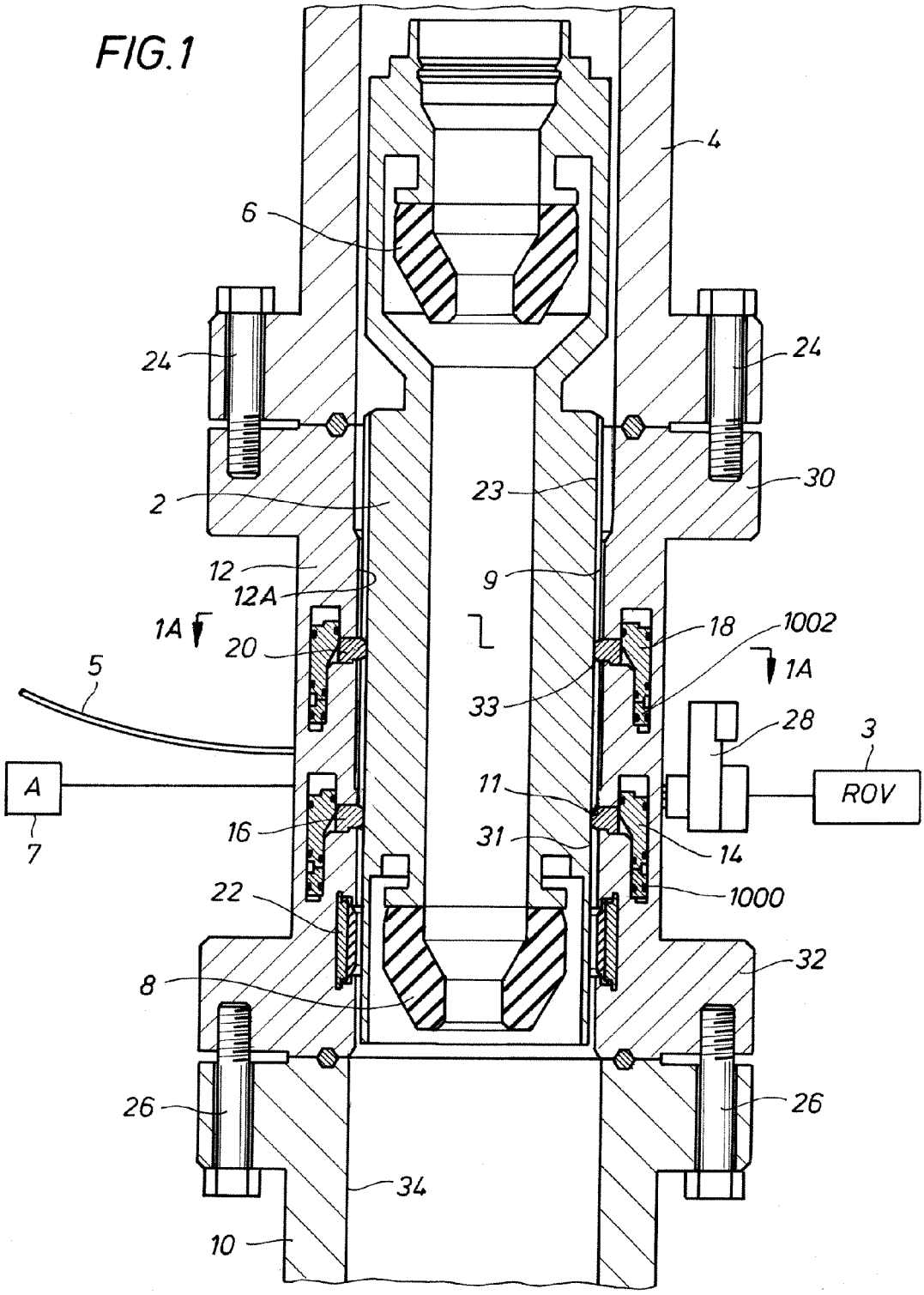
FIG. 1 is a cross-sectional elevational view of an RCD having two passive seals and latched with a riser spool or housing having two latching members shown in the latched position and an active packer seal shown in the unsealed position.

In FIG. 1, riser spool or housing 12 is positioned with marine riser sections (4, 10). Marine riser sections (4, 10) are part of a marine riser, such as disclosed above in the Background of the Invention. Housing 12 is illustrated bolted with bolts (24, 26) to respective marine riser sections (4, 10). Other attachment means are contemplated. An RCD 2 with two passive stripper seals (6, 8) is landed in and latched to housing 12 using latching assemblies, such as first latching piston 14 and second latching piston 18, both of which may be actuated, such as described in the '837 patent (see FIGS. 2 and 3 of '837 patent). Active packer seal 22 in housing 12, shown in its noninflated and unsealed position, may be hydraulically expandable to a sealed position to sealingly engage the outside diameter of RCD 2 using the present invention.

Remote Operated Vehicle (ROV) subsea control panel 28 may be positioned with housing 12 between protective flanges (30, 32) for operation of hydraulic latching pistons (14, 18) and active packer seal 22. An ROV 3 containing hydraulic fluid may be sent below sea level to connect with the ROV panel 28 to control operations the housing 12 components. The ROV 3 may be controlled remotely from the surface. In particular, by supplying hydraulic fluid to different components using shutter valves and other mechanical devices, latching pistons (14, 18) and active seal 22 may be operated when practical. Alternatively, or in addition for redundancy, one or more hydraulic lines, such as umbilical line 5, may be run from the surface to supply hydraulic fluid for remote operation of the housing 12 latching pistons (14, 18) and active seal 22. Alternatively, or in addition for further redundancy and safety, an accumulator 7 for storing hydraulic fluid may be activated remotely to operate the housing 12 components or store fluids under pressure. It is contemplated that all three means for hydraulic fluid could be provided. It is also contemplated that a similar ROV panel, ROV, hydraulic lines, and/or accumulator may be used with all embodiments of the invention.

The RCD 2 outside diameter is smaller than the housing 12 inside diameter or straight thru bore. First retainer member 16 and second retainer member 20 are shown in FIG. 1 after having been moved from their respective first or unlatched positions to their respective second or latched positions. RCD 2 may have a change in outside diameter that occurs at first retainer member 16. As shown in FIG. 1, the upper outside diameter 9 of RCD 2 may be greater than the lower outside diameter 31 of RCD 2. Other RCD outside surface configurations are contemplated, including the RCD not having a change in outside diameter.

Figure 1A:
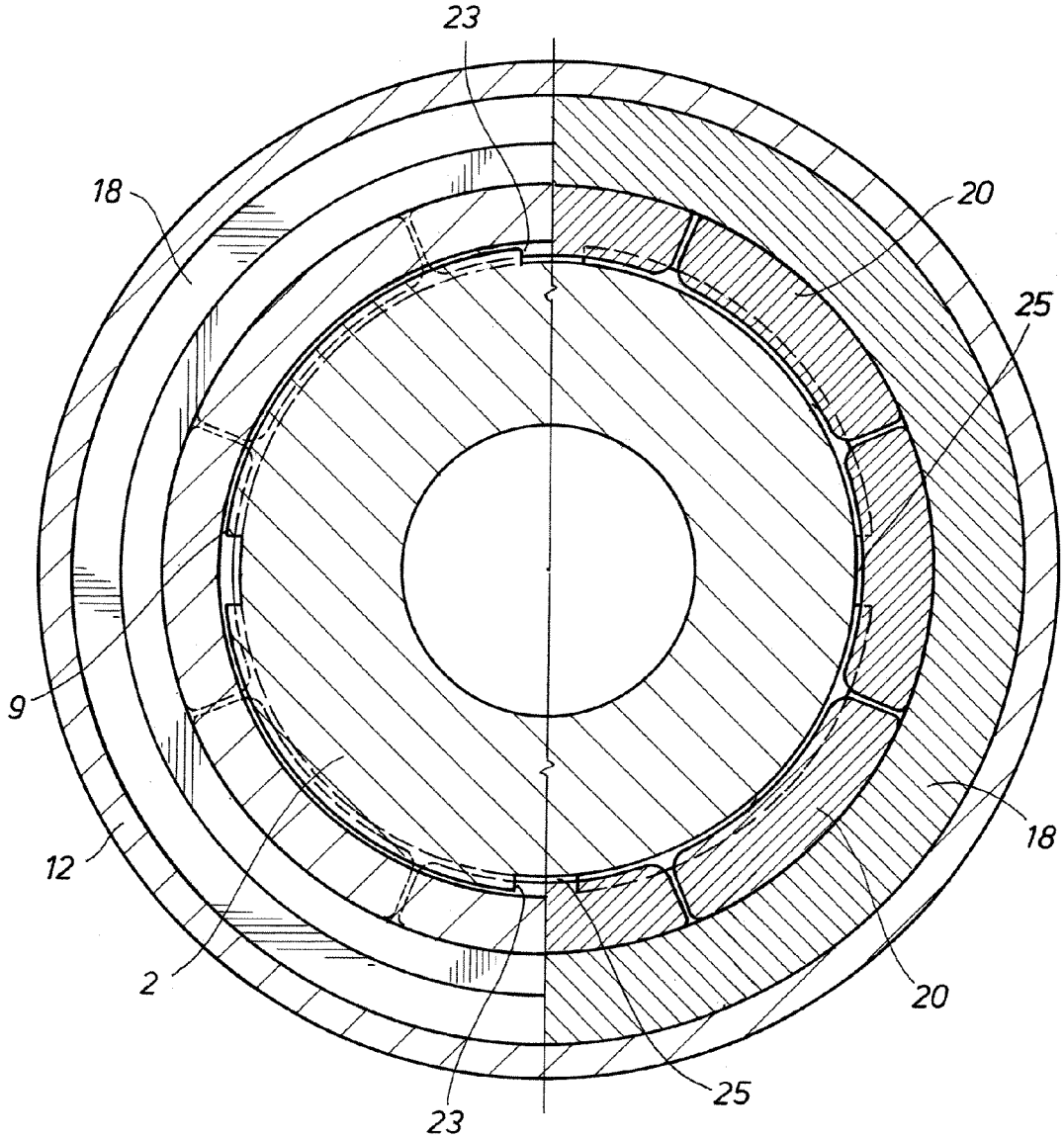
FIG. 1A is a section view along stepped line 1A-1A of FIG. 1 showing second retainer member as a plurality of dogs in the latched position, a plurality of vertical grooves on the outside surface of the RCD, and a plurality of fluid passageway's between the dogs and the RCD.

As shown in FIGS. 1 and 1A, the RCD 2 upper outside diameter 9 above the second retainer member 20 and between the first 16 and second 20 retainer members may have a plurality of vertical grooves 23. As shown in FIG. 1A, second retainer member 20 may be a plurality of dogs. First retainer member 16 may also be a plurality of dogs like second retainer member 20. Retainer members (16, 20) may be segmented locking dogs. Retainer members (16, 20) may each be a split ring or C-shaped member, or they may each be a plurality of segments of split ring or C-shaped members. Retainer members (16, 20) may be biased radially outwardly. Retainer members (16, 20) may each be mechanical interlocking members, such as tongue and groove type or T-slide type, for positive retraction. Other retainer member configurations are contemplated.

The vertical grooves 23 along the outside surface of RCD 2 allow for fluid passageways 25 when dogs 20 are in the latched position as shown in FIG. 1A. The vertical grooves 23 allow for the movement of fluids around the RCD 2 when the RCD 2 is moved in the riser. The vertical grooves 23 are provided to prevent the compression or surging of fluids in the riser below the RCD 2 when RCD 2 is lowered or landed in the riser and swabbing or a vacuum effect when the RCD 2 is raised or retrieved from the riser.

Returning to FIG. 1, first retainer member 16 blocks the downward movement of the RCD 2 during landing by contacting RCD blocking shoulder 11, resulting from the change between upper RCD outside diameter 9 and lower RCD outside diameter 31. Second retainer member 20 has engaged the RCD 2 in a horizontal radial receiving groove 33 around the upper outside diameter 9 of RCD 2 to squeeze or compress the RCD 2 between retainer members (16, 20) to resist rotation. In their second or latched positions, retainer members (16, 20) also may squeeze or compress RCD 2 radially inwardly. It is contemplated that retainer members (16, 20) may be alternatively moved to their latched positions radially inwardly and axially upwardly to squeeze or compress the RCD 2 using retainer members (16, 20) to resist rotation. As can now be understood, the RCD may be squeezed or compressed axially upwardly and downwardly and radially inwardly. In their first or unlatched positions, retainer members (16, 20) allow clearance between the RCD 2 and housing 12. In their second or latched positions, retainer members (16, 20) block and latchingly engage the RCD 2, respectively, to resist vertical movement and rotation. The embodiment shown in FIGS. 1 and 1A for the outside surface of the RCD 2 may be used for all embodiments shown in all the Figures.

While it is contemplated that housing 12 may have a 10,000 psi body pressure rating, other pressure ratings are contemplated. Also, while it is contemplated that the opposed housing flanges (30, 32) may have a 39 inch (99.1 cm) outside diameter, other sizes are contemplated. RCD 2 may be latchingly attached with a 21.250 inch (54 cm) thru bore 34 of marine riser sections (4, 10) with a 19.25 (48.9 cm) inch inside bore 12A of housing 12. Other sizes are contemplated. It is also contemplated that housing 12 may be positioned above or be integral with a marine diverter, such as a 59 inch (149.9 cm) inside diameter marine diverter. Other sizes are contemplated. The diverter will allow fluid moving down the drill pipe and up the annulus to flow out the diverter opening below the lower stripper seal 8 and the same active seal 22. Although active seal 22 is shown below the bearing assembly of the RCD 2 and below latching pistons (14, 18), it is contemplated that active seal 22 may be positioned above the RCD bearing assembly and latching pistons (14, 18). It is also contemplated that there may be active seals both above and below the RCD bearing assembly and latching pistons (14, 18). All types of seals, active or passive, as are known in the art are contemplated. While the active seal 22 is illustrated positioned with the housing 12, it is contemplated that the seal, active or passive, could instead be positioned with the outer surface of the RCD 2.

In the method, to establish a landing for RCD 2, which may be an 18.00 inch (45.7 cm) outer diameter RCD, the first retainer member 16 is remotely activated to the latched or loading position. The RCD 2 is then moved into the housing 12 until the RCD 2 lands with the RCD blocking shoulder 11 contacting the first retainer member 16. The second retainer member 20 is then remotely activated with hydraulic fluid supplied as discussed above to the latched position to engage the RCD receiving groove 33, thereby creating a clamping force on the RCD 2 outer surface to, among other benefits, resist torque or rotation. In particular, the top chamfer on first retainer member 16 is engaged with the RCD shoulder 11. When the bottom chamfer on the second retainer member 20 moves into receiving groove 33 on the RCD 2 outer surface, the bottom chamfer "squeezes" the RCD between the two retainer members (16, 20) to apply a squeezing force on the RCD 2 to resist torque or rotation. The active seal 22 may then be expanded with hydraulic fluid supplied as discussed herein to seal against the RCD 2 lower outer surface to seal the gap or annulus between the RCD 2 and the housing 12.

Figure 4A:
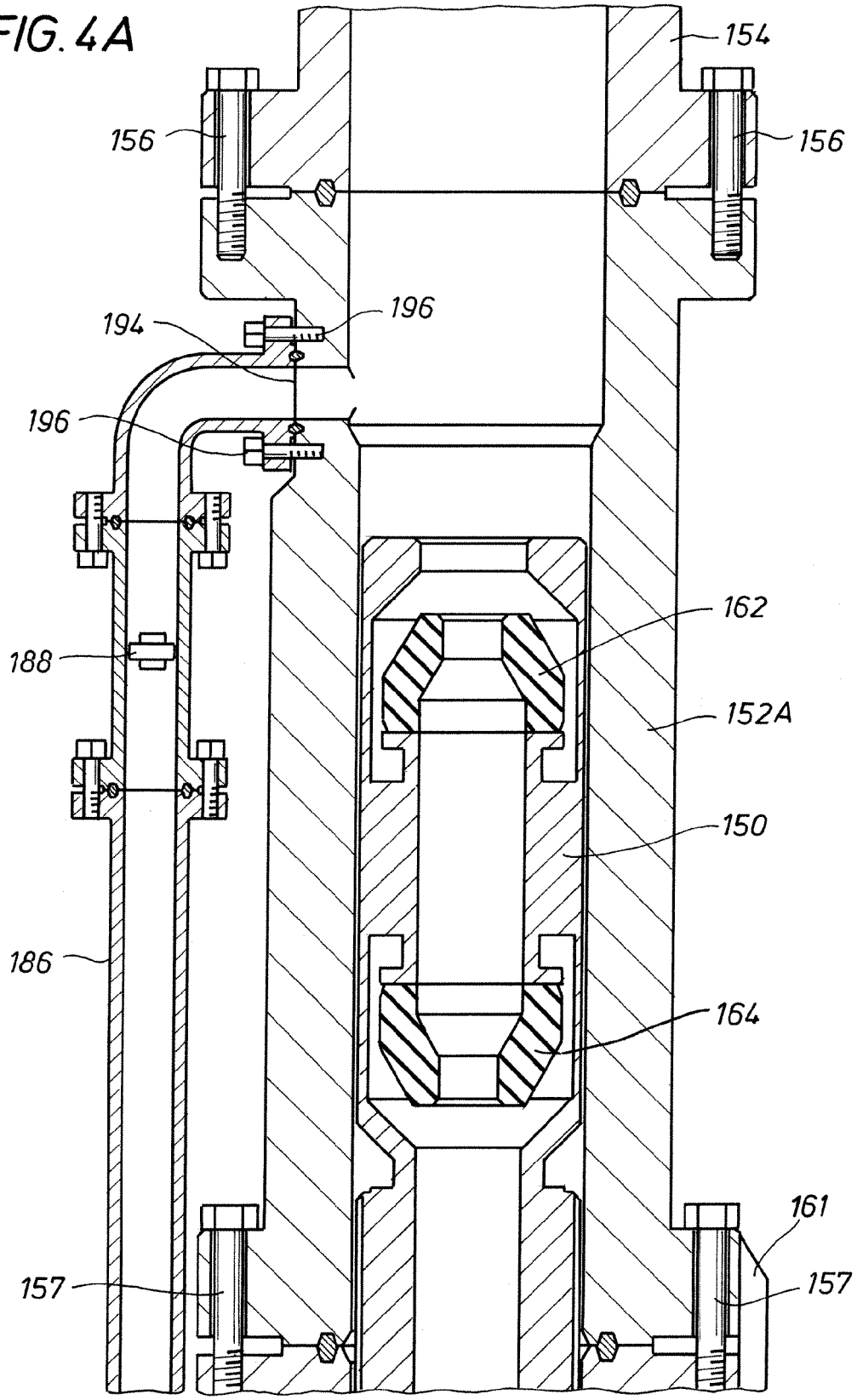
FIGS. 4A-4B are a cross-sectional elevational view of an RCD with three passive seals having a seal assembly disposed with an RCD running tool and latched with a riser spool or housing having, three latching members shown in the latched position, the lower latch member engaging the seal assembly, and a bypass conduit or line having a valve therein.

The operations of the housing 12 may be controlled remotely through the ROV fluid supplied to the control panel 28, with hydraulic line 5 and/or accumulator 7. Other methods are contemplated, including activating the second retainer member 20 simultaneously with the active seal 22. Although a bypass channel or line, such as an internal bypass channel 68 shown in FIG. 2 and an external bypass line 186 shown in FIG. 4A, is not shown in FIG. 1, it is contemplated that a similar external bypass line or internal bypass channel with a valve may be used in FIG. 1 or in any other embodiment herein. The operation of a bypass line with a valve is discussed in detail below with FIG. 2.

Back-up or secondary pistons (1000, 1002) may move respective primary pistons (14, 18) to their unlatched positions should the hydraulic system fail to move primary pistons (14, 18). Secondary pistons (1000, 1002) may operate independently of each other.

Figure 2:
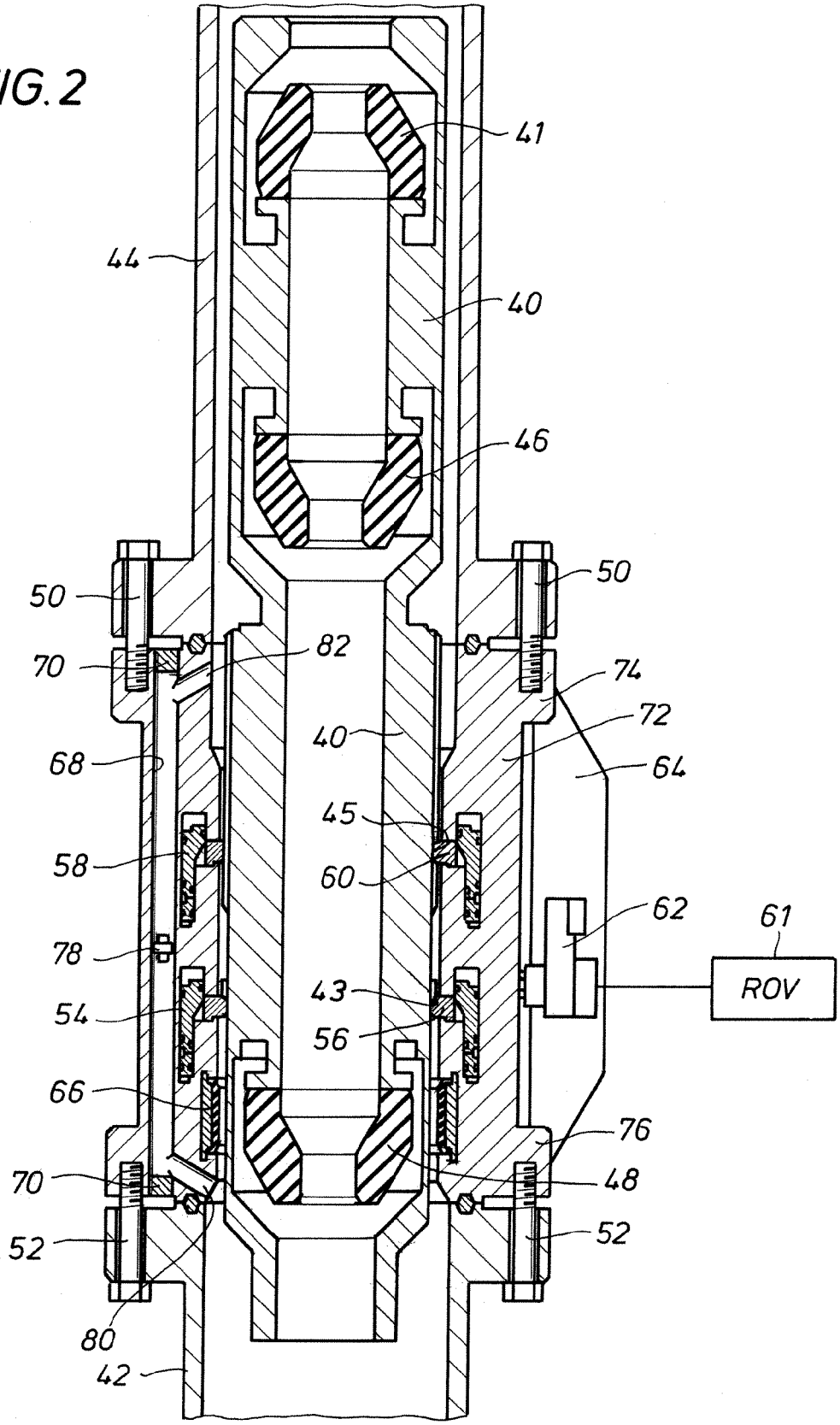
FIG. 2 is a cross-sectional elevational view of an RCD with three passive seals latched with a riser spool or housing having two latching members shown in the latched position, an active seal shown in the unsealed position, and a bypass channel or line having a valve therein.

Turning to FIG. 2, an RCD 40 with three passive stripper seals (41, 46, 48) is positioned with riser spool or housing 72 with first retainer member 56 and second retainer member 60, both of which are activated by respective hydraulic pistons in respective latching assemblies (54, 58). First retainer member 56 blocks movement of the RCD 40 when blocking shoulder 43 engages retainer member 56 and second retainer member 60 is positioned with RCD receiving formation or groove 45. The operations of the housing 72 components may be controlled remotely using ROV 61 connected with ROV control panel 62 positioned between flanges (74, 76) and further protected by shielding member 64. Alternatively, or in addition, as discussed above, housing 74 components may be operated by hydraulic lines and/or accumulators. RCD stripper seal 41 is inverted from the other stripper seals (46, 48) to, among other reasons, resist "suck down" of drilling fluids during a total or partial loss circulation. Such a loss circulation could result in the collapse of the riser if no fluids were in the riser to counteract the outside forces on the riser. For RCD 40 in FIG. 2, and for similar RCD stripper seal embodiments in the other Figures, it is contemplated that the two opposing stripper seals, such as stripper seals (41, 46), may be one integral or continuous seal rather than two separate seals.

The RCD 40 outside diameter is smaller than the housing 72 inside diameter, which may be 19.25 inches (48.9 cm). Other sizes are contemplated. While the riser housing 72 may have a 10,000 psi body pressure rating, other pressure ratings are contemplated. Retainer members (56, 60) may be a plurality of dogs or a C-shaped member, although other types of members are contemplated. Active seal 66, shown in an unexpanded or unsealed position, may be expanded to sealingly engage RCD 40 using the present invention. Alternatively, or in addition, an active seal may be positioned above the RCD bearing assembly and latching assemblies (54, 58). Housing 74 is illustrated bolted with bolts (50, 52) to marine riser sections (42, 44). As discussed above, other attachment means are contemplated. While it is contemplated that the opposed housing flanges (74, 76) may have a 45 inch (114.3 cm) outside diameter, other sizes are contemplated. As can now be understood, the RCD 40 may be latchingly attached with the thru bore of housing 72. It is also contemplated that housing 74 may be positioned with a 59 inch (149.9 cm) inside diameter marine diverter.

The system shown in FIG. 2 is generally similar to the system shown in FIG. 1, except for internal bypass channel 68, which, as stated above, may be used with any of the embodiments. Valve 78, such as a gate valve, may be positioned in bypass channel 68. Two end plugs 70 may be used after internal bypass channel 68 is manufactured, such as shown in FIG. 2, to seal communication with atmospheric pressure outside the wellbore. Bypass channel 68 with gate valve 78 acts as a check valve in well kick or blowout conditions. Gate valve 78 may be operated remotely. For example, if hazardous weather conditions are forecasted, the valve 78 could be closed with the riser sealable controlled and the offshore rig moved to a safer location. Also, if the riser is raised with the RCD in place, valve 78 could be opened to allow fluid to bypass the RCD 40 and out the riser below the housing 72 and RCD 40. In such conditions, fluid may be allowed to flow through bypass channel 68, around RCD 40, via bypass channel first end 80 and bypass channel second end 82, thereby bypassing the RCD 40 sealed with housing 72. Alternatively to internal bypass channel 68, it is contemplated that an external bypass line, such as bypass line 186 in FIG. 4A, may be used with FIG. 2 and any other embodiments.

Figure 3A:
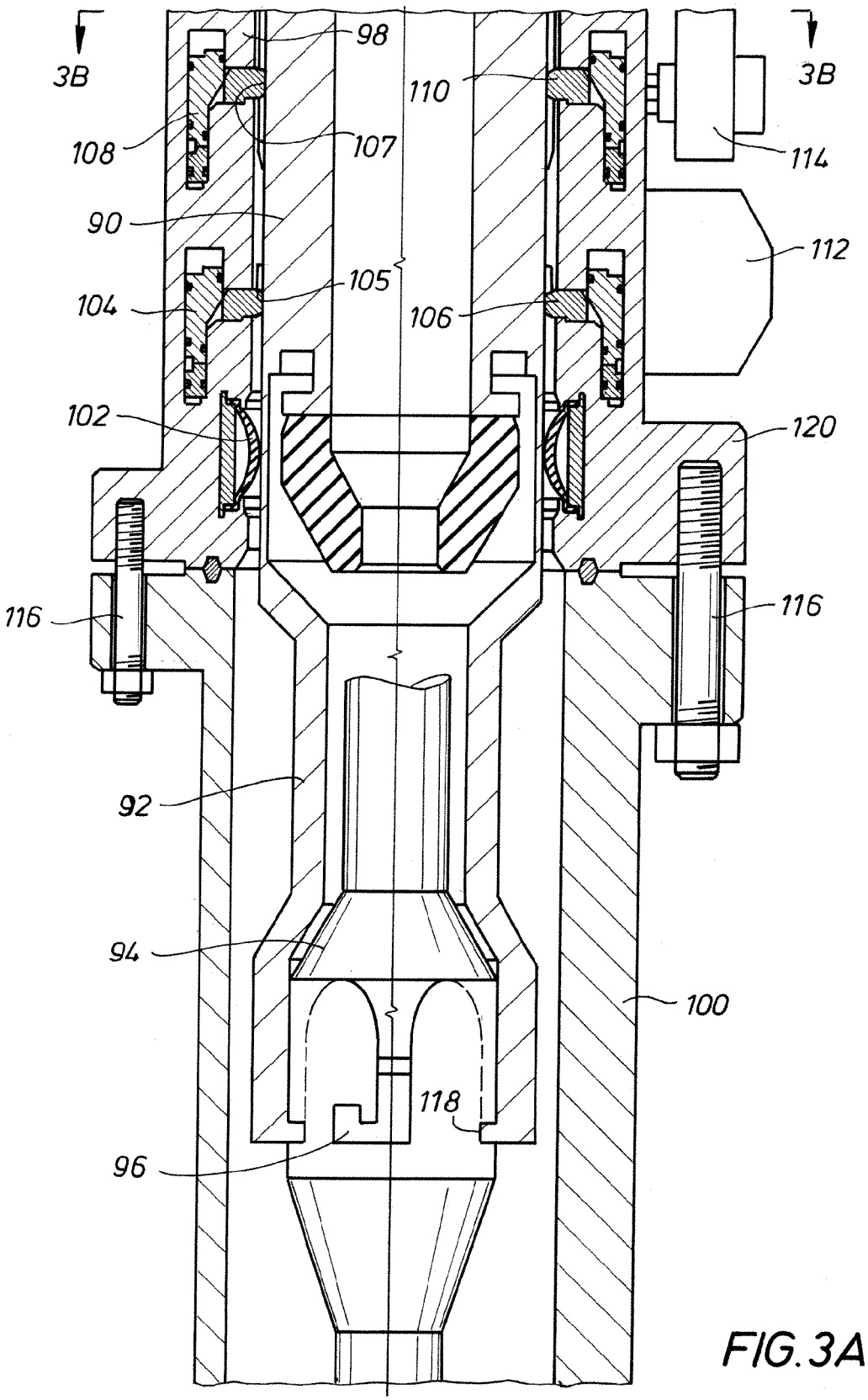
FIG. 3A is a cross-sectional elevational partial view of an RCD having a seal assembly disposed with an RCD running tool and latched with a riser spool or housing having two latching members shown in the latched position and an active seal shown in the sealed position.

In FIG. 3A, riser spool or housing 98 is illustrated connected with threaded shafts and nuts 116 to marine riser section 100. An RCD 90 having a seal assembly 92 is positioned with an RCD running tool 94 with housing 98. Seal assembly latching formations 118 may be positioned in the J-hook receiving grooves 96 in RCD running tool 94 so that the running tool 94 and RCD 90 are moved together on the drill string through the marine riser and housing 98. Other attachment means are contemplated as are known in the art. A running tool, such as running tool 94, may be used to position an RCD with any riser spool or housing embodiments. RCD 90 is landed with housing 98 with first retainer member 106 and squeezed with second retainer member 110, both of which are remotely actuated by respective hydraulic pistons in respective latching assemblies (104, 108). First retainer member 106 blocks RCD shoulder 105 and second retainer member 110 is positioned with RCD second receiving formation or groove 107.

ROV control panel 114 may be positioned with housing 98 between upper and lower shielding protrusions 112 (only lower protrusion shown) to protect the panel 114. Other shielding means are contemplated. While it is contemplated that the opposed housing flanges 120 (only lower flange shown) of housing 98 may have a 45 inch (114.3 cm) outside diameter, other sizes are contemplated. The RCD 90 outside diameter is smaller than the housing 98 inside diameter. Retainer members (106, 110) may be a plurality of dogs or a C-shaped member. Active seal 102, shown in an expanded or sealed position, sealingly engages RCD 102. After the RCD 90 is sealed as shown in FIG. 3A, the running tool 94 may be disengaged from the RCD seal assembly 92 and continue moving with the drill string down the riser for drilling operations. Alternatively, or in addition, an active or passive seal may be positioned on RCD 90 instead of on housing 98, and/or may be positioned both above and below RCD bearing assembly or latching assemblies (104, 108). Alternatively to the embodiment shown in FIG. 3A, a seal assembly, such as seal assembly 92, may be positioned above the RCD bearing assembly or latching assemblies (104, 108) to engage an RCD running tool. The alternative seal assembly may be used to either house a seal, such as seal 102, or be used as the portion of the RCD to be sealed by a seal in a housing, similar to the embodiment shown in FIG. 3A.

Figure 3B:
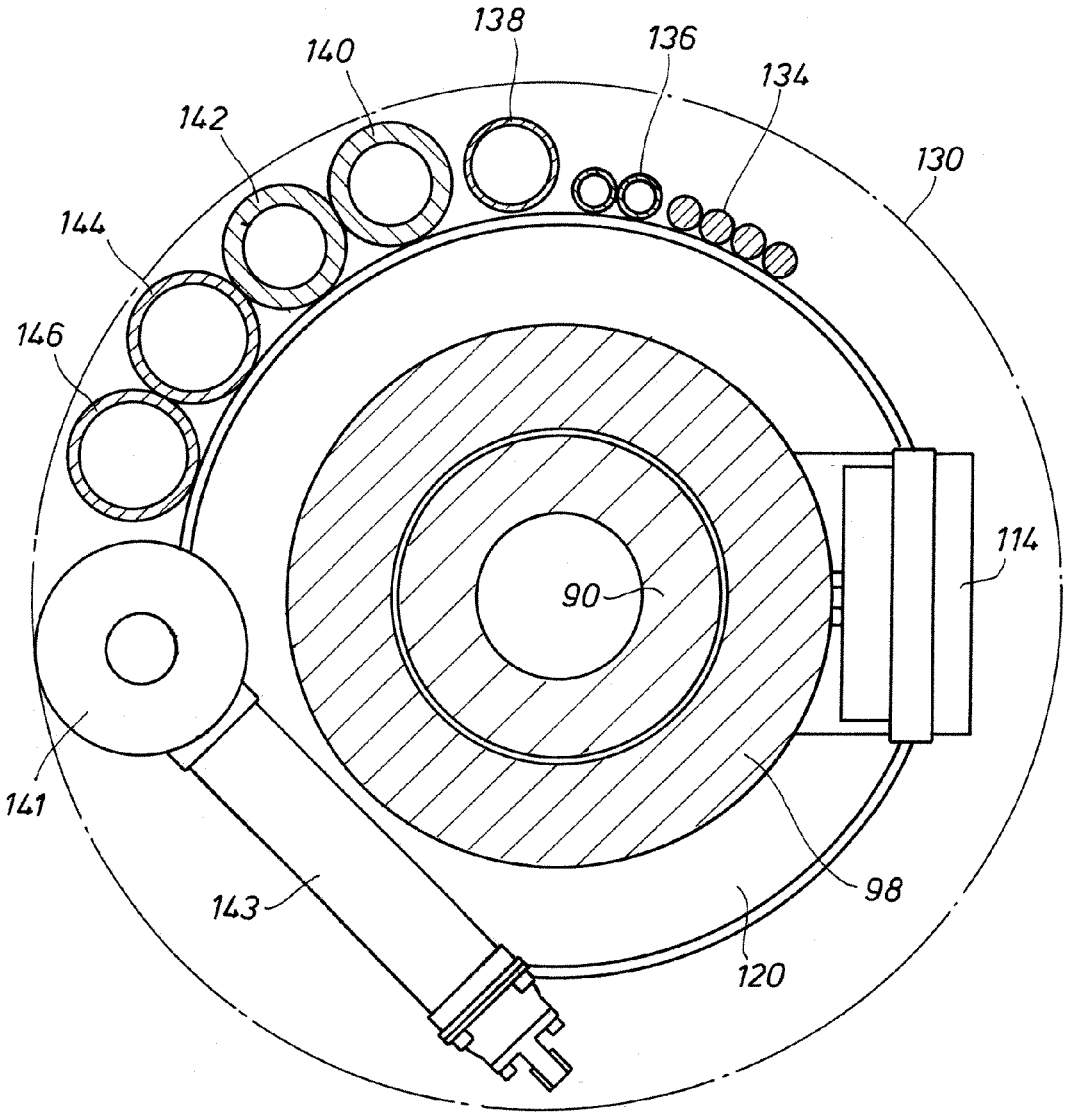
FIG. 3B is a section view along line 3B-3B of FIG. 3A showing an ROV panel and an exemplary placement of lines, such as choke lines, kill lines, booster lines, umbilical lines and/or other lines, cables and conduits around the riser spool.

Generally, lines and cables extend radially outwardly from the riser, as shown in FIG. 1 of the '171 patent, and male and female members of the lines and cables can be plugged together as the riser sections are joined together. Turning to FIG. 3B, an exemplary rerouting or placement of these lines and cables is shown external to housing 98 within the design criteria inside diameter 130 as the lines and cables traverse across the housing 98. Exemplary lines and cables may include 1.875 inch OD multiplex cables 134, 2.375×2.000 rigid conduit lines 136, a 5.563×4.5 mud boost line 138, a 7×4.5 kill line 140, a 7×4.5 choke line 142, a 7.5×6 mud return line 144, and a 7.5×6 seawater fluid power line 146. Other sizes, lines (such as the discussed umbilical lines) and cables and configurations are contemplated. It is also contemplated that an ROV or accumulator(s) may be used to replace some of the lines and/or conduits.

It is contemplated that a marine riser segment would stab the male or pin end of its riser tubular segment lines and cables with the female or box end of a lower riser tubular segment lines and cables. The lines and cables, such as shown in FIG. 3B, may also be stabbed or plugged with riser tubular segment lines and cables extending radially outward so that they may be plugged together when connecting the riser segments. In other words, the lines and/or cables shown in FIG. 3B are rerouted along the vertical elevation profile exterior to housing 98 to avoid housing protrusions, such as panel 114 and protrusion 112, but the lines and cables are aligned radially outward to allow them to be connected with their respective lines and cables from the adjoining riser segments. Although section 3B-3B is only shown with FIG. 3A, similar exemplary placement of the ROV panel, lines, and cables as shown in FIG. 3B may be used with any of the embodiments.

An external bypass line 186 with gate valve 188 is shown and discussed below with FIG. 4A. Although FIG. 3A does not show a bypass line and gate valve, it is contemplated that the embodiment in FIG. 3A may have a bypass line and gate valve. FIG. 3B shows an exemplary placement of a gate valve 141 with actuator 143 if used with FIG. 3A. A similar placement may be used for the embodiment in FIG. 4A and other embodiments.

Figure 4B:
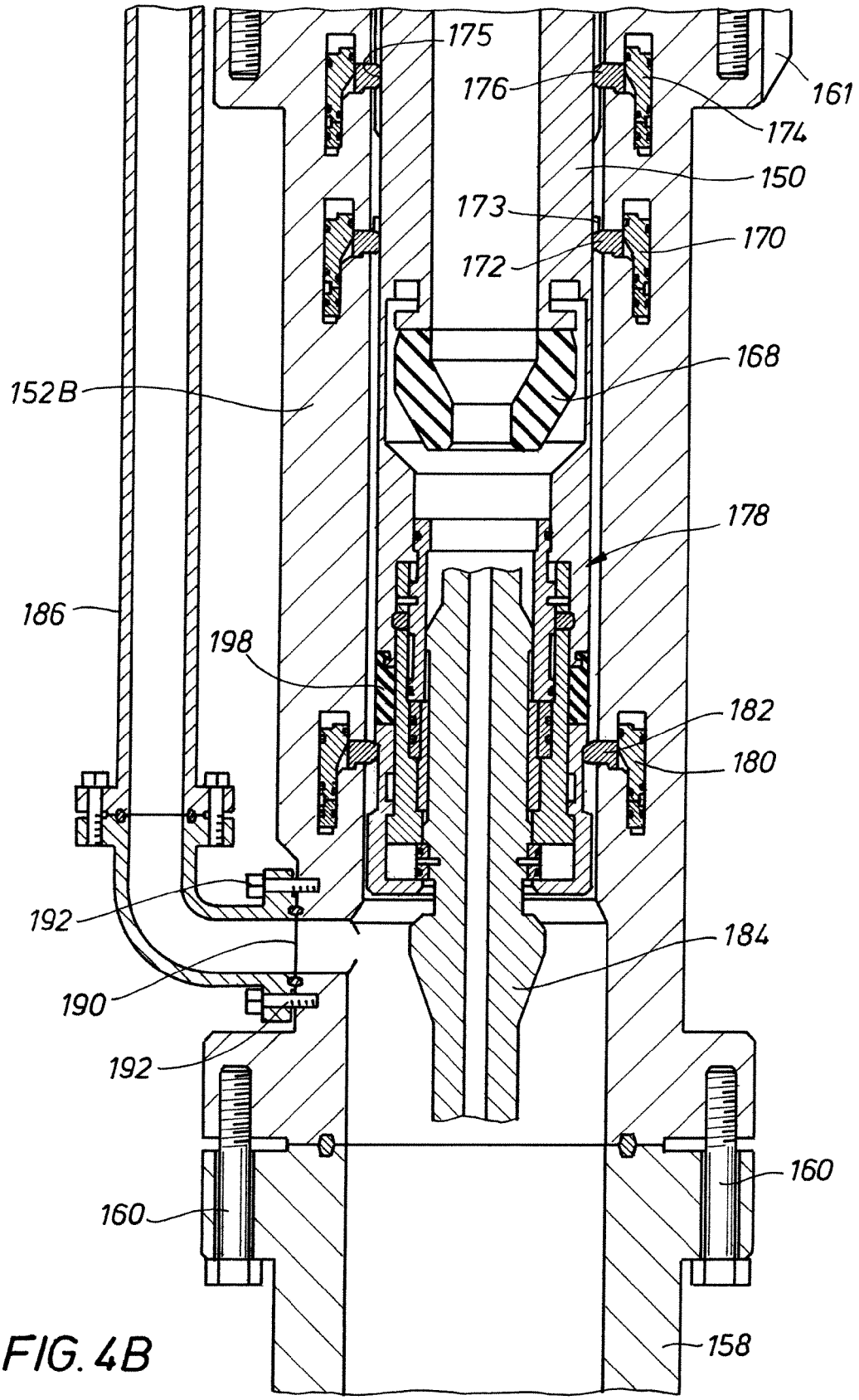

In FIGS. 4A-4B, riser spools or housings (152A, 152B) are bolted between marine riser sections (154, 158) with respective bolts (156, 160). Housing 152A is bolted with housing 152B using bolts 157. A protection member 161 may be positioned with one or more of the bolts 157 (e.g., three openings in the protection member to receive three bolts) to protect an ROV panel, which is not shown. An RCD 150 with three passive stripper seals (162, 164, 168) is positioned with riser spools or housings (152A, 152B) with first retainer member 172, second retainer member 176, and third retainer member or seal assembly retainer 182 all of which are activated by respective hydraulic pistons in their respective latching assemblies (170, 174, 180). Retainer members (172, 176, 182) in housing 152B as shown in FIG. 4B have been moved from their respective first or unlatched positions to their respective second or latched positions. First retainer member 172 blocks RCD shoulder 173 and second retainer member 176 is positioned with RCD receiving formation or groove 175. The operations of the housing 152B may be controlled remotely using in any combination an ROV connected with an ROV containing hydraulic fluid and control panel, hydraulic lines, and/or accumulators, all of which have been previously described but not shown for clarity of the Figure.

The RCD seal assembly, generally indicated at 178, for RCD 150 and the RCD running tool 184 are similar to the seal assembly and running tool shown in FIGS. 10A-10E and are described in detail below with those Figures. RCD stripper seal 162 is inverted from the other stripper seals (164, 168). Although RCD seal assembly 178 is shown below the RCD bearing assembly and below the first and second latching assemblies (170, 174), a seal assembly may alternatively be positioned above the RCD bearing assembly and the first and second latching assemblies (170, 174) for all embodiments.

External bypass line 186 with valve 188 may be attached with housing 152 with bolts (192, 196). Other attachment means are contemplated. A similar bypass line and valve may be positioned with any embodiment. Unlike bypass channel 68 in FIG. 2, bypass line 186 in FIGS. 4A-4B is external to and releasable from the housings (152A, 152B). Bypass line 186 with gate valve 188 acts as a check valve in well kick or blowout conditions. Gate valve 188 may be operated remotely. Also, if hazardous weather conditions are forecasted, the valve 188 could be closed with the riser sealable controlled and the offshore rig moved to a safer location.

Also, when the riser is raised with the RCD in place, valve 188 could be opened to allow fluid to bypass the RCD 150 and out the riser below the housing 152B and RCD 150. In such conditions when seal assembly extrudable seal 198 is in a sealing position (as described below in detail with FIGS. 10A-10E), fluid may be allowed to flow through bypass line 186, around RCD 150, via bypass line first end 190 and bypass line second end 194, thereby bypassing RCD 150 sealed with housing 152B. Alternatively to external bypass line 186, it is contemplated that an internal bypass channel, such as bypass channel 68 in FIG. 2, may be used with FIGS. 4A-4B and any other embodiment.

Figure 5A:
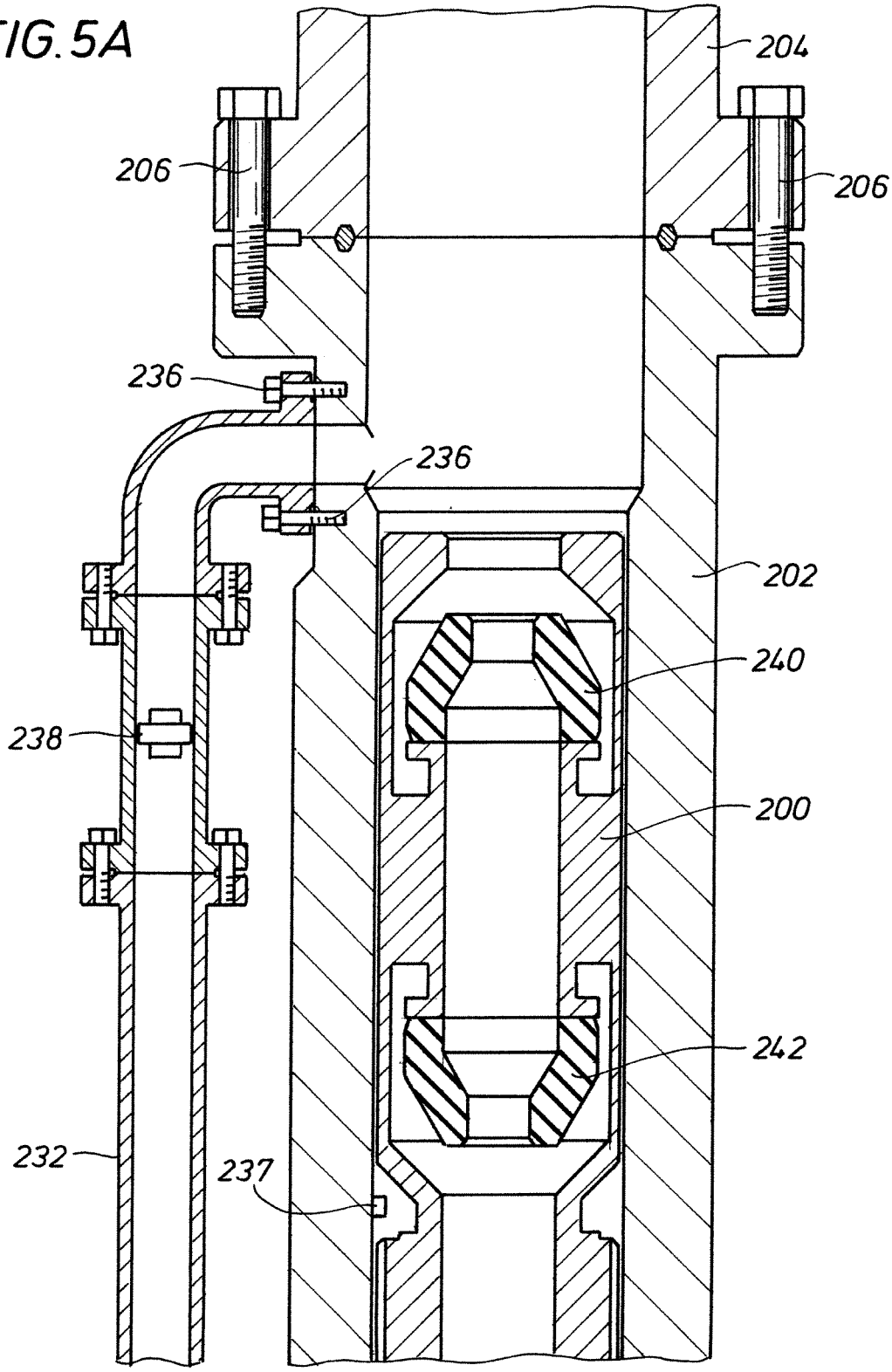
FIGS. 5A-5B are a cross-sectional elevational view of an RCD with three passive seals having a seal assembly disposed with an RCD running tool and sealed with a riser housing and the RCD latched with the riser housing having two latching members shown in the latched position and a bypass conduit or line having a valve therein.
Figure 5B:
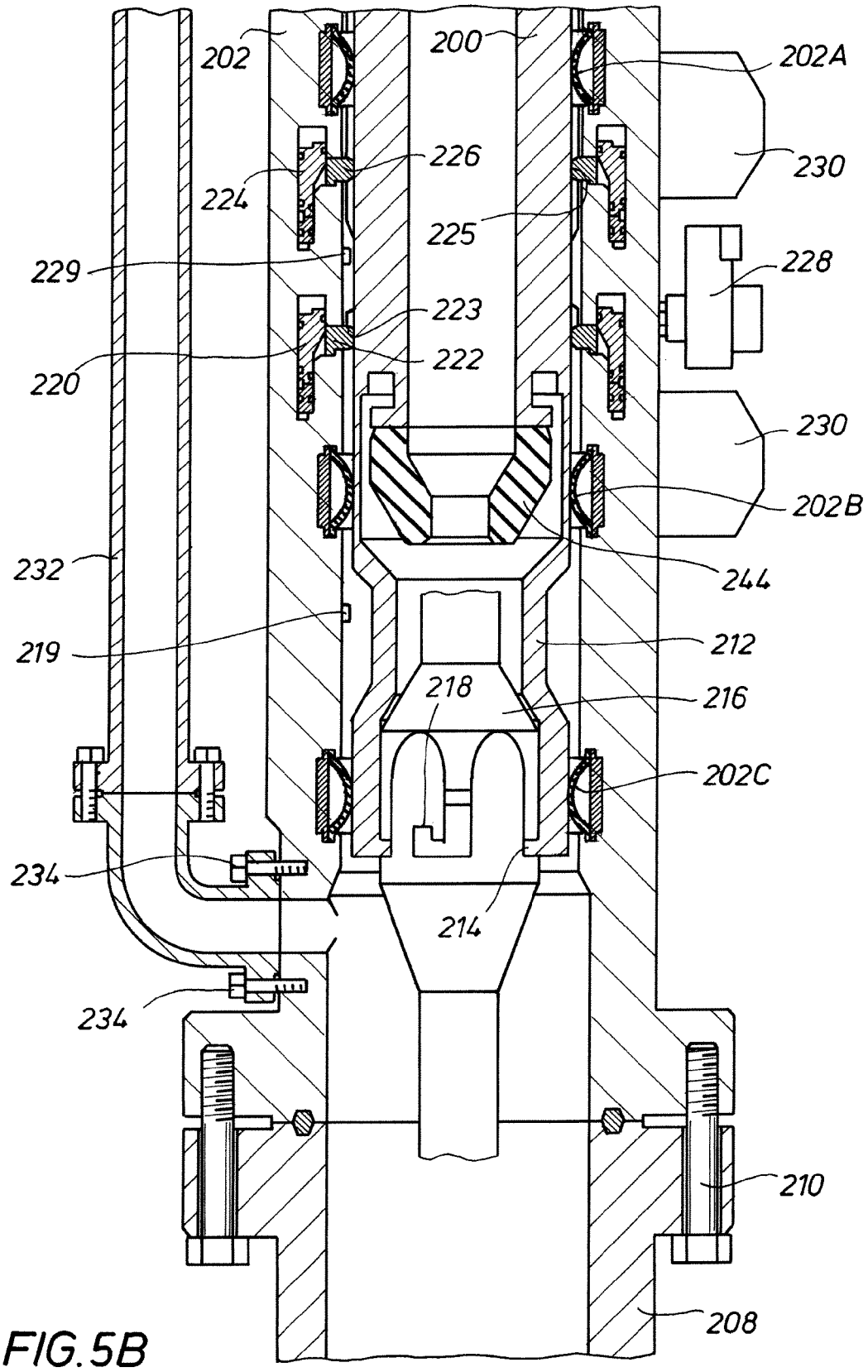

Turning to FIGS. 5A-5B, riser spool or housing 202 is illustrated bolted to marine riser sections (204, 208) with respective bolts (206, 210). An RCD 200 having three passive seals (240, 242, 244) and a seal assembly 212 is positioned with an RCD running tool 216 used for positioning the RCD 200 with housing 202. Seal assembly latching formations 214 may be positioned in the J-hook receiving grooves 218 in RCD running tool 216 and the running tool 216 and RCD 200 moved together on the drill string through the marine riser. RCD 200 is landed with housing 202 with first retainer member 222 and latched with second retainer member 226, both of which are remotely actuated by respective hydraulic pistons in respective latching assemblies (220, 224). First retainer member 222 blocks RCD shoulder 223 and second retainer member 226 is positioned with RCD receiving formation or groove 225.

Upper 202A, intermediate 202B, and lower 202C active packer seals may be activated using the present invention to seal the annulus between the housing 202 and RCD 200. Upper seal 202A and lower active seal 202C may be sealed together to protect latching assemblies (220, 224). Intermediate active seal 202B may provide further division or redundancy for seal 202C. It is also contemplated that lower active seal 202C may be sealed first to seal off the pressure in the riser below the lower seal 202C. Upper active seal 202A may then be sealed at a pressure to act as a wiper to resist debris and trash from contacting latching members (220, 224). Other methods are contemplated. Sensors (219, 229, 237) may be positioned with housing 202 between the seals (202A. 202B, 202C) to detect wellbore parameters, such as pressure, temperature, and/or flow. Such measurements may be useful in determining the effectiveness of the seals (202A. 202B, 202C), and may indicate if a seal (202A, 202B, 202C) is not sealing properly or has been damaged or failed.

It is also contemplated that other sensors may be used to determine the relative difference in rotational speed (RPM) between any of the RCD passive seals (240, 242, 244), for example, seals 240 and 242. For the embodiment shown in FIGS. 5A-5B, as well as all other embodiments, a data information gathering system, such as DIGS, provided by Weatherford may be used with a PLC to monitor and/or reduce relative slippage of the sealing elements (240, 242, 244) with the drill string. It is contemplated that real time revolutions per minute (RPM) of the sealing elements (240, 242, 244) may be measured. If one of the sealing elements (240, 242, 244) is on an independent inner member and is turning at a different rate than another sealing element (240, 242, 244), then it may indicate slippage of one of the sealing elements with tubular. Also, the rotation rate of the sealing elements can be compared to the drill string measured at the top drive (not shown) or at the rotary table in the drilling floor.

The information from all sensors, including sensors (219, 229, 237), may be transmitted to the surface for processing with a CPU through an electrical line or cable positioned with hydraulic line 5 shown in FIG. 1. An ROV may also be used to access the information at ROV panel 228 for processing either at the surface or by the ROV. Other methods are contemplated, including remote accessing of the information. After the RCD 200 is latched and sealed as shown in FIG. 5B, the running tool 216 may be disengaged from the RCD 200 and continue moving with the drill string down the riser for drilling operations.

ROV control panel 228 may be positioned with housing 200 between two shielding protrusions 230 to protect the panel 228. The RCD 200 outside diameter is smaller than the housing 202 inside diameter. Retainer members (222, 226) may be a plurality of dogs or a C-shaped member. External bypass line 232 with valve 238 may be attached with housing 202 with bolts (234, 236). Other attachment means are contemplated. Bypass line 232 with gate valve 238 acts as a check valve in well kick or blowout conditions. Valve 238 may be operated remotely.

Figure 6A:
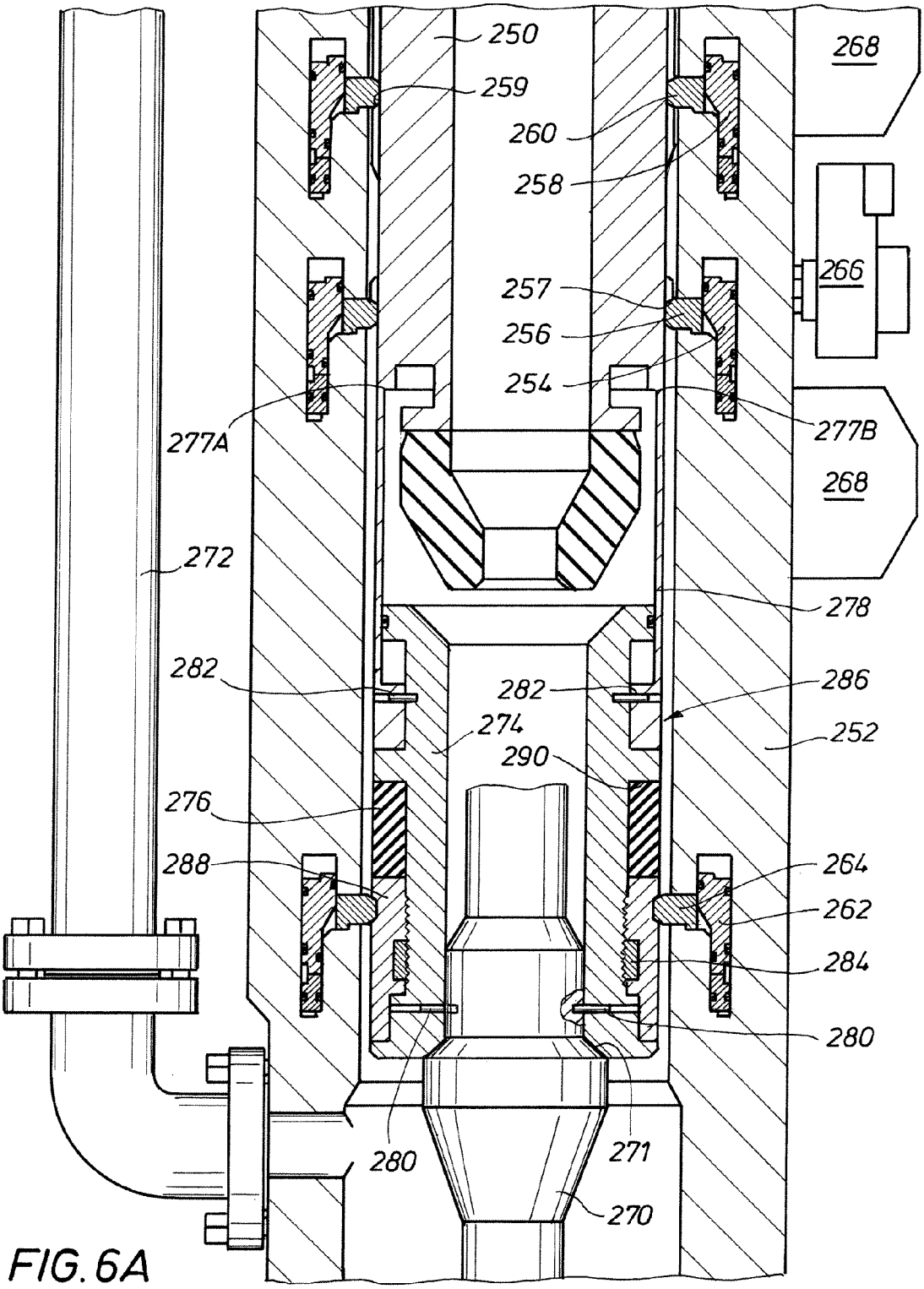
FIG. 6A is a cross-sectional elevational partial view of an RCD having a seal assembly with a mechanically extrudable seal assembly seal shown in the unsealed position, the seal assembly having two unsheared shear pins and a ratchet shear ring.

Turning to FIG. 6A, RCD 250 having a seal assembly, generally designated at 286, is shown latched in riser spool or housing 252 with first retainer member 256, second retainer member 260, and third retainer member or seal assembly retainer 264 of respective latching assemblies (254, 258, 262) in their respective second or latched/landed positions. First retainer member 256 blocks RCD shoulder 257 and second retainer member 260 is positioned with RCD receiving formation or groove 259. An external bypass line 272 is positioned with housing 252. An ROY panel 266 is disposed with housing 252 between two shielding protrusions 268. Seal assembly 286 comprises RCD extension or extending member 278, tool member 274, retainer receiving member 288, seal assembly seal 276, upper or first shear pins 282, lower or second shear pins 280, and ratchet shear ring or ratchet shear 284. Although two upper 282 and two lower 280 shear pins are shown for this and other embodiments, it is contemplated that there may be only one upper 282 and one lower 280 shear pin or that there may be a plurality of upper 282 and lower 280 shear pins of different sizes, metallurgy and shear rating. Other mechanical shearing devices as are known in the art are also contemplated.

Seal assembly seal 276 may be bonded with tool member blocking shoulder 290 and retainer receiving member 288, such as by epoxy. A lip retainer formation in either or both the tool member 274 and retainer receiving member 288 that fits with a corresponding formation(s) in seal 276 is contemplated. This retainer formation, similar to formation 320 shown and/or described with FIG. 7A, allows seal 276 to be connected with the tool member 274 and/or retainer receiving member 288. A combination of bonding and mechanical attachment as described above may be used. Other attachment methods are contemplated. The attachment means shown and discussed for use with extrudable seal 276 may be used with any extrudable seal shown in any embodiment.

Extrudable seal 276 in FIG. 6A, as well as all similar extrudable seals shown in all RCD sealing assemblies in all embodiments, may be made from one integral or monolithic piece of material, or alternatively, it may be made from two or more segments of different materials that are formed together with structural supports, such as wire mesh or metal supports. The different segments of material may have different properties. For example, if the seal 276 were made in three segments of elastomers, such as an upper, intermediate, and lower segment when viewed in elevational cross section, the upper and lower segments may have certain properties to enhance their ability to sandwich or compress a more extrudable intermediate segment. The intermediate segment may be formed differently or have different properties that allow it to extrude laterally when compressed to better seal with the riser housing. Other combinations and materials are contemplated.

Figure 6B:
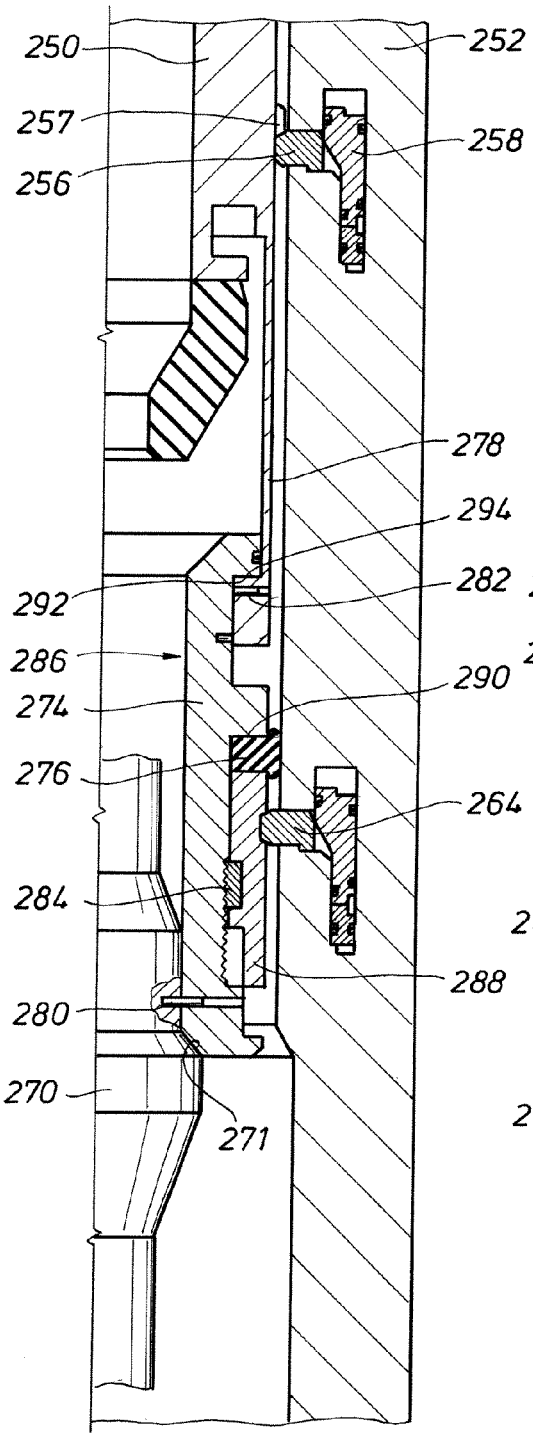
FIG. 6B is a cross-sectional elevational partial broken view of the RCD of FIG. 6A with the RCD running tool moved downward from its position in FIG. 6A to shear the seal assembly upper shear pin and ratchet the ratchet shear ring to extrude the seal assembly seal to the sealed position.

Seal assembly 286 is positioned with RCD running tool 270 with lower shear pins 280 and running tool shoulder 271. After the running tool is made up in the drill string, the running tool 270 and RCD 250 are moved together from the surface down through the marine riser to housing 252 in the landing position shown in FIG. 6A. In one method, it is contemplated that before the RCD 250 is lowered into the housing 252, first retainer member 256 would be in the landing position, and second 260 and third 264 retainer members would be in their unlatched positions. RCD shoulder 257 would contact first retainer member 256, which would block downward movement. Second retainer member 260 would then be moved to its latched position engaging RCD receiving formation 259, which, as discussed above, would squeeze the RCD between the first 256 and second 260 retaining members to resist rotation. Third retaining member would then be moved to its latched position with retainer receiving member 288, as shown in FIG. 6A. After landing, the seal assembly seal 276 may be extruded as shown in FIG. 6B. It should be understood that the downward movement of the running tool and RCD may be accomplished using the weight of the drill string. For all embodiments of the invention shown in all the Figures, it is contemplated that a latch position indicator system, such as one of the embodiments proposed in the '837 patent or the '724 publication, may be used to determine whether the latching pistons, such as latching assemblies (254, 258, 262) of FIG. 6A, are in their latched or unlatched positions. It is contemplated that a programmable logic controller (PLC) having a comparator may compare hydraulic fluid values or parameters to determine the positions of the latches. It is also contemplated that an electrical switch system, a mechanical valve system and/or a proximity sensor system may be positioned with a retainer member. Other methods are contemplated.

It is contemplated that seal assembly 286 may be detachable from RCD 250, such as at locations (277A, 277B). Other attachment locations are contemplated. Seal assembly 286 may be threadingly attached with RCD 250 at locations (277A, 277B). Other types of connections are contemplated. The releasable seal assembly 286 may be removed for repair, and/or for replacement with a different seal assembly. It is contemplated that the replacement seal assembly would accommodate the same vertical distance between the first retainer member 256, the second retainer member 260 and the third retainer member 264. All seal assemblies in all the other embodiments in the Figures may similarly be detached from their RCD.

FIG. 6B shows the setting position used to set or extrude seal assembly seal 276 to seal with housing 252. To set the extrudable seal 276, the running tool 270 is moved downward from the landing position shown in FIG. 6A. This downward motion shears the upper shear pin 282 but not the lower shear pin 280. This downward movement also ratchets the ratchet shear ring 284 upwardly. As can now be understood, lower shear pin 280 has a higher shear and ratchet force than upper shear pin 282 and ratchet shear ring 284, respectively, relative to retainer receiving member 288 and then maintains the relative position. Therefore, ratchet shear ring 284 allows the downward movement of the tool member 274. The running tool 270 pulls the tool member 274 downward. It is contemplated that the force needed to fully extrude seal 276 is less than the shear strength of upper shear pin 282.

When upper shear pin 282 is sheared, there is sufficient force to fully extrude seal 276. Tool member 274 will move downward after upper shear pin 282 is sheared. Tool member blocking shoulder 292 prevents further downward movement of the tool member 274 when shoulder 292 contacts the upward facing blocking shoulder 294 of RCD extending member 278. However, it is contemplated that the seal 276 will be fully extruded before tool member 274 blocking shoulder 292 contacts upward facing shoulder 294. Ratchet shear ring 284 prevents tool member 274 from moving back upwards after tool member 274 moves downwards.

Shoulder 290 of tool member 274 compresses and extrudes seal 276 against retainer receiving member 288, which is held fixed by third retainer member 264. During setting, ratchet shear ring 284 allows tool member 274 to ratchet downward with minimal resistance and without shearing the ring 284. After the seal 276 is set as shown in FIG. 6B, running tool 270 may continue downward through the riser for drilling operations by shearing the lower shear pin 280. Ratchet shear ring 284 maintains tool member 274 from moving upward after the lower shear pin 280 is sheared, thereby keeping seal assembly seal 276 extruded as shown in FIG. 6B during drilling operations. As can now be understood, for the embodiment shown in FIGS. 6A-6C, the weight of the drill string moves the running tool 270 downward for setting the seal assembly seal 276.

As shown in the FIG. 6B view, it is contemplated that shoulder 290 of tool member 274 may be sloped with a positive slope to enhance the extrusion and sealing of seal 276 with housing 252 in the sealed position. It is also contemplated that the upper edge of retainer receiving member 288 that may be bonded with seal 276 may have a negative slope to enhance the extrusion and sealing of seal 276 in the sealed position with housing 252. The above described sloping of members adjacent to the extrudable seal may be used with all embodiments having an extrudable seal. For FIG. 6A and other embodiments with extrudable seals, it is contemplated that if the distance between the outer facing surface of the unextruded seal 276 as it is shown in FIG. 6A, and the riser housing 252 inner bore surface where the extruded seal 276 makes contact when extruded is 0.75 inch (1.91 cm) to 1 inch (2.54 cm), then 2000 to 3000 of sealing force could be provided. Other distances or gaps and sealing forces are contemplated. It should be understood that the greater the distance or gap, the lower the sealing force of the seal 276. It should also be understood that the material composition of the extrudable seal will also affect its sealing force.

Figure 6C:
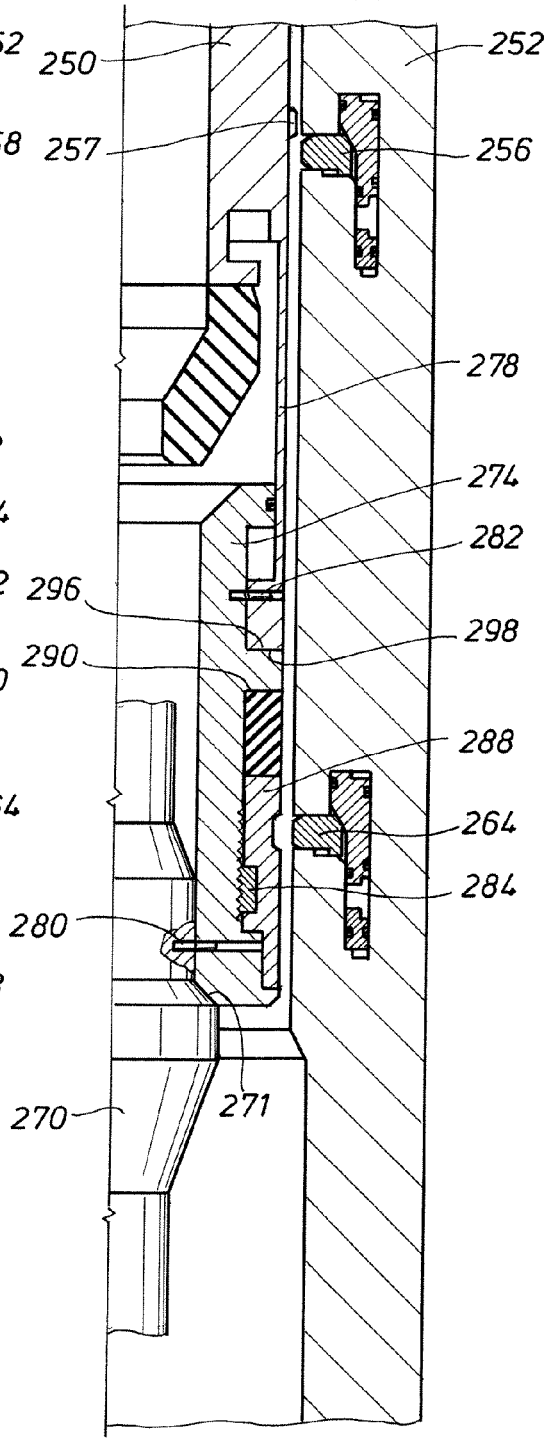
FIG. 6C is a cross-sectional elevational partial broken view of the RCD of FIG. 6B with the RCD running tool moved upward from its position in FIG. 6B, the seal assembly upper shear pin sheared but in its unsheared position, the ratchet shear ring sheared to allow the seal assembly seal to move to the unsealed position, and the riser spool or housing latching members shown in the unlatched position.

FIG. 6C shows the housing 252 in the fully released position for removal or retrieval of the RCD 250 from the housing 252. After drilling operations are completed, the running tool 270 may be moved upward through the riser toward the housing 252. When running tool shoulder 271 makes contact with tool member 274, as shown in FIG. 6C, first, second and third retainer members (256, 260, 264) should be in their latched positions, as shown in FIGS. 6A and 6B. Running tool shoulder 271 then pushes tool member 274 upward, shearing the teeth of ratchet shear ring 284. As can now be understood, ratchet shear ring 284 allows ratcheting in one direction, but shears when moved in the opposite direction upon application of a sufficient force. Tool member 274 moves upward until upwardly facing blocking shoulder 296 of tool member 274 contacts downwardly facing blocking shoulder 298 of extending member 278. The pin openings used to hold the upper 282 and lower 280 shear pins should be at substantially the same elevation before the pins were sheared. FIG. 6C shows the sheared upper 282 and lower 280 shear pins being aligned. Again, the pins could be continuous in the pin opening or equidistantly spaced as desired and depending on the pin being used.

When tool member 274 moves upward, tool member blocking shoulder 290 moves upward, pulling seal assembly seal 276 relative to fixed retainer receiving member 288 retained by the third retainer member 264 in the latched position. The seal 276 is preferably stretched to substantially its initial shape, as shown in FIG. 6C. The retainer members (256, 260, 264) may then be moved to their first or unlatched positions as shown in FIG. 6C, and the RCD 250 and running tool 270 removed together upward from the housing 252.

Figure 7A:
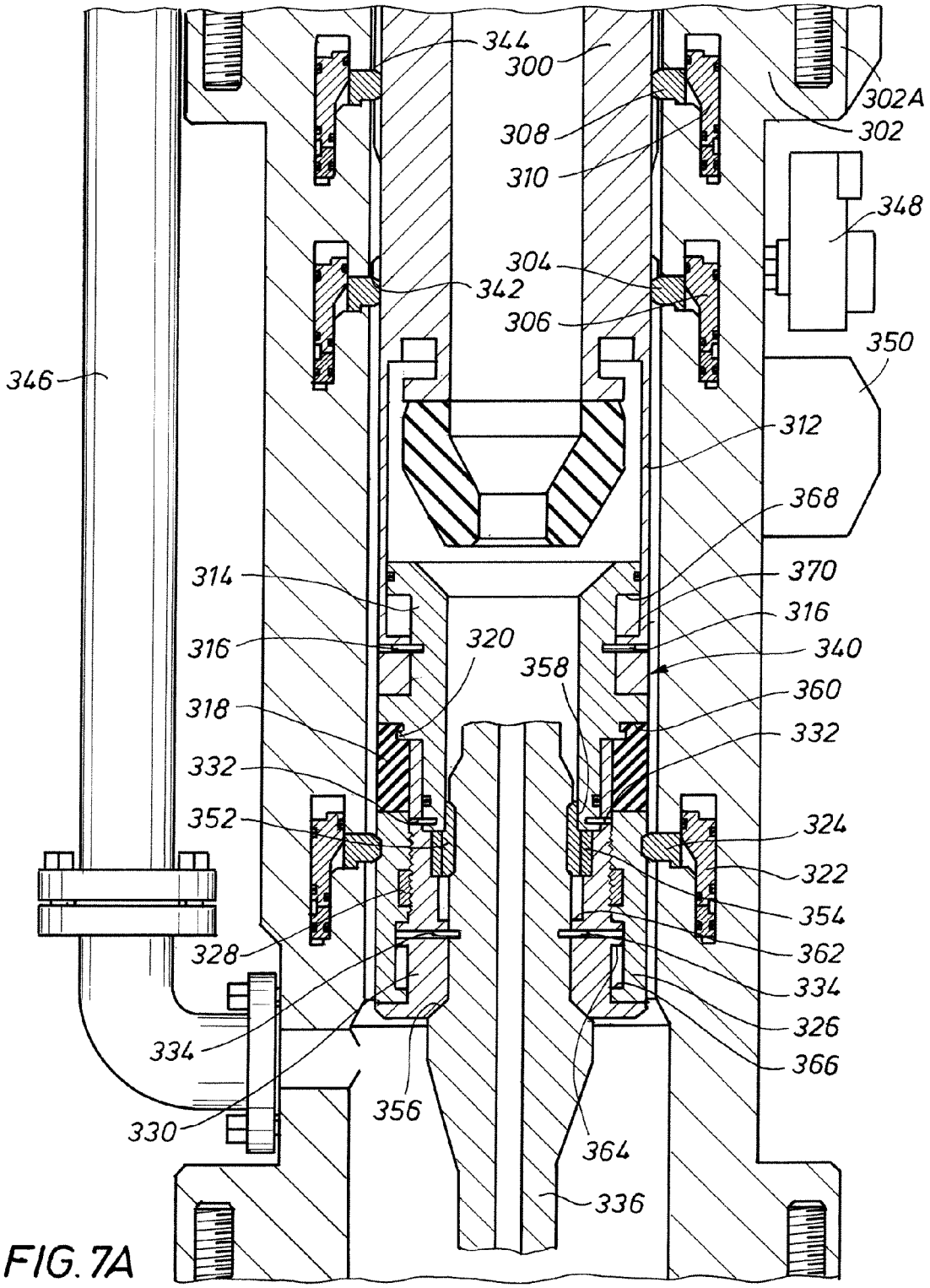
FIG. 7A is a cross-sectional elevational partial view of an RCD having a seal assembly with a seal assembly seal shown in the unsealed position, the seal assembly having upper, intermediate, and lower shear pins, a unidirectional ratchet or lock ring, and two concentric split C-rings.

Turning to FIG. 7A, RCD 300 and its seal assembly, generally designated 340, are shown latched in riser spool or housing 302 with first retainer member 304, second retainer member 308, and third retainer member or seal assembly retainer 324 of respective latching pistons (306, 310, 322) in their respective second or latched/landed positions. First retainer member 304 blocks RCD shoulder 342 and second retainer member 308 is positioned with RCD second receiving formation 344. An external bypass line 346 is positioned with housing 302. An ROV panel 348 is disposed with housing 302 between a shielding protrusion 350 and flange 302A. Seal assembly 340 comprises RCD extending member 312, RCD tool member 314, tool member 330, retainer receiving member 326, seal assembly seal 318, upper shear pins 316, intermediate shear pins 332, lower shear pins 334, ratchet or lock ring 328, inner split C-ring 352, and outer split C-ring 354. Inner C-ring 352 has shoulder 358. Tool member 314 has downwardly facing blocking shoulders (368, 360). Tool member 330 has upwardly facing blocking shoulders 362 and downwardly facing blocking shoulder 364. Retainer receiving member 326 has downwardly facing blocking shoulder 366. Extending member 312 has downwardly facing blocking shoulder 370.

Although two upper 316, two lower 334 and two intermediate 332 shear pins are shown, it is contemplated that there may be only one upper 316, one lower 334 and one intermediate 332 shear pin or, as discussed above, that there may be a plurality of upper 316, lower 334 and intermediate 332 shear pins. Other mechanical shearing devices as are known in the art are also contemplated. Seal assembly seal 318 may be bonded with RCD tool member 314 and retainer receiving member 326, such as by epoxy. A lip retainer formation 320 in RCD tool member 314 fits with a corresponding formation in seal 318 to allow seal 318 to be pulled by RCD tool member 314. Although not shown, a similar lip formation may be used to connect the seal 318 with retainer receiving member 326. A combination of bonding and mechanical attachment as described above may be used.

Figure 7B:
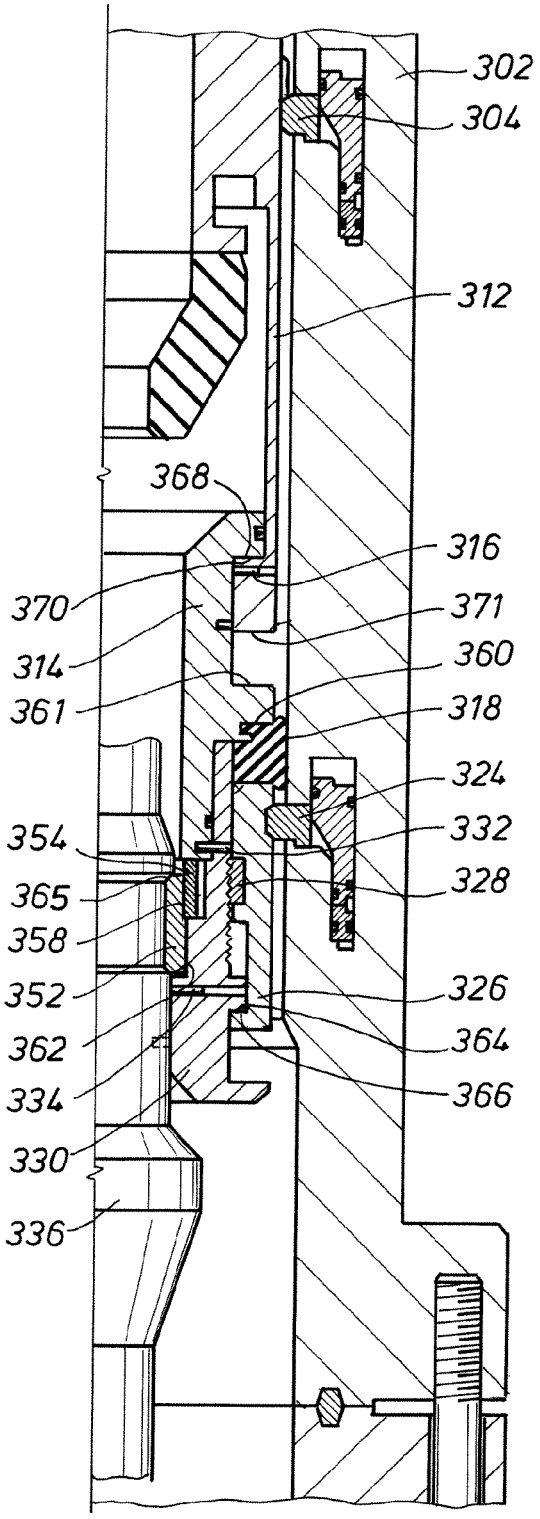
FIG. 7B is a cross-sectional elevational partial broken view of the RCD of FIG. 7A with the RCD running tool moved downward from its position in FIG. 7A, the seal assembly upper shear pin and lower shear pin shown sheared and the ratchet ring ratched to extrude the seal assembly seal to the sealed position.
Figure 7C:
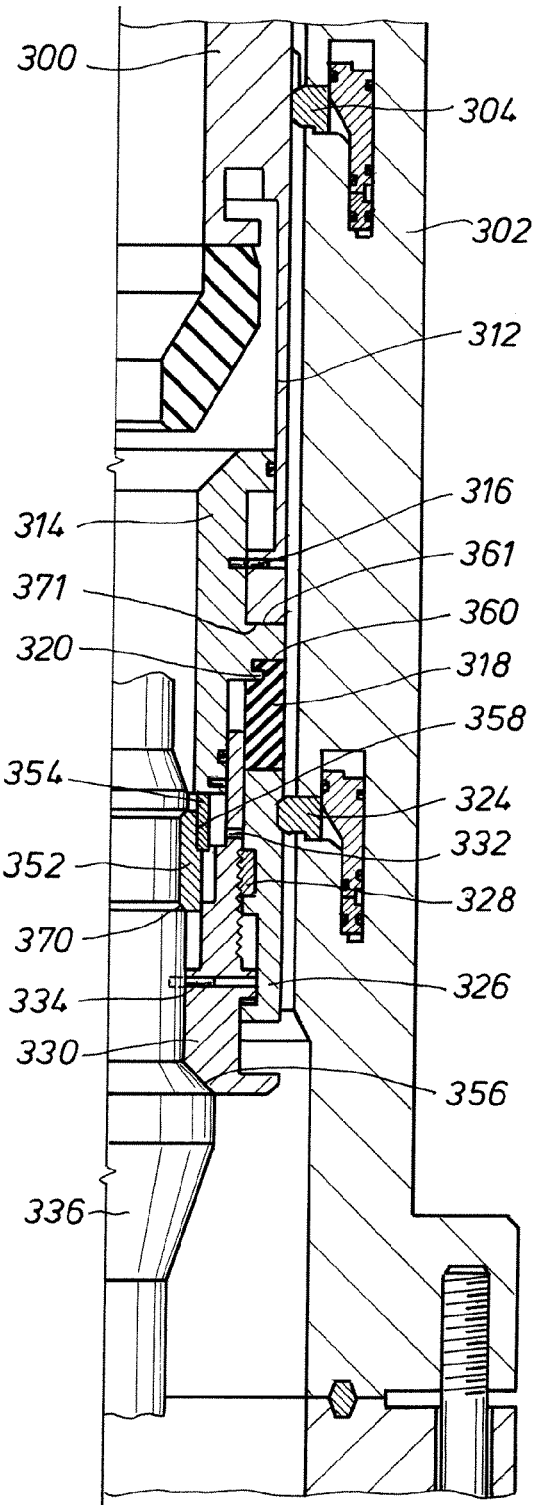
FIG. 7C is a cross-sectional elevational partial broken view of the RCD of FIG. 7B with the RCD running tool moved upward from its position in FIG. 7B, the seal assembly upper shear pin and lower shear pin sheared but in their unsheared positions, the intermediate shear pin sheared to allow the seal assembly seal to move to the unsealed position while all the riser spool or housing latching members remain in the latched position.

Seal assembly 340 is positioned with RCD running tool 336 with lower shear pins 334, running tool shoulder 356, and concentric C-rings (352, 354). The running tool 336 and RCD 300 are moved together from the surface through the marine riser down into housing 302 in the landing position shown in FIG. 7A. In one method, it is contemplated that before the RCD 300 is lowered into the housing 302, first retainer member 304 would be in the landed position, and second 308 and third 324 retainer members would be in their unlatched positions. RCD shoulder 342 would be blocked by first retainer member 304 to block the downward movement of the RCD 300. Second retainer member 308 would then be moved to its latched position engaging RCD receiving formation 344, which would squeeze the RCD between the first 304 and second 308 retaining members to resist rotation. Third retaining member 324 would then be moved to its latched position with retainer receiving member 326 as shown in FIGS. 7A-7C. After landing is completed, the seal assembly seal 318 may be set or extruded.

FIG. 7B shows the setting position used to set or extrude seal assembly seal 318 with housing 302. To set the extrudable seal 318, the running tool 336 is moved downward from the landing position shown in FIG. 7A so that the shoulder 365 of running tool 336 pushes the inner C-ring 352 downward. Inner C-ring 352 contacts blocking shoulder 362 of tool member 330, and pushes the tool member 330 down until the blocking shoulder 364 of the tool member 330 contacts the blocking shoulder 366 of retainer receiving member 326, as shown in FIG. 7B. Outer C-ring 354 then moves inward into groove 358 of inner C-ring 352 as shown in FIG. 7B. The downward motion of the running tool 336 first shears the lower shear pins 334, and after inner C-ring 352 urges tool member 330 downward, the upper shear pins 316 are sheared, as shown in FIG. 7B. The intermediate shear pins 332 are not sheared. As can now be understood, the intermediate shear pins 332 have a higher shear strength than the upper shear pins 316 and lower shear pins 334. The intermediate shear pin 332 pulls RCD tool member 314 downward until downwardly facing blocking shoulder 368 of RCD tool member 314 contacts upwardly facing blocking shoulder 370 of RCD extending member 312. The ratchet or lock ring 328 allows the downward ratcheting of tool member 330 relative to retainer receiving member 326. Like ratchet shear ring 284 of FIGS. 6A-6C, ratchet or lock ring 328 of FIGS. 7A-7C allows ratcheting. However unlike ratchet shear ring 284 of FIGS. 6A-6C, ratchet or lock ring 328 of FIGS. 7A-7C is not designed to shear when tool member 330 moves upwards, but rather ratchet or lock ring 328 resists the upward movement of the adjacent member to maintain the relative positions.

Shoulder 360 of RCD tool member 314 compresses and extrudes seal 318 against retainer receiving member 326, which is fixed by third retainer member 324. After the seal 318 is set as shown in FIG. 7B, running tool 336 may continue downward through the riser for drilling operations. Ratchet or lock ring 328 and intermediate shear pin 332 prevent tool member 330 and RCD tool member 314 from moving upwards, thereby maintaining seal assembly seal 318 extruded as shown in FIG. 7B during drilling operations. As can now be understood, for the embodiment shown in FIGS. 7A-7C, the running tool 336 is moved downward for setting the seal assembly seal 318 and pulled to release. The weight of the drill string may be relied upon for the downward force.

FIG. 7C shows the running tool 336 moved up in the housing 302 after drilling operations for unsetting the seal 318 and thereafter retrieving the RCD 300 from the housing 302. Running tool shoulder 370 makes contact with inner C-ring 352. First, second and third retainer members (304, 308, 324) are in their latched positions, as shown for first 304 and third 324 retainer members in FIG. 7C. Inner C-ring 352 shoulders with outer C-ring 354, outer C-ring 354 shoulders with RCD tool member 314 to shear intermediate shear pins 332. Ratchet or lock ring 328 maintains tool member 330. As can now be understood, ratchet or lock ring 328 allows movement of tool member 330, in one direction, but resists movement in the opposite direction. RCD tool member 314 moves upward until blocking shoulder 361 of RCD tool member 314 contacts blocking shoulder 371 of extending member 312. The openings used to hold the upper 316 and lower 334 shear pins should be at substantially the same elevation before the pins were started.

When RCD tool member 314 moves upward. RCD tool member blocking shoulder 360 moves upward, pulling seal assembly seal 318 with lip retainer formation 320 and/or the bonded connection since retainer receiving member 326 is fixed by the third retainer member 324 in the latched position. The retainer members (304, 308, 324) may then be moved to their first or unlatched positions, and the RCD 300 and running tool 336 together pulled upwards from the housing 302.

Figure 8A:
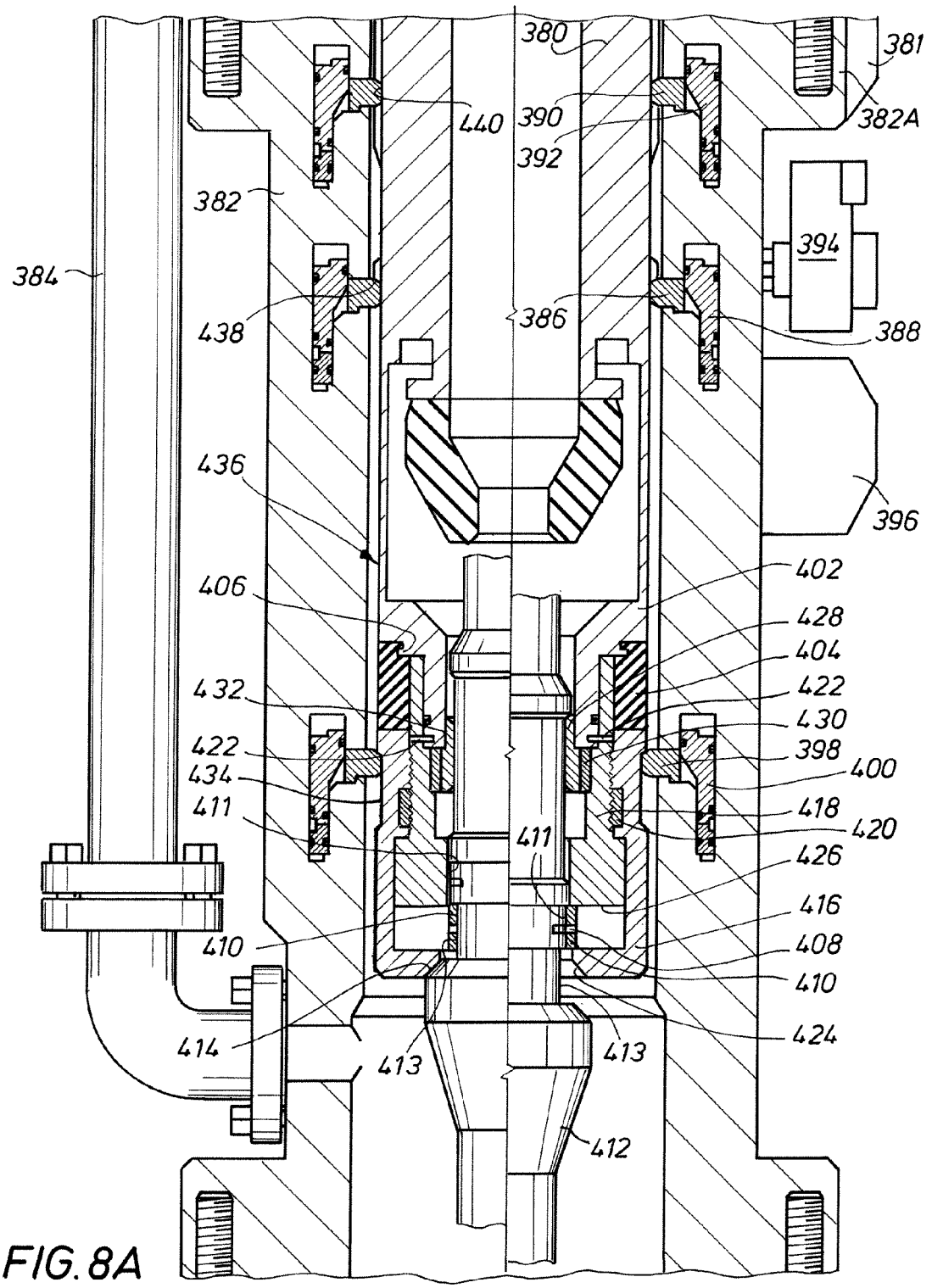
FIG. 8A is a cross-sectional elevational partial split view of an RCD having a seal assembly with a seal assembly seal shown in the unsealed position and a RCD seal assembly loss motion connection latched with a riser spool or housing, on the right side of the break line an upper shear pin and a lower shear pin disposed with an RCD running tool both unsheared, and on the left side of the break line, the RCD running tool moved upward from its position on the right side of the break line to shear the lower shear pin.

Turning to FIG. 8A, RCD 380 and its seal assembly, generally indicated 436, are shown latched in riser spool or housing 382 with first retainer member 386, second retainer member 390, and third retainer member or seal assembly retainer 398 of respective latching pistons (388, 392, 400) in their respective second or latched positions. First retainer member 386 blocks RCD shoulder 438 and second retainer member 390 is positioned with RCD receiving formation 440. An external bypass line 384 is positioned with housing 382. A valve may be positioned with line 384 and any additional bypass line. An ROV panel 394 is disposed with housing 382 between a shielding protrusion 396 and a protection member 381 positioned with flange 382A, similar to protection member 161 in FIG. 4A. Returning to FIG. 8A, seal assembly 436 comprises RCD extending member 402, tool member 418, retainer receiving member 416, seal assembly seal 404, upper shear pins 422, lower shear pins 408, ratchet lock ring 420, lower shear pin retainer ring or third C-ring 410, inner or first C-ring 428, and outer or second C-ring 430. Inner C-ring 428 has groove 432 for seating outer C-ring 430 when running tool 412 is moved downward from its position shown on the left side of the break line in FIG. 8A, as will be described in detail with FIG. 8C. Tool member 418 has blocking shoulder 426. Retainer receiving member 416 has blocking shoulder 424 and loss motion connection or groove 434 for a loss motion connection with third retainer member 398 in its latched position, as shown in FIG. 8A. Extending member 402 has a lip retainer formation 406 for positioning with a corresponding formation on seal 404.

Although two upper 422 and two lower 408 shear pins are shown for this embodiment, it is contemplated that there may be only one upper 422 and one lower 408 shear pin or, as discussed above, that there may be a plurality of upper 422 and lower 408 shear pins for this embodiment of the invention. Other mechanical shearing devices as are known in the art are also contemplated. Seal assembly seal 404 may be bonded with extending member 402 and retainer receiving member 416, such as by epoxy. A lip retainer formation 406 in RCD extending member 402 fits with a corresponding formation in seal 404 to allow seal 404 to be pulled by extending member 402. Although not shown, a similar lip formation may be used to connect the seal 404 with retainer receiving member 416. A combination of bonding and mechanical attachment as described above may be used. Other attachment methods are contemplated.

Seal assembly 436 is positioned with RCD running tool 412 with lower shear pins 408 and third C-ring 410, running tool shoulder 414, and concentric inner and outer C-rings (428, 430). The running tool 412 and RCD 380 are moved together from the surface through the marine riser down into housing 382 in the position landing shown on the right side of the break line in FIG. 8A. In one method, it is contemplated that before the RCD 380 is lowered into the housing 382, first retainer member 386 would be in the latched or landing position, and second 390 and third 398 retainer members would be in their unlatched positions. RCD shoulder 438 would contact first retainer member 386, which would block the downward movement of the RCD 380. Second retainer member 390 would then be moved to its latched position engaging RCD receiving formation 440 to squeeze the RCD 380 between the first retaining members 386 and second retaining members 390 to resist rotation. Third retaining member 398 would then be moved to its latched position with retainer receiving member 416, as shown in FIG. 8A.

On the left side of the break line in FIG. 8A, the running tool 412 has moved upwards, shearing the lower shear pins 408. Shoulder 426 of tool member 418 pushes lower shear pin retainer C-ring 410 downward to slot 413 of running tool 412. C-ring 410 has an inward bias and contracted inward from its position shown on the right side of the break line due to the diameter of the running tool 413. Blocking shoulder 414 of running tool 412 has made contact with blocking shoulder 424 of retainer receiving member 416.

Figure 8B:
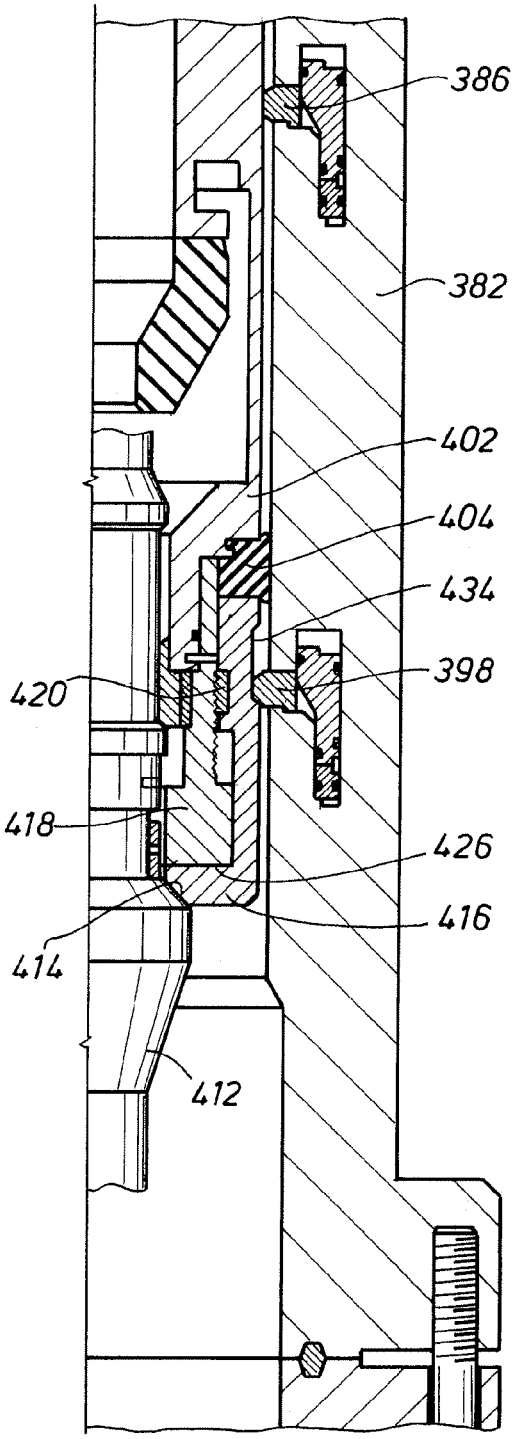
FIG. 8B is a cross-sectional elevational partial broken view of the RCD of FIG. 8A with the RCD running tool moved upward from its position on the left side of the break line in FIG. 8A, the lower latch member retainer moved to the lower end of the loss motion connection and the unidirectional ratchet ring ratcheted upwardly to extrude the seal assembly seal.
Figure 8C:
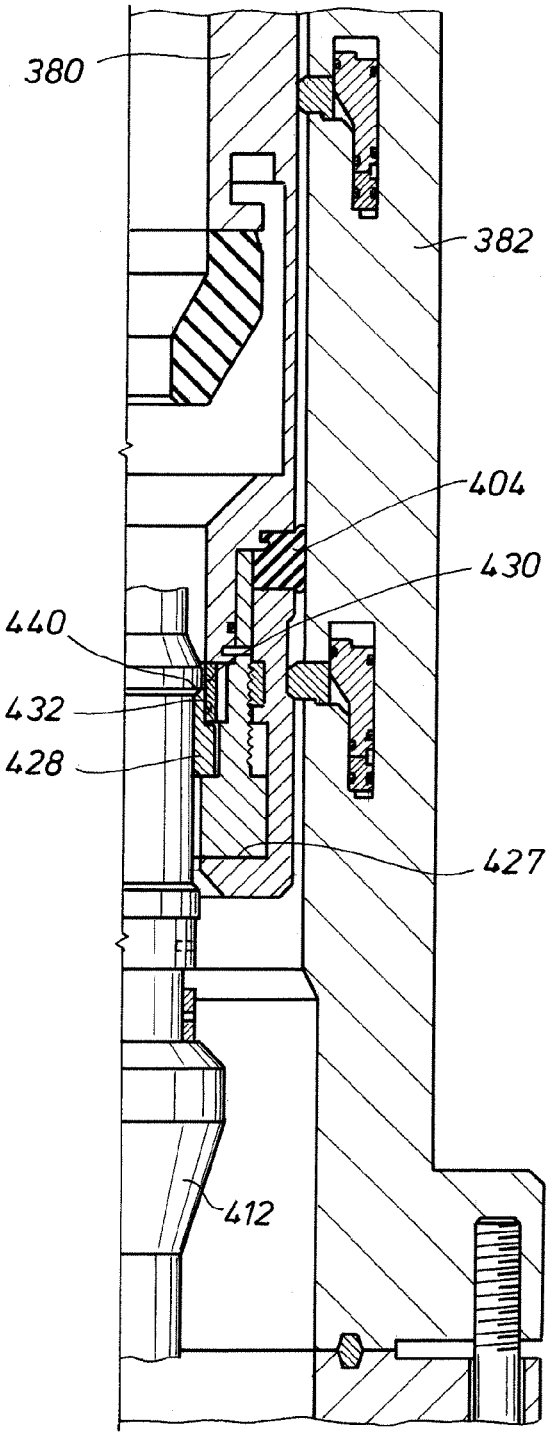
FIG. 8C is a cross-sectional elevational partial broken view of the RCD of FIG. 8B with the RCD running tool moved downward from its position in FIG. 8B, the seal assembly seal in the sealed position and the radially outward split C-ring moved from its concentric position to its shouldered position.

FIG. 8B shows the setting position to mechanically set or extrude seal assembly seal 404 with housing 382. To set the extrudable seal 404, the running tool 412 is moved upward from the landing position, shown on the right side of FIG. 8A, to the position shown on they left side of FIG. 8A. The blocking shoulder 414 of running tool 412 pushes the retainer receiving member 416 upward. Loss motion groove 434 of retainer receiving member 416 allows retainer receiving member 416 to move upward until it is blocked by downwardly facing blocking shoulder 426 of tool member 418 and the upward facing shoulder 427 of retainer receiving member 46 as shown in FIG. 8C. The ratchet or lock ring 420 allows upward ratcheting of retainer receiving member 416 with tool member 418. It should be understood that the tool member 418 does not move downwards to set the seal 404 in FIG. 8C. Like the ratchet or lock ring 328 of FIGS. 7A-7C, ratchet or lock ring 420 maintains the positions of its respective members.

Retainer receiving member 416 compresses and extrudes seal 404 against RCD extending member 402, which is latched with held by first retainer member 386. After the seal 404 is set as shown in FIG. 8B, running tool 412 may begin moving downward as shown in FIG. 8C through the riser for drilling operations. Ratchet or lock ring 420 maintains retainer receiving member 416 from moving downwards, thereby keeping seal assembly seal 404 extruded as shown in FIG. 8B during drilling operations. As can now be understood, for the embodiment shown in FIGS. 8A-8E, unlike the embodiments shown in FIGS. 6A-6C and 7A-7C, the running tool 412 is moved upwards for extruding the seal assembly seal 404.

In FIG. 8C, the running tool 412 has begun moving down through the housing 382 from its position in FIG. 8B to begin drilling operations after seal 404 has been extruded. RCD 380 remains latched with housing 382. Running tool shoulder 440 makes contact with inner C-ring 428 pushing it downwards. Outer C-ring 430, which has a radially inward bias, moves from its concentric position inward into groove 432 in inner C-ring 428, and inner C-ring 428 moves outward enough to allow running tool shoulder 440 to move downward past inner C-ring 428. Running tool may then move downward with the drill string for drilling operations.

Figure 8D:
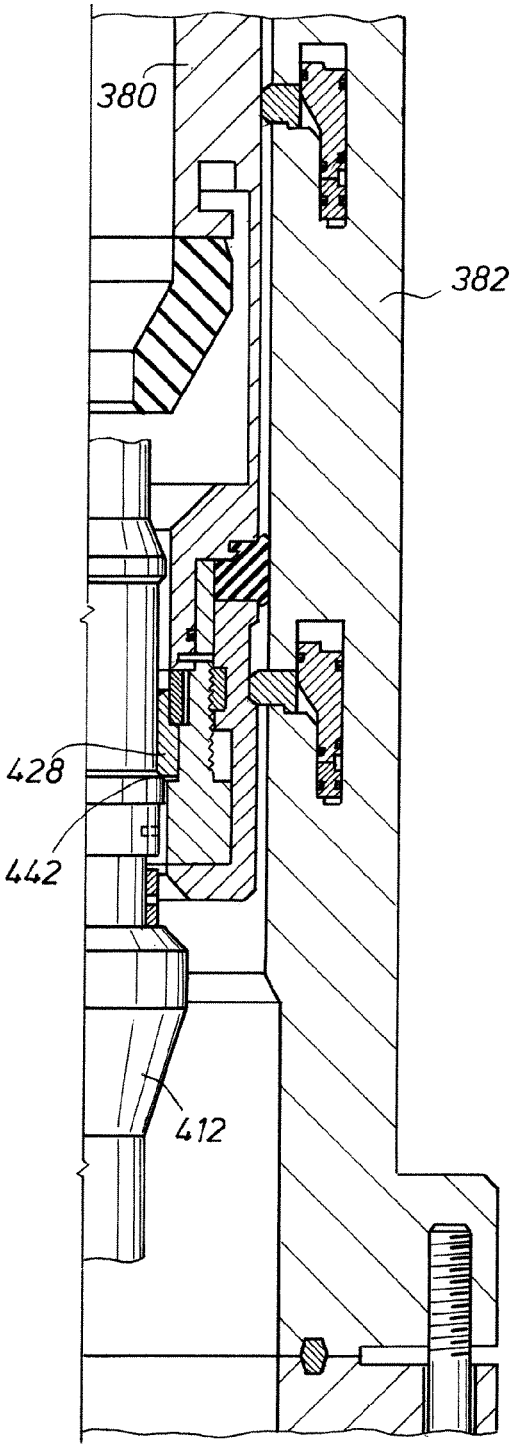
FIG. 8D is a cross-sectional elevational partial broken view of the RCD of FIG. 8C with the RCD running tool moved upward from its position in FIG. 8C so that a running tool shoulder engages the racially inward split C-ring.
Figure 8E:
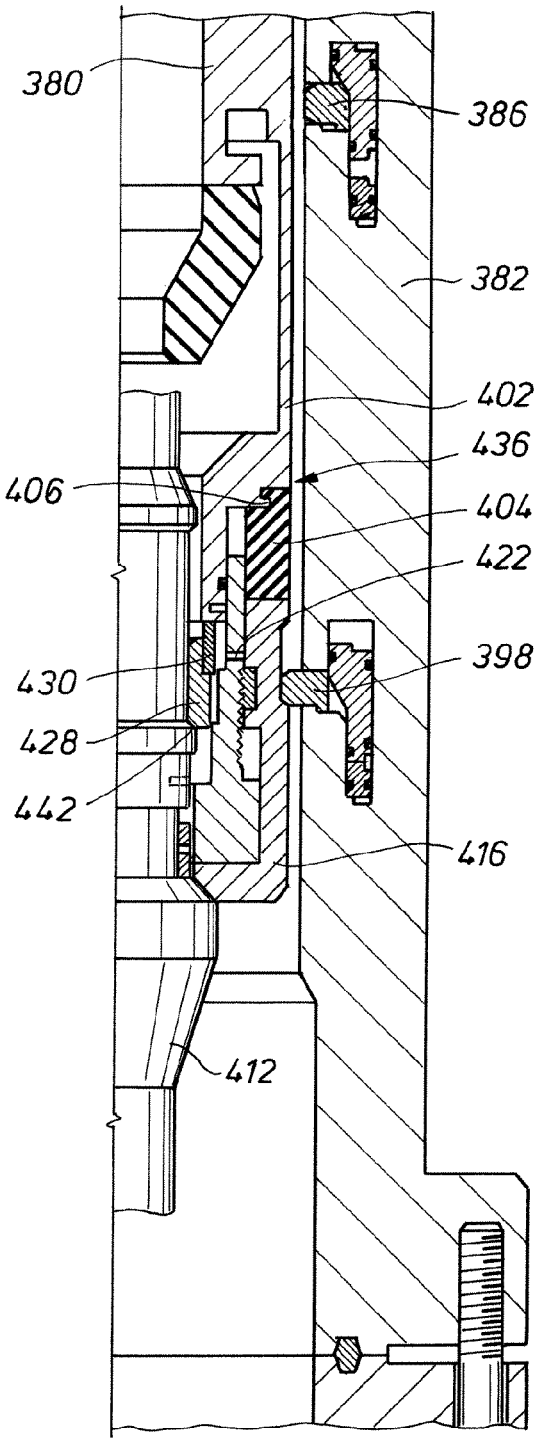
FIG. 8E is a cross-sectional elevational partial broken view of the RCD of FIG. 8D with the RCD running tool moved further upward from its position in FIG. 8D so that the shouldered C-rings shear the upper shear pin to allow the seal assembly seal to move to the unsealed position after the two upper latch members are unlatched.

FIG. 8D shows RCD running tool 412 returning from drilling operations and moving upwards into housing 382 for the RCD 380 retrieval process. Shoulder 442 of running tool 412 shoulders inner C-ring 428, as shown in FIG. 8D. FIG. 8E shows the seal assembly 436 and housing 382 in the RCD retrieval position. The first retainer members 386 and second retainer members 390 are in their first or unlatched positions. Running tool 412 moves upwards and running tool shoulder 442 shoulders inner C-ring 428 upwards, which shoulders outer C-ring 430. Outer C-ring 430 then shoulders unlatched RCD extending member 402 upwards. RCD 380 having RCD extending member 402 may move upwards since first 386 and second 390 retainer members are unlatched. Lip formation 406 of extending member 402 pulls seal 404 upwards. Seal 404 may also be bonded with extending member 402. Retainer receiving member 416 remains shouldered against third retainer 398 in the latched position. It is contemplated that seal 404 may also be bonded with retainer receiving member 416, and/or may also have a lip formation connection similar to formation 406 on extending member 402. In all embodiments of the invention, when retrieving or releasing an RCD from the housing, the running tool is pulled or moves upwards into the housing.

Figure 9A:
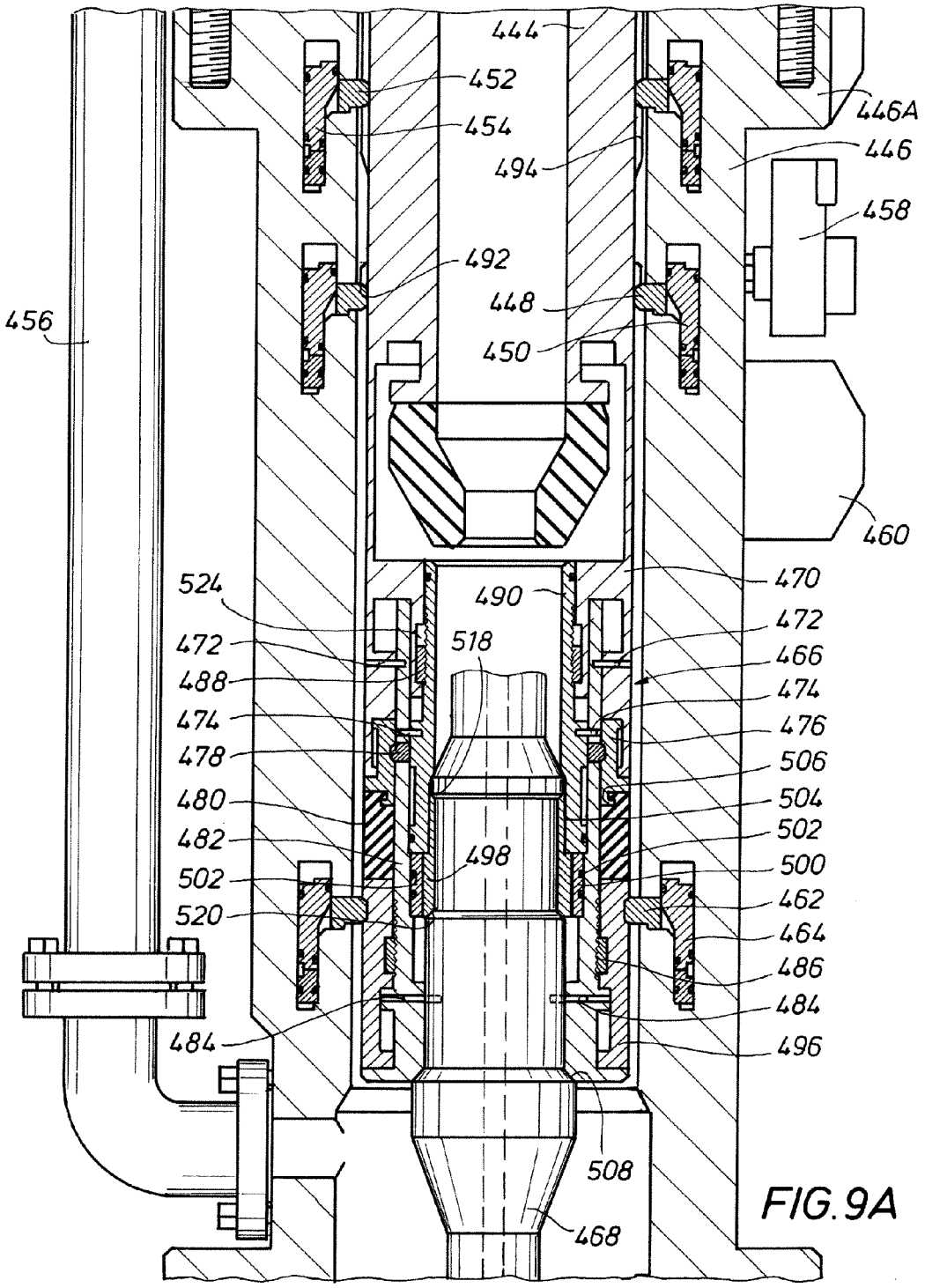
FIG. 9A is a cross-sectional elevational partial view of an RCD having a seal assembly with a seal assembly seal shown in the unsealed position, a seal assembly latching member in the latched position, upper, intermediate and lower shear pins, all unsheared, and an upper and a lower unidirectional ratchet or lock rings, the RCD seal assembly disposed with an RCD running tool, and latched with a riser spool having three latching members shown in the latched position and a bypass conduit or line.

Turning to FIG. 9A, RCD 444 and its seal assembly 466 are shown latched in riser spool or housing 446 with first retainer member 448, second retainer member 452, and third retainer member or seal assembly retainer member 462 of respective latching pistons (450, 454, 464) in their respective second or latched positions. First retainer member 448 blocks RCD shoulder 492 and second retainer member 452 is positioned with RCD receiving formation 494. An external bypass line 456 is positioned with housing 446. An ROV panel 458 is disposed with housing 446 between a shouldering protrusion 460 and flange 446A. Seal assembly 466 comprises RCD or extending member 470, RCD tool member 490, tool member 482, retainer receiving member 496, seal member 476, seal assembly seal 480, upper shear pins 472, intermediate shear pins 474, lower shear pins 484, seal assembly dog 478, upper lock ring ratchet or lock ring 488, lower ratchet or lock ring 486, inner or first C-ring 498, and outer segments 500 with two garter springs 502. It is contemplated that there may be a plurality of segments 500 held together radially around inner C-ring 498 by garter springs 502. Segments 500 with garter springs 502 are a radially enlargeable member urged to be contracted radially inward. It is also contemplated that there may be only one garter spring 502 or a plurality of garter springs 502. It is also contemplated that an outer C-ring may be used instead of outer segments 500 with garter springs 502. An outer C-ring may also be used with garter springs. Inner C-ring 498 is disposed between running tool shoulders (518, 520). Inner C-ring 498 has groove 504 for seating outer segments 500 when running tool 468 is moved downward from its position in FIG. 9A, as will be described in detail with FIG. 9C.

Upper ratchet or lock ring 488 is disposed in groove 524 of RCD extending member 470. Although two upper 472, two lower 484 and two intermediate 474 shear pins are shown for this embodiment, it is contemplated that there may be only one upper shear pin 472, one lower shear pin 484 and one intermediate sheer pin 474 shear pin or, as discussed above, that there may be a plurality of upper 472, lower 484 and intermediate 474 shear pins. Other mechanical shearing devices as are known in the art are also contemplated. Seal assembly seal 480 may be bonded with seal member 476 and retainer receiving member 496, such as by epoxy. A lip retainer formation 506 in seal member 476 fits with a corresponding formation in seal 480 to allow seal 480 to be pulled by seal member 476, as will be described below in detail with FIG. 9E. Although not shown, a similar lip formation may be used to connect the seal 480 with retainer receiving member 496. A combination of bonding and mechanical attachment, as described above, may be used. Other attachment methods are contemplated.

Seal assembly, generally indicated as 466, is positioned with RCD running tool 468 with lower shear pins 484, running tool shoulder 508, inner C-ring 498, and segments 500 with garter springs 502. The running tool 468 and RCD 444 are moved together from the surface through the marine riser down into housing 446 in the landing position shown in FIG. 9A. In one method, it is contemplated that before the RCD 444 is lowered into the housing 446, first retainer member 448 would be in the landing position, and second 452 and third 462 retainer members would be in their unlatched positions. RCD shoulder 492 would contact first retainer member 448 to block the downward movement of the RCD 444. Second retainer member 452 would then be moved to its latched position engaging RCD receiving formation 494, which would squeeze the RCD between the first 448 and second 452 retaining members to resist rotation. Third retaining member 462 would then be moved to its latched position with retainer receiving member 496 as shown in FIG. 9A.

Figure 9B:
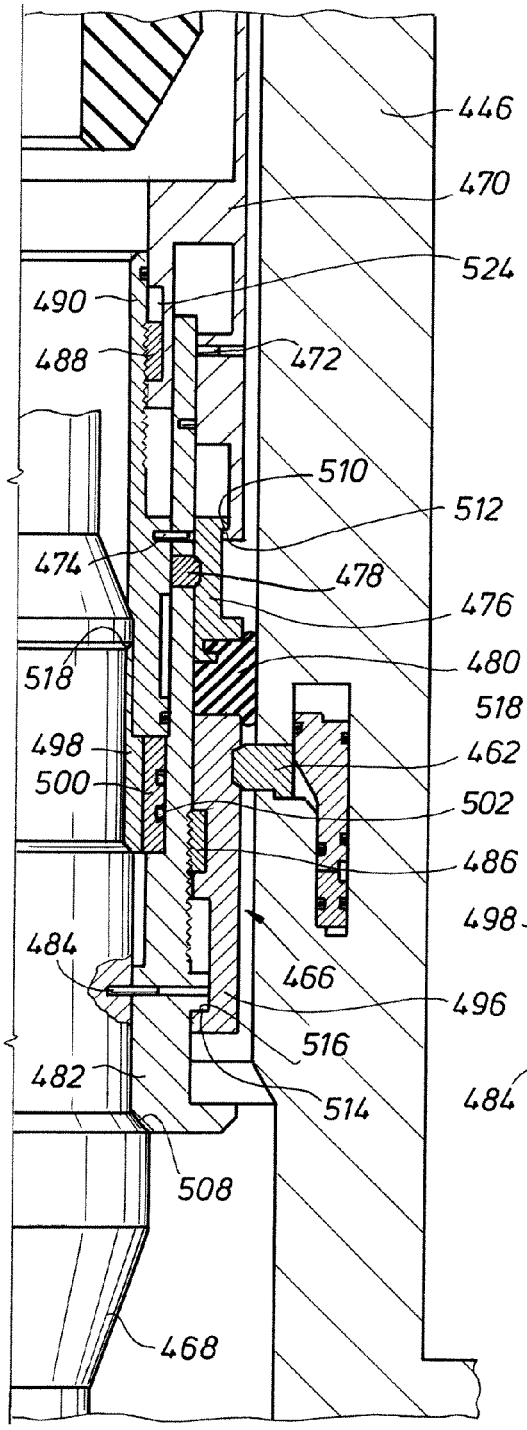
FIG. 9B is a cross-sectional elevational partial broken view of the RCD of FIG. 9A with the RCD running tool moved downward from its position in FIG. 9A, the upper shear pin sheared and the lower ratchet ring ratcheted to extrude the seal assembly seal.

FIG. 9B shows the first stage of the setting position used to mechanically set or extrude seal assembly seal 480 with housing 446. To set the extrudable seal 480, the running tool 468 is moved downward from the landing position shown in FIG. 9A. The lower shear pin 484 pulls tool member 482 downward with running tool 468. Tool member shoulder 518 also shoulders inner C-ring 498 downward relative to outer segments 500 held with garter springs 502. Similar to ratchet or lock ring 328 of FIGS. 7A-7C, lower ratchet or lock ring 486 allows the downward movement of tool member 482 while resisting the upward movement of the tool member 482. Similarly, upper ratchet or lock ring 488 allows the downward movement of RCD tool member 490 while resisting the upward movement of the RCD tool member 490. However, as will be discussed below with FIG. 9D, upper ratchet or lock ring 488 is positioned in slot 524 of extending member 470, allowing movement of upper ratchet or lock ring 488.

RCD tool member 490 is pulled downward by intermediate shear pins 474 disposed with tool member 482. The downward movement of tool member 482 shears upper shear pins 472. As can now be understood, the shear strength of upper shear pins 472 is lower than the shear strengths of intermediate shear pins 474 and lower shear pins 484 shear pins. Tool member 482 moves downward until its downwardly facing blocking shoulder 514 contacts retainer receiving member upwardly facing blocking shoulder 516. Seal assembly retaining dog 478 pulls seal member 476 downward until its downwardly facing shoulder 510 contacts extending member upwardly facing shoulder 512. Dog 478 may be a C-ring with radially inward bias. Other devices are contemplated. Seal assembly retainer 462 is latched, fixing retainer receiving member 496. Seal assembly seal 480 is extruded or set as shown in FIG. 9B. Lower ratchet or lock ring 486 resists tool member 482 from moving upwards, and dog 478 resists seal member 476 from moving upwards, thereby maintaining seal assembly seal 480 extruded as shown in FIG. 9B during drilling operations.

Figure 9C:
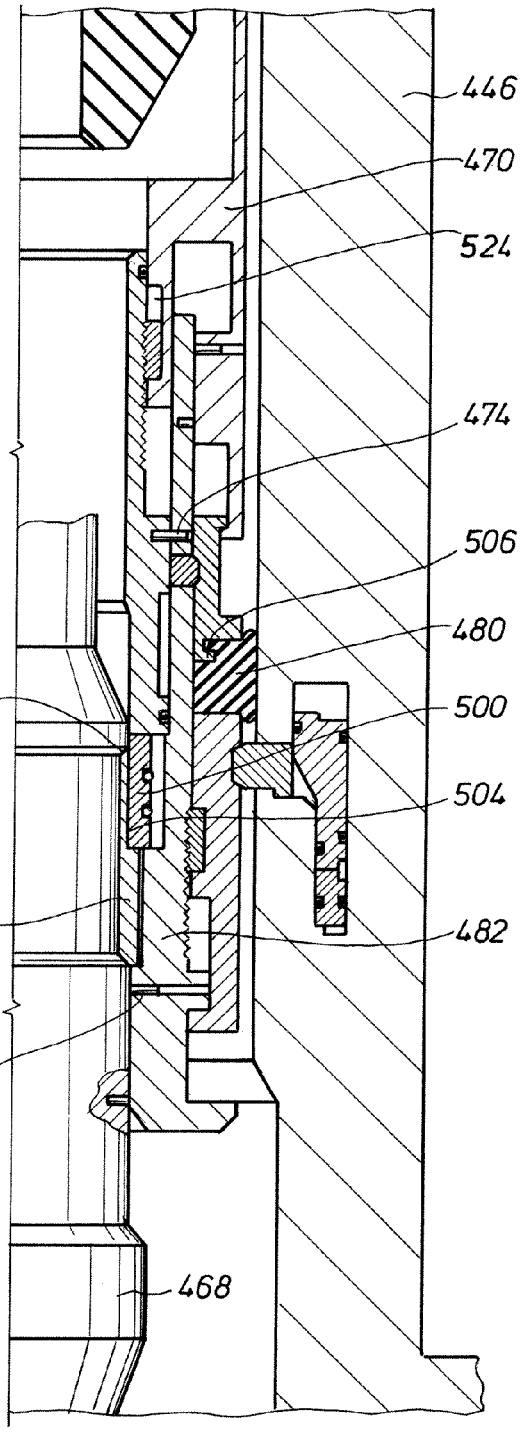
FIG. 9C is a cross-sectional elevational partial broken view of the RCD of FIG. 9B with the RCD running tool moved downward from its position in FIG. 9B, the lower shear pin sheared, and the seal assembly seal to the sealed position and the radially outward garter springed segments moved from their concentric position to their shouldered position.

FIG. 9C shows the final stage of setting the seal 480. Running tool 468 is moved downward from its position in FIG. 9B using the weight of the drill string to shear lower shear pin 484. As can now be understood, lower shear pin 484 has a lower shear strength than intermediate shear pin 474. RCD running tool shoulder 518 pushes inner C-ring 498 downward and outer segments 500 may move inward into groove 504 of inner C-ring 498, as shown in FIG. 9C. Running tool 468 may then proceed downward with the drill string for drilling operations, leaving RCD 444 sealed with the housing 446. As can now be understood, for the embodiment shown in FIGS. 9A-9E, the running tool 468 is moved downward for setting the seal assembly seal 480. The weight of the drill string may be relied upon for the downward force.

Figure 9D:
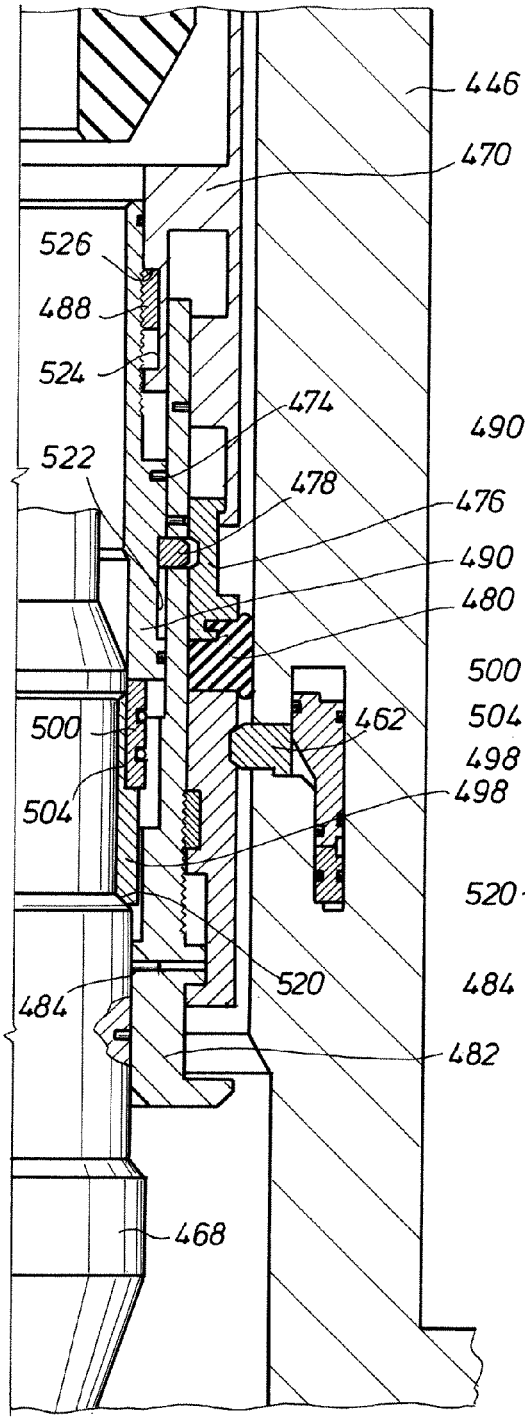
FIG. 9D is a cross-sectional elevational partial broken view of the RCD of FIG. 9C with the RCD running tool moved upward from its position in FIG. 9C so that the shouldered garter spring segments shear the intermediate shear pin to allow the seal assembly dog to move to the unlatched position after the two upper latch members are unlatched.

FIG. 9D shows the running tool 468 moving up in the housing 446 after drilling operations for the first stage of unsetting or releasing the seal 480 and thereafter retrieving the RCD 444 from the housing 446. Running tool shoulder 520 shoulders inner C-ring 498. Third retainer member 462 is in its latched position. Inner C-ring 498 shoulders outer segments 500 upwards by the shoulder in groove 504, and outer segments 500 shoulders RCD tool member 490 upwards, shearing intermediate shear pins 474. Upper ratchet or lock ring 488 moves upwards in slot 524 of RCD extending member 470 until it is blocked by shoulder 526 of extending member 470. Seal assembly retainer dog 478 is allowed to move inwardly or retracts into slot 522 of RCD tool member 490. Although not shown in FIGS. 9D-9E, first 448 retainer member and second retainer member 452, shown in FIG. 9A, are moved into their first or unlatched positions. It is also contemplated that both or either of first retainer member 448 and second retainer member 452 may be moved to their unlatched positions before the movement of the running tool 468 shown in FIG. 9D.

Figure 9E:
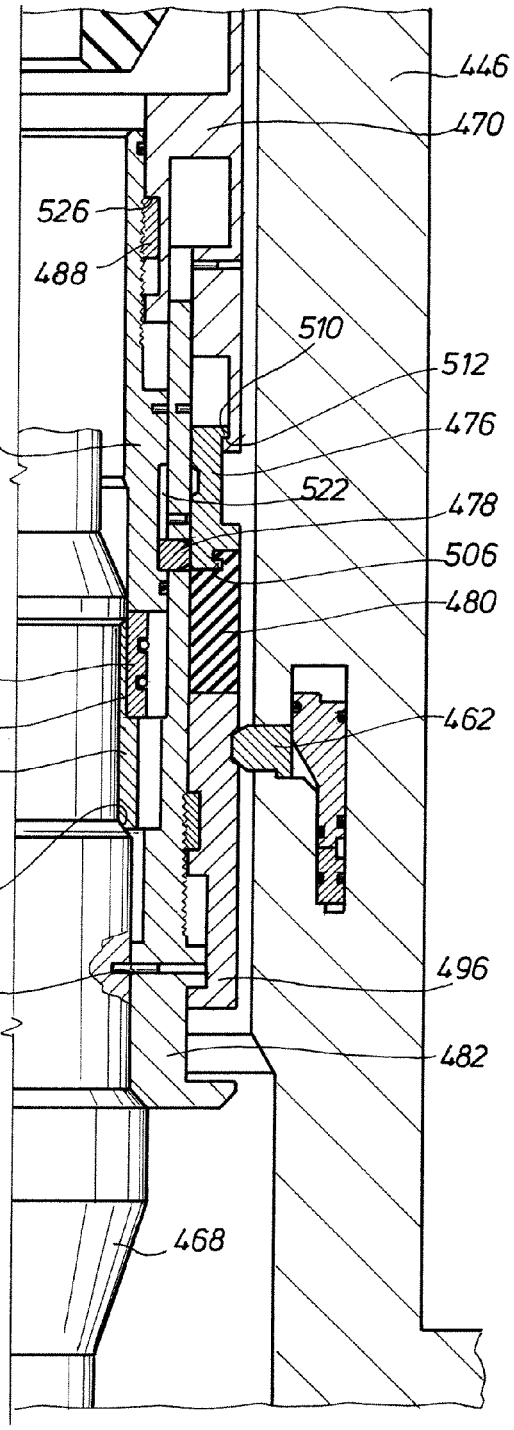
FIG. 9E is a cross-sectional elevational partial broken view of the RCD of FIG. 9D with the RCD running tool moved further upward from its position in FIG. 9D, the lower shear pin sheared but in its unsheared position, the seal assembly dog in the unlatched position to allow the seal assembly seal to move to the unsealed position after the two upper latch members are unlatched.

Turning to FIG. 9E, the final stage for unsealing seal 480 is shown. Running tool 468 is moved upwards from its position in FIG. 9D, and running tool shoulder 520 shoulders inner C-ring 498 upwards. Inner C-ring 498 shoulders outer segments 500 disposed in slot 504 of inner C-ring 498 upwards. Outer segments 500 shoulders RCD tool member 490 upwards. Since upper ratchet or lock ring 488 had previously contacted shoulder 526 of extension member 470 in FIG. 9D, upper ratchet or ring 488 now shoulders RCD extending member 470 upwards by pushing on shoulder 526. RCD extending member 470 may move upwards with RCD 444 since first retaining member 448 and second retaining member 452 are in their unlatched positions. Upwardly facing shoulder 512 of extending member 470 pulls downwardly facing shoulder 510 of seal member 476 upwards, and seal member 476, in turn, stretches seal 480 upwards through lip formation 506 and/or bonding with seal 480.

Third retainer member 462 maintains retainer receiving member 496 and the one end of seal 480 fixed, since seal 480 is bonded and/or mechanically attached with retainer receiving member 496. Seal assembly retainer dog 478 moves along slot 522 of RCD tool member 490. Seal 480 is preferably stretched to substantially its initial shape, as shown in FIG. 9E, at which time the openings in running tool 468 and tool member 482 for holding lower shear pins 484, which was previously sheared, are at the same elevation when the lower shear pin 484 was not sheared. Seal assembly retainer member or third retainer member 462 may then be moved to its first or unlatched position, allowing RCD running tool 468 to lift the RCD 444 to the surface.

Figure 10A:
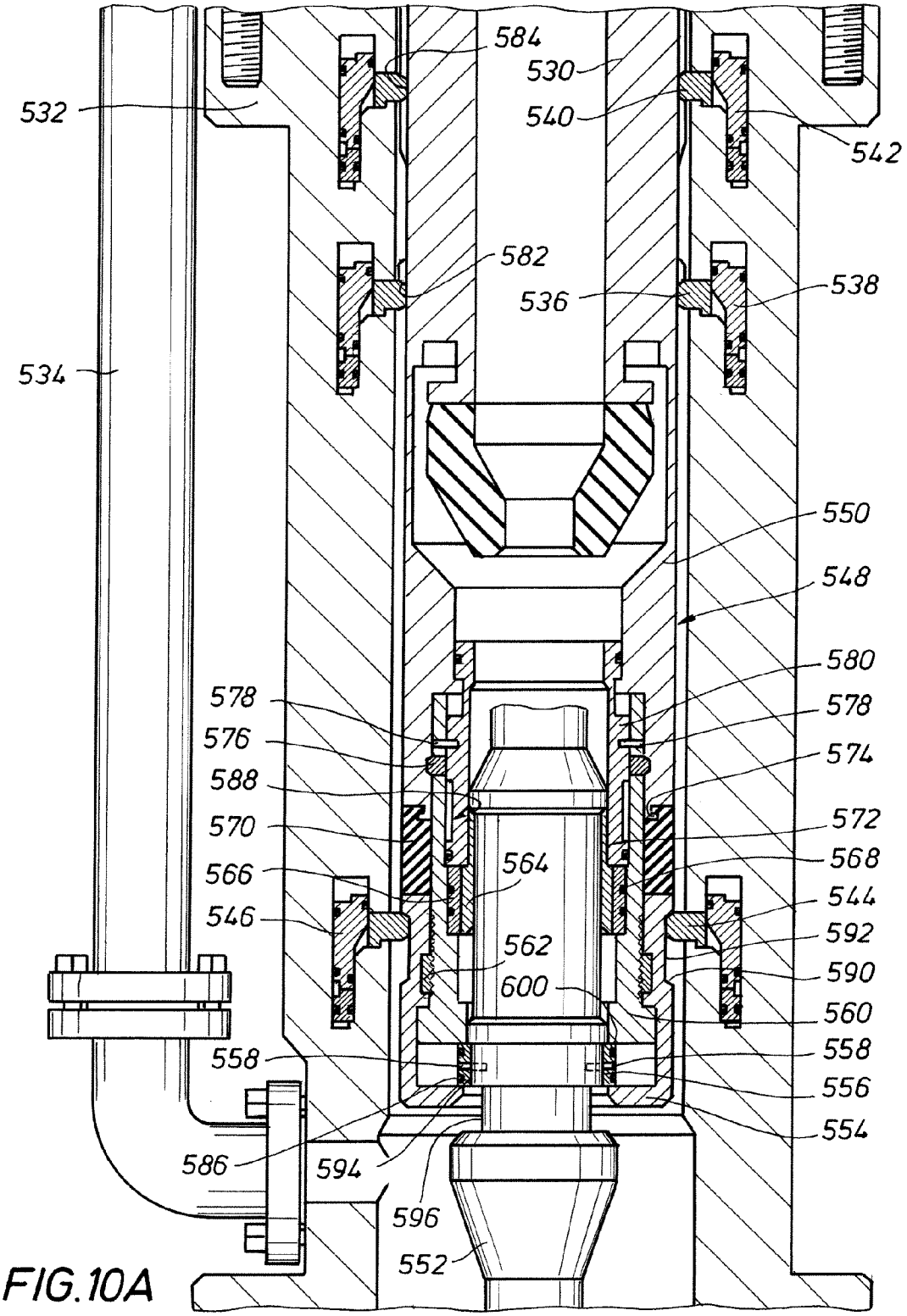
FIG. 10A is a cross-sectional elevational partial view of an RCD having a seal assembly, similar to FIG. 4B, with the seal assembly seal shown in the unsealed position, a seal assembly dog shown in the latched position, unsheared upper and lower shear pins, and a unidirectional ratchet or lock ring, the lower shear pin disposed between an RCD running tool and garter springed segments, and a riser spool having three latching members shown in the latched position and a bypass conduit or line.

Turning to FIG. 10A, RCD 530 and its seal assembly 548 are shown latched in riser spool or housing 532 with first retainer member 536, second retainer member 540, and third retainer member 544 of respective latching pistons (538, 542, 546) in their respective second or latched positions. First retainer member 536 blocks RCD shoulder 582 and second retainer member 540 is positioned with RCD receiving formation 584. An external bypass line 534 is positioned with housing 532. Seal assembly, generally indicated at 548, comprises RCD extending member 550. RCD tool member 580, tool member 560, retainer receiving member 554, seal assembly seal 570, upper shear pins 578, lower shear pins 558, lower shear pin holding segments 556 with garter springs 586, ratchet or lock ring 562, inner C-ring 564, outer segments 566 with garter springs 568, and seal assembly retaining dog 576. It is contemplated that C-rings may be used instead of segments (566, 556) with respective garter springs (568, 586), or that C-rings may be used with garter springs. Tool member shoulder 600 shoulders with lower shear pin segments 556. Inner C-ring 564 has groove 572 for seating outer segments 566 when running tool 552 is moved as described with and shown in FIG. 10C. Inner C-ring 562 shoulders with running tool shoulder 588. Retainer receiving member 554 has a blocking shoulder 590 in the loss motion connection or groove 592 for a loss motion connection with third retainer member 544 in its latched position, as shown in FIG. 10A.

Although two upper shear pins 578 and two lower shear pins 558 are shown, it is contemplated that there may be only one upper shear pin 578 and one lower shear pin 558 or, as discussed above, that there may be a plurality of upper shear pins 578 and lower shear pins 558. Other mechanical shearing devices as are known in the art are also contemplated. Seal assembly seal 570 may be bonded with extending member 550 and retainer receiving member 554, such as by epoxy. A lip retainer formation 574 in RCD extending member 550 fits with a corresponding formation in seal 570 to allow seal 570 to be pulled by extending member 550. Although not shown, a similar lip formation may be used to connect the seal 570 with retainer receiving member 554. A combination of bonding and mechanical attachment as described above may be used. Other attachment methods are contemplated.

Seal assembly, generally indicated at 548, is positioned with RCD running tool 552 with lower shear pins 558 and lower shear pin segments 556, running tool shoulder 588, inner C-ring 564, and outer segments 566 with garter springs 568. Lower shear pin segments 556 are disposed on running tool surface 594, which has a larger diameter than adjacent running tool slot 596. The running tool 552 and RCD 530 are moved together from the surface through the marine riser down into housing 532 in the landing position shown in FIG. 10A. In one method, it is contemplated that before the RCD 530 is lowered into the housing 532, first retainer member 536 would be in the landing position, and second 540 and third 544 retainer members would be in their unlatched positions. RCD shoulder 582 would be blocked by first retainer member 536, which would block downward movement of the RCD 530. Second retainer member 540 would then be moved to its latched position engaging RCD receiving formation 584, which would squeeze the RCD 530 between the first 536 and second 540 retaining members to resist rotation. Third retaining member 544 would then be moved to its latched position with retainer receiving member 554 in loss motion connection or groove 592 as shown in FIG. 10A. After landing is completed, the process of extruding the seal assembly seal 570 may begin as shown in FIGS. 10B-10C.

Figure 10B:
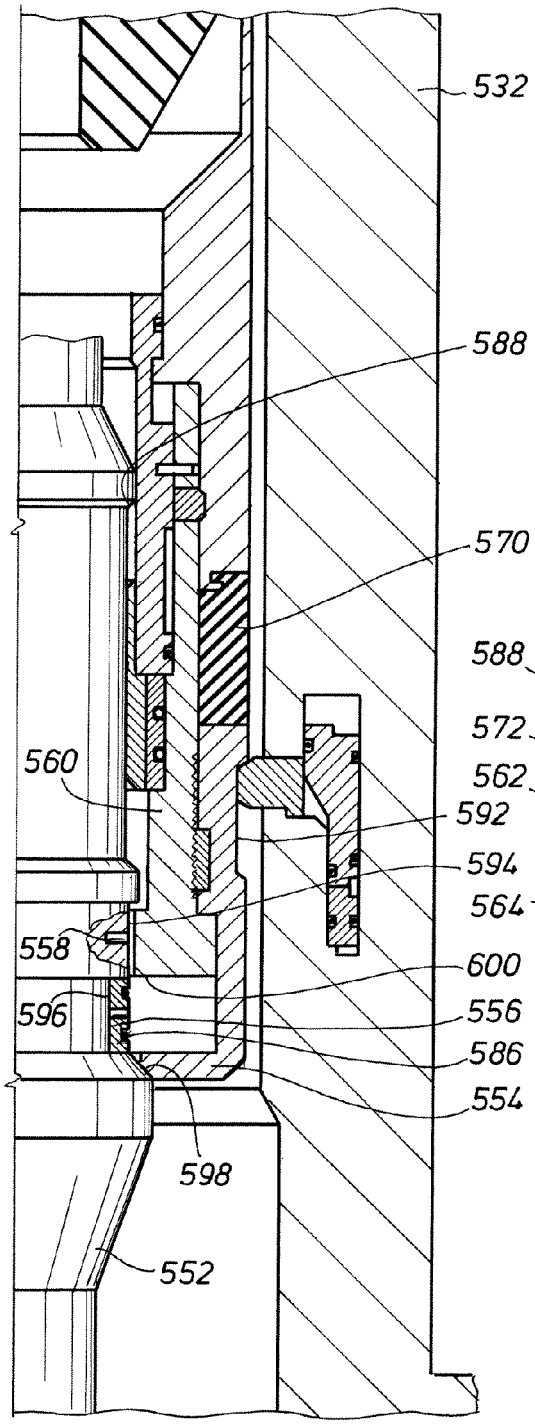
FIG. 10B is a cross-sectional elevational partial broken view of the RCD of FIG. 10A with the RCD running tool moved upward from its position in FIG. 10A, the RCD seal assembly loss motion connection receiving the lower latch member retainer and the lower shear pin sheared to allow the lower garter springed segments to move inwardly in a slot on the running tool.

In FIG. 10B, the running tool 552 has moved upwards, and blocking shoulder 600 of tool member 560 has pushed lower shear pin holding segments 556 downward from running tool surface 594 to running tool slot 596. Garter springs 586 contract segments 556 radially inward. The lower shear pin 558 has been sheared by the movement of segments 556.

To continue setting or extruding seal 570, the running tool 552 is further moved upwards from its position shown in FIG. 10B. The seal 570 final setting position is shown in FIG. 10C, but in FIG. 10C the running tool 552 has already been further moved upwards from its position in FIG. 10B, and then is shown moving downwards in FIG. 10C with the drill string for drilling operations. To set the seal 570 as shown in FIG. 10C, the running tool 552 moves up from its position in FIG. 10B, and running tool shoulder 598 shoulders retainer receiving member 554 upwards until blocked by shoulder 600 of tool member 560. The ratchet or lock ring 562 allows the unidirectional upward movement of retainer receiving member 554 relative to tool member 560. Like the ratchet or lock ring 328 of FIGS. 7A-7C, ratchet or lock ring 562 resists the upward movement of the tool member 560.

Figure 10C:
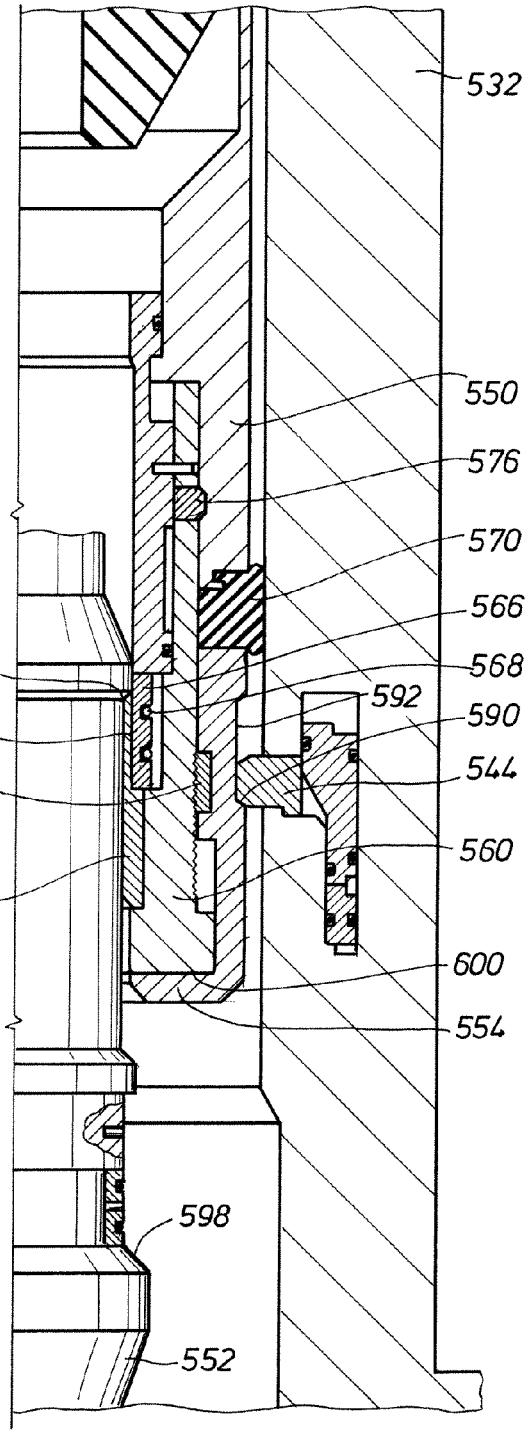
FIG. 10C is a cross-sectional elevational partial broken view of the RCD of FIG. 10B with the RCD running tool moved downward after it had moved further upward from its position in FIG. 10B to move the lower latch member retainer to the lower end of the loss motion connection and the unidirectional ratchet or lock ring maintaining the seal assembly seal in the sealed position and to move the upper garter springed segments from their concentric position to their shouldered position.

Loss motion connection or groove 592 of retainer receiving member 554 allows retainer receiving member 554 to move upward until it is blocked by the third retainer 544 contacting shoulder 590 at one end of groove 592, as shown in FIG. 10C. Retainer receiving member 554 mechanically compresses and extrudes seal 570 against RCD extending member 550, which, as shown in FIG. 10A, is latchingly fixed by first retainer member 536. After the seal 570 is set with the upward movement of the running tool 552 from its position shown in FIG. 10B, inner C-ring 564 and outer segments 566 will still be concentrically disposed as shown in FIG. 10B. Running tool 552 may then be moved downward with the drill string for drilling operations. With this downward movement, running tool shoulder 588 shoulders inner C-ring 564 downwards, and outer segments 566 with their garter springs 568 will move inward into groove 572 in inner C-ring 564 in the position shown in FIG. 10C. The running tool 552 then, as described above, continues moving down out of the housing 530 for drilling operations. Ratchet or lock ring 562 resists retainer receiving member 554 from moving downwards, thereby maintaining seal assembly seal 570 extruded, as shown in FIG. 10C during the drilling operations. As can now be understood, for the embodiment shown in FIGS. 10A-10E, like the embodiment shown in FIGS. 8A-8E, and unlike the embodiments shown in FIGS. 6A-6C, 7A-7C and 9A-9E, the running tool is moved upwards for mechanically setting or extruding the seal assembly seal.

Figure 10D:
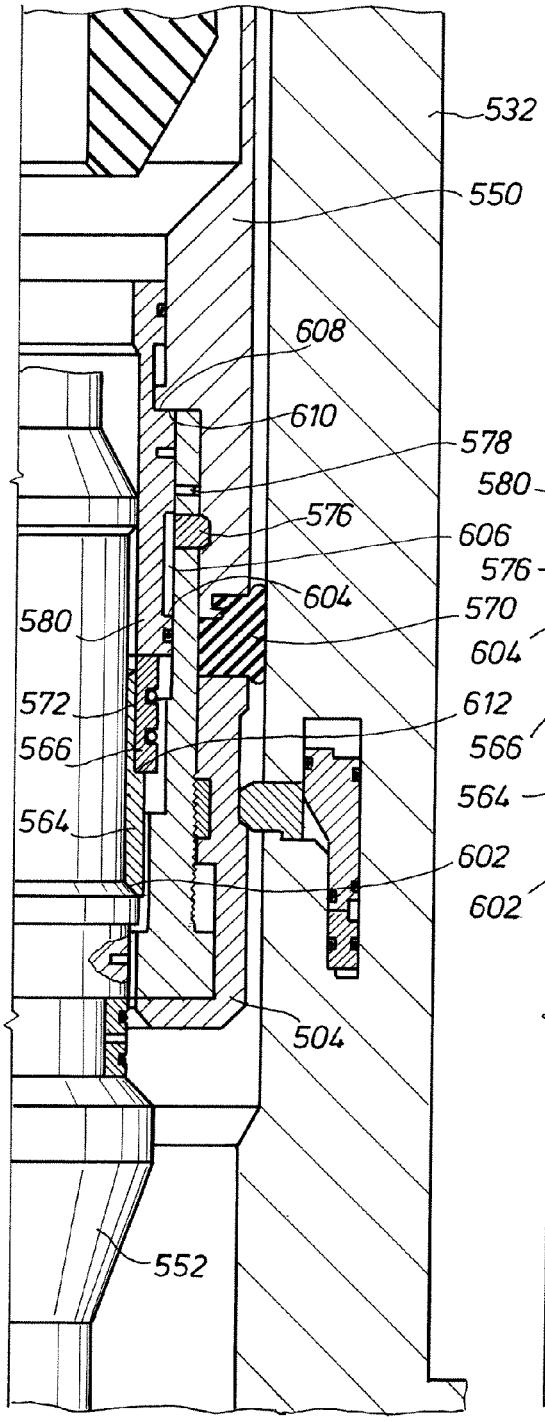
FIG. 10D is a cross-sectional elevational partial broken view of the RCD of FIG. 10C with the RCD running tool moved upward from its position in FIG. 10C after running down hole, so the shouldered garter spring segments shear the upper shear pin while the seal assembly seal is maintained in the sealed position after the two upper latch members are unlatched.

FIG. 10D shows RCD running tool 552 moving upwards into housing 532 returning upon drilling operations for the beginning of the RCD 530 retrieval process. When blocking shoulder 602 of running tool 552 shoulders inner C-ring 564, as shown in FIG. 10D, the first retainer members 536 and second retainer members 540 are preferably in their first or unlatched positions. It is also contemplated that the retainer members 536, 540 may be unlatched after the running tool 552 is in the position shown in FIG. 10D but before the position shown in FIG. 10E. Shoulder 612 of inner C-ring groove 572 shoulders outer segments 566 upward. Outer segments 566, in turn, shoulders RCD tool member 580 upwards. RCD tool member 580, in turn, moves upward until its upwardly facing blocking shoulder 608 is blocked by downwardly facing shoulder 610 of RCD extending member 550. The upward movement of RCD tool member 580, as shown in FIG. 10D, allows the retraction of seal assembly dog 576 into slot 606.

Figure 10E:
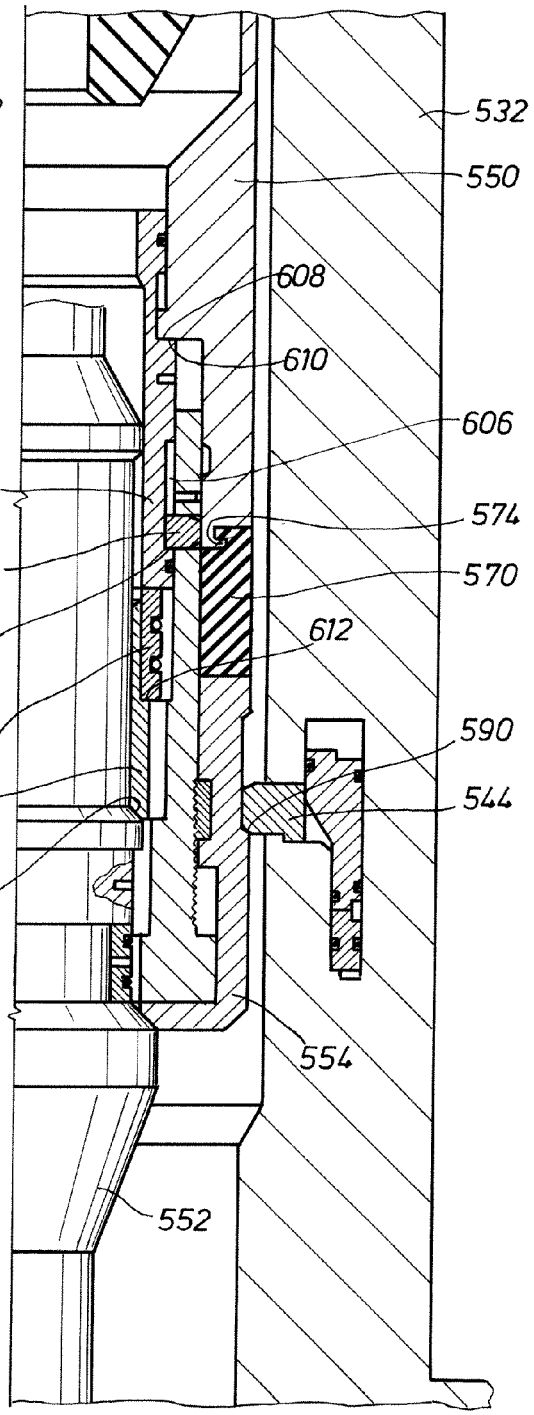
FIG. 10E is a cross-sectional elevational partial broken view of the RCD of FIG. 10D with the RCD running tool moved further upward from its position in FIG. 10D so the seal assembly dog can move to its unlatched position to allow the seal assembly seal to move to the unsealed position after the two upper latch members are unlatched.

Turning now to FIG. 10E, running tool 552 moves further upward from its position in FIG. 10D continuing to shoulder inner C-ring 564 upward with running tool shoulder 602. Outer segments 566 continue to shoulder RCD tool member 580 so seal assembly dog 576 moves along slot 606 until contacting shoulder 604 at the end of the RCD tool member slot 606. Dog 576 may be a C-ring or other similar device with a radially inward bias. Blocking shoulder 608 of RCD tool member 580 shoulders blocking shoulder 610 of RCD extending member 550 upwards. RCD 530 having RCD extending member 550 moves upward since first retainer members 536 and second retainer members 540 are unlatched. Lip formation 574 of extending member 550 pulls and stretches seal 570 upward. Seal 570 may also be bonded with extending member 550. Retainer receiving member 554 shouldered at shoulder 590 is blocked by third retainer 544 in the latched position. It is contemplated that retainer receiving member 554 may also have a lip formation similar to formation 574 on extending member 550 and be bonded for further restraining both ends of seal 570. After seal 570 is unset or released, third retainer member 544 may be moved to its unlatched position and the running tool 552 moved upward to the surface with the RCD 530.

For all embodiments in all of the Figures, it is contemplated that the riser spool or housing with RCD disposed therein may be positioned with or adjacent the top of the riser, in any intermediate location along the length of the riser, or on or adjacent the ocean floor, such as over a conductor casing similar to shown in the '774 patent or over a BOP stack similar to shown in FIG. 4 of the '171 patent.

Figure 11:
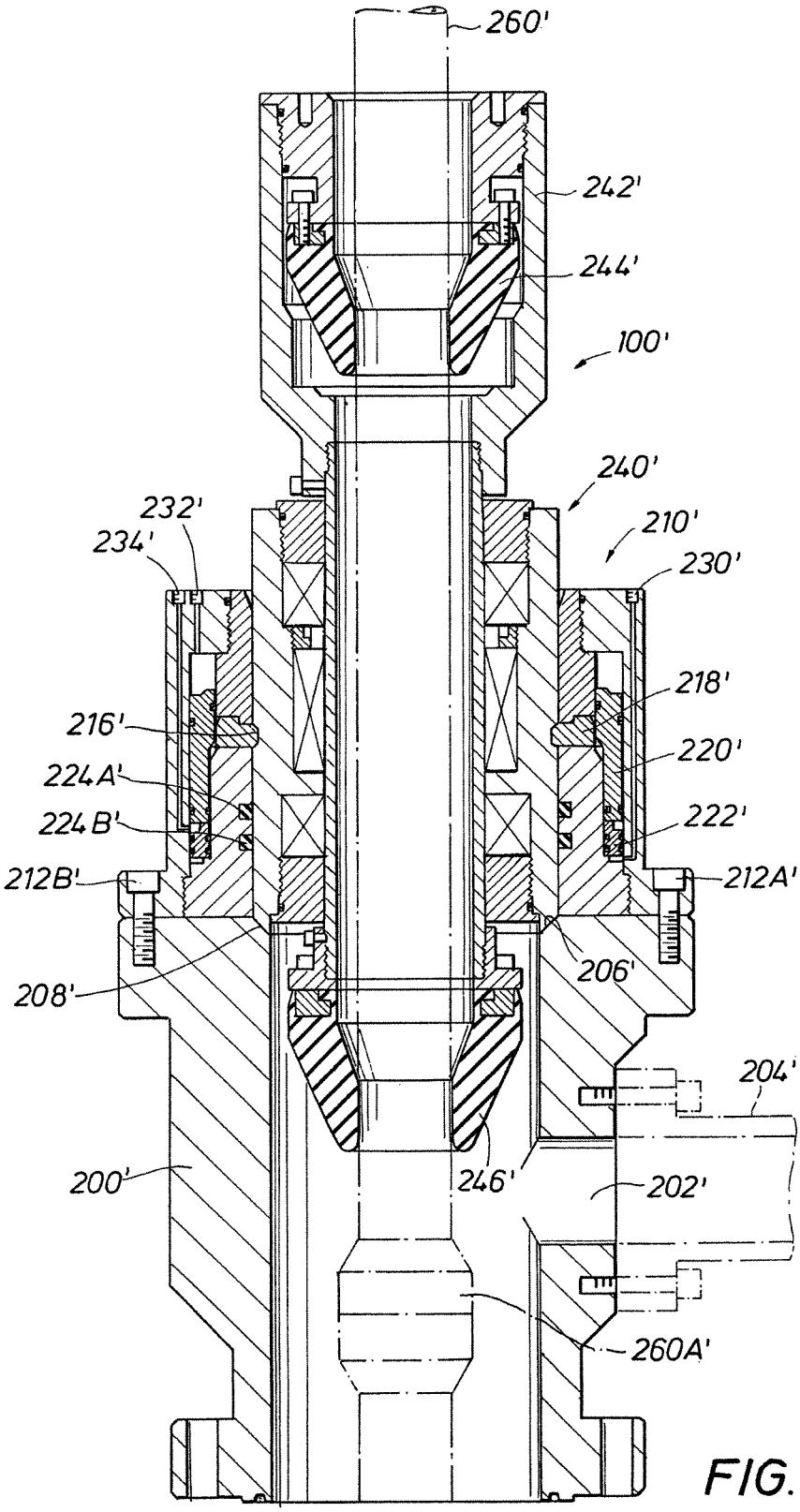
FIG. 11 is a cross-sectional elevational view of an RCD disposed with a single hydraulic latch assembly.

In FIG. 11, RCD 100' is disposed in a single hydraulic latch assembly 240'. FIG. 11 is a cross-section view of an embodiment of a single diverter housing section, riser section, or other applicable wellbore tubular section (hereinafter a "housing section"), and a single hydraulic latch assembly to better illustrate the rotating control device 100'. As shown in FIG. 11, a latch assembly separately indicated at 210' is bolted to a housing section 200' with bolts 212A' and 212B'. Although only two bolts 212A' and 212B' are shown in FIG. 11, any number of bolts and any desired arrangement of bolt positions can be used to provide the desired securement and sealing of the latch assembly 210' to the housing section 200'. As shown in FIG. 11, the housing section 200' has a single outlet 202' for connection to a diverter conduit 204', shown in phantom view: however, other numbers of outlets and conduits can be used with diverter conduits 115' and 117'. Again, this conduit 204' can be connected to a choke. The size, shape, and configuration of the housing section 200' and latch assembly 210' are exemplary and illustrative only, and other sizes, shapes, and configurations can be used to allow connection of the latch assembly 210' to a riser. In addition, although the hydraulic latch assembly is shown connected to a nipple, the latch assembly can be connected to any conveniently configured section of a wellbore tubular or riser.

A landing formation 206' of the housing section 200' engages a shoulder 208' of the rotating control device 100', limiting downhole movement of the rotating control device 100' when positioning the rotating control device 100'. The relative position of the rotating control device 100' and housing section 200' and latching assembly 210' are exemplary and illustrative only, and other relative positions can be used.

FIG. 11 shows the latch assembly 210' latched to the rotating control device 100'. A retainer member 218' extends radially inwardly from the latch assembly 210', engaging a latching formation 216' in the rotating control device 100', latching the rotating control device 100' with the latch assembly 210' and therefore with the housing section 200' bolted with the latch assembly 210'. In some embodiments, the retainer member 218' can be "C-shaped", that can be compressed to a smaller diameter for engagement with the latching formation 216'. However, other types and shapes of retainer rings are contemplated. In other embodiments, the retainer member 218' can be a plurality of dog, key, pin, or slip members, spaced apart and positioned around the latch assembly 210'. In embodiments where the retainer member 218' is a plurality of dog or key members, the dog or key members can optionally be spring-biased. Although a single retainer member 218' is described herein, a plurality of retainer members 218' can be used. The retainer member 218' has a cross section sufficient to engage the latching formation 216' positively and sufficiently to limit axial movement of the rotating control device 100' and still engage with the latch assembly 210'. An annular piston 220' is shown in a first position in FIG. 11, in which the piston 220' blocks the retainer member 218' in the radially inward position for latching with the rotating control device 100'. Movement of the piston 220' from a second position to the first position compresses or moves the retainer member 218' radially inwardly to the engaged or latched position shown in FIG. 11. Although shown in FIG. 11 as an annular piston 220', the piston 220' can be implemented, for example, as a plurality of separate pistons disposed about the latch assembly 210'.

When the piston 220' moves to a second position, the retainer member 218' can expand or move radially outwardly to disengage from and unlatch the rotating control device 100 from the latch assembly 210'. The retainer member 218' and latching formation 216' can be formed such that a predetermined upward force on the rotating control device 100' will urge the retainer member radially outwardly to unlatch the rotating control device 100'. A second or auxiliary piston 222' can be used to urge the first piston 220' into the second position to unlatch the rotating control device 100', providing a backup unlatching capability. The shape and configuration of pistons 220' and 222' are exemplary and illustrative only, and other shapes and configurations can be used.

Hydraulic ports 232' and 234' and corresponding gun-drilled passageways allow hydraulic actuation of the piston 220'. Increasing the relative pressure on port 232' causes the piston 220' to move to the first position, latching the rotating control device 100' to the latch assembly 210' with the retainer member 218'. Increasing the relative pressure on port 234' causes the piston 220' to move to the second position, allowing the rotating control device 100' to unlatch by allowing the retainer member 218' to expand or move and disengage from the rotating control device 100'. Connecting hydraulic lines (not shown in the figure for clarity) to ports 232' and 234' allows remote actuation of the piston 220'.

The second or auxiliary annular piston 222' is also shown as hydraulically actuated using hydraulic port 230' and its corresponding gun-drilled passageway. Increasing the relative pressure on port 230' causes the piston 222' to push or urge the piston 220' into the second or unlatched position, should direct pressure via port 234' fail to move piston 220' for any reason.

The hydraulic ports 230', 232' and 234' and their corresponding passageways shown in FIG. 11 are exemplary and illustrative only, and other numbers and arrangements of hydraulic ports and passageways can be used. In addition, other techniques for remote actuation of pistons 220' and 222', other than hydraulic actuation, are contemplated for remote control of the latch assembly 210'.

Thus, the rotating control device illustrated in FIG. 11 can be positioned, latched, unlatched, and removed from the housing section 200' and latch assembly 210' without sending personnel below the rotary table into the moon pool to manually connect and disconnect the rotating control device 100'.

An assortment of seals is used between the various elements described herein, such as wiper seals and O-rings, known to those of ordinary skill in the art. For example, each piston 220' preferably has an inner and outer seal to allow fluid pressure to build up and force the piston in the direction of the force. Likewise, seals can be used to seal the joints and retain the fluid from leaking between various components. In general, these seals will not be further discussed herein.

For example, seals 224A' and 224B' seal the rotating control device 100' to the latch assembly 210'. Although two seals 224A' and 224B' are shown in FIG. 11, any number and arrangement of seals can be used. In one embodiment, seals 224A' and 224W are Parker Polypak® ¼-inch cross section seals from Parker Hannifin Corporation. Other seal types can be used to provide the desired sealing.

Figure 12:
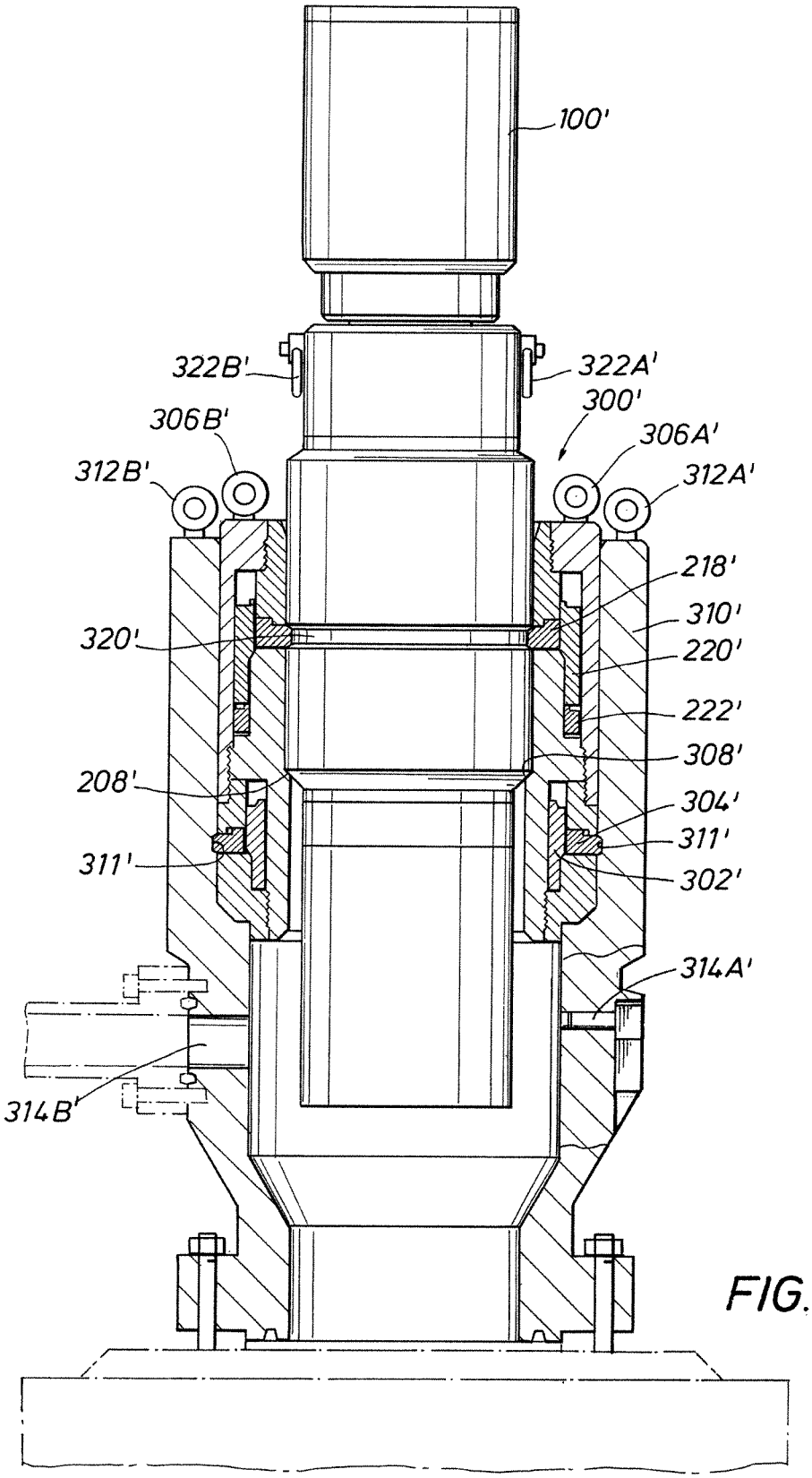
FIG. 12 is a cross-sectional elevational view of an RCD disposed with a dual hydraulic latch assembly.

In FIG. 12, RCD 100' is disposed in a dual hydraulic latch assembly 300'. FIG. 12 illustrates another embodiment of a latch assembly, generally indicated at 300', that is a dual hydraulic latch assembly. As with the single latch assembly 210' embodiment illustrated in FIG. 11, piston 220' compresses or moves retainer member 218' radially inwardly to latch the rotating control device 100' to the latch assembly 300'. The retainer member 218' latches the rotating control device 100' in a latching formation, shown as an annular groove 320', in an outer housing of the rotating control device 100' in FIG. 12. The use and shape of annular groove 320' is exemplary and illustrative only and other latching formations and formation shapes can be used. The dual hydraulic latch assembly includes the pistons 220' and 222' and retainer member 218' of the single latch assembly embodiment of FIG. 11 as a first latch subassembly. The various embodiments of the dual hydraulic latch assembly discussed below as they relate to the first latch subassembly can be equally applied to the single hydraulic latch assembly of FIG. 11.

In addition to the first latch subassembly comprising the pistons 220' and 222' and the retainer member 218', the dual hydraulic latch assembly 300' embodiment illustrated in FIG. 12 provides a second latch subassembly comprising a third piston 302' and a second retainer member 304'. In this embodiment, the latch assembly 300' is itself latchable to a housing section 310', shown as a riser nipple, allowing remote positioning and removal of the latch assembly 300'. In such an embodiment, the housing section 310' and dual hydraulic latch assembly 300' are preferably matched with each other, with different configurations of the dual hydraulic latch assembly implemented to fit with different configurations of the housing section 310'. A common embodiment of the rotating control device 100' can be used with multiple dual hydraulic latch assembly embodiments; alternately, different embodiments of the rotating control device 100' can be used with each embodiment of the dual hydraulic latch assembly 300' and housing section 310'.

As with the first latch subassembly, the piston 302' moves to a first or latching position. However, the retainer member 304' instead expands radially outwardly, as compared to inwardly, from the latch assembly 300' into a latching formation 311' in the housing section 310'. Shown in FIG. 12 as an annular groove 311', the latching formation 311' can be any suitable passive formation for engaging with the retainer member 304'. As with pistons 220' and 222', the shape and configuration of piston 302' is exemplary and illustrative only and other shapes and configurations of piston 302' can be used. In some embodiments, the retainer member 304' can be "C-shaped" that can be expanded to a larger diameter for engagement with the latching formation 311'. However, other types and shapes of retainer rings are contemplated. In other embodiments, the retainer member 304' can be a plurality of dog, key, pin, or slip members, positioned around the latch assembly 300'. In embodiments where the retainer member 304' is a plurality of dog or key members, the dog or key members can optionally be spring-biased. Although a single retainer member 304' is described herein, a plurality of retainer members 304' can be used. The retainer member 304' has a cross section sufficient to engage positively the latching formation 311' to limit axial movement of the latch assembly 300' and still engage with the latch assembly 300'.

Shoulder 208' of the rotating control device 100' in this embodiment lands on a landing formation 308' of the latch assembly 300', limiting downward or downhole movement of the rotating control device 100' in the latch assembly 300'. As stated above, the latch assembly 300' can be manufactured for use with a specific housing section, such as housing section 310', designed to mate with the latch assembly 300'. In contrast, the latch assembly 210' of FIG. 11 can be manufactured to standard sizes and for use with various generic housing sections 200', which need no modification for use with the latch assembly 210'.

Cables (not shown) can be connected to eyelets or rings 322A' and 322B' mounted on the rotating control device 100' to allow positioning of the rotating control device 100' before and after installation in a latch assembly. The use of cables and eyelets for positioning and removal of the rotating control device 100' is exemplary and illustrative, and other positioning apparatus and numbers and arrangements of eyelets or other attachment apparatus, such as discussed below, can be used.

Similarly, the latch assembly 300' can be positioned in the housing section 310' using cables (not shown) connected to eyelets 306A' and 306B', mounted on an upper surface of the latch assembly 300'. Although only two such eyelets 306A' and 306B' are shown in FIG. 12, other numbers and placements of eyelets can be used. Additionally, other techniques for mounting cables and other techniques for positioning the unlatched latch assembly 300', such as discussed below, can be used. As desired by the operator of a rig, the latch assembly 300' can be positioned or removed in the housing section 310' with or without the rotating control device 100'. Thus, should the rotating control device 100 fail to unlatch from the latch assembly 300' when desired, for example, the latched rotating control device 100' and latch assembly 300' can be unlatched from the housing section 310' and removed as a unit for repair or replacement. In other embodiments, a shoulder of a running tool, tool joint 260A' of a string 260' of pipe, or any other shoulder on a tubular that could engage lower stripper rubber 246' can be used for positioning the rotating control device 100 instead of the above-discussed eyelets and cables. An exemplary tool joint 260A' of a string of pipe 260' is illustrated in phantom in FIG. 11.

As best shown in FIG. 11, the rotating control device 100 includes a bearing assembly 240'. The bearing assembly 240' is similar to the Weatherford-Williams model 7875 rotating control device, now available from Weatherford International, Inc., of Houston, Tex. Alternatively, Weatherford-Williams models 7000, 7100, IP-1000, 7800, 8000/9000, and 9200 rotating control devices or the Weatherford RPM SYSTEM 3000™, now available from Weatherford International, Inc., could be used. Preferably, a rotating control device 240' with two spaced-apart seals, such as stripper rubbers, is used to provide redundant sealing. The major components of the bearing assembly 240' are described in U.S. Pat. No. 5,662,181, now owned by Weatherford/Lamb, Inc. which is incorporated herein by reference in its entirety for all purposes. Generally, the bearing assembly 240' includes a top rubber pot 242' that is sized to receive a top stripper rubber or inner member seal 244'; however, the top rubber pot 242' and seal 244' can be omitted, if desired. Preferably, a bottom stripper rubber or inner member seal 246' is connected with the top seal 244' by the inner member of the bearing assembly 240'. The outer member of the bearing assembly 240' is rotatably connected with the inner member. In addition, the seals 244' and 246' can be passive stripper rubber seals, as illustrated, or active seals as known by those of ordinary skill in the art.

In the embodiment of a single hydraulic latch assembly 210', such as illustrated in FIG. 11, a lower accumulator may be required because hoses and lines cannot be used to maintain hydraulic fluid pressure in the bearing assembly 100' lower portion. In addition, an accumulator allows the bearings (not shown) to be self-lubricating. An additional accumulator can be provided in the upper portion of the bearing assembly 100' if desired.

Figure 13:
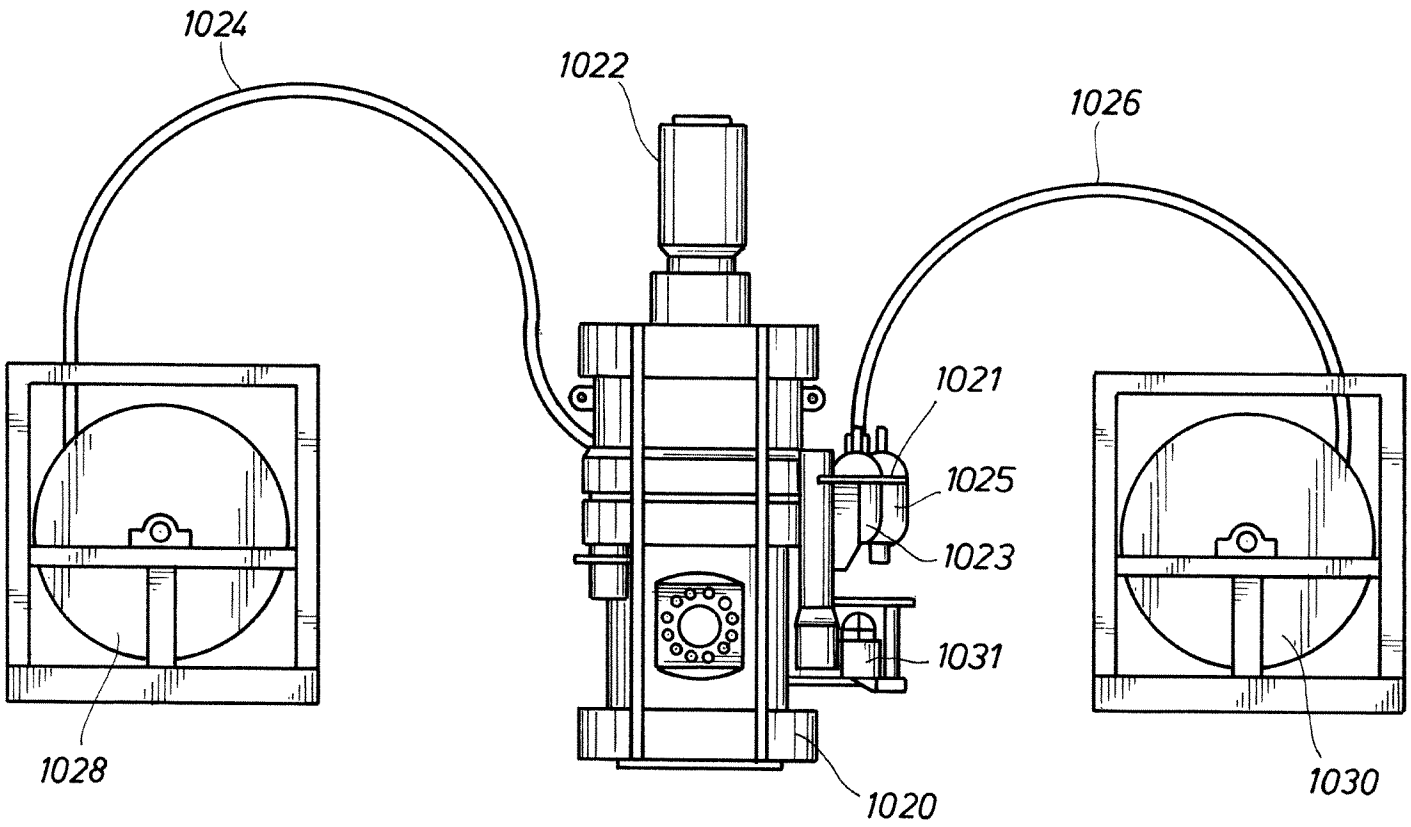
FIG. 13 is an elevational view of an RCD latched with a latching assembly (not shown) in a housing with a first umbilical line on the left side extending from a first umbilical line reel and connected with the housing, and a second umbilical line on the right side extending from a second umbilical line reel and attached with a valve pack (not shown) connected to accumulators, with a signal device in a stowed position below the accumulators.
Figure 21:
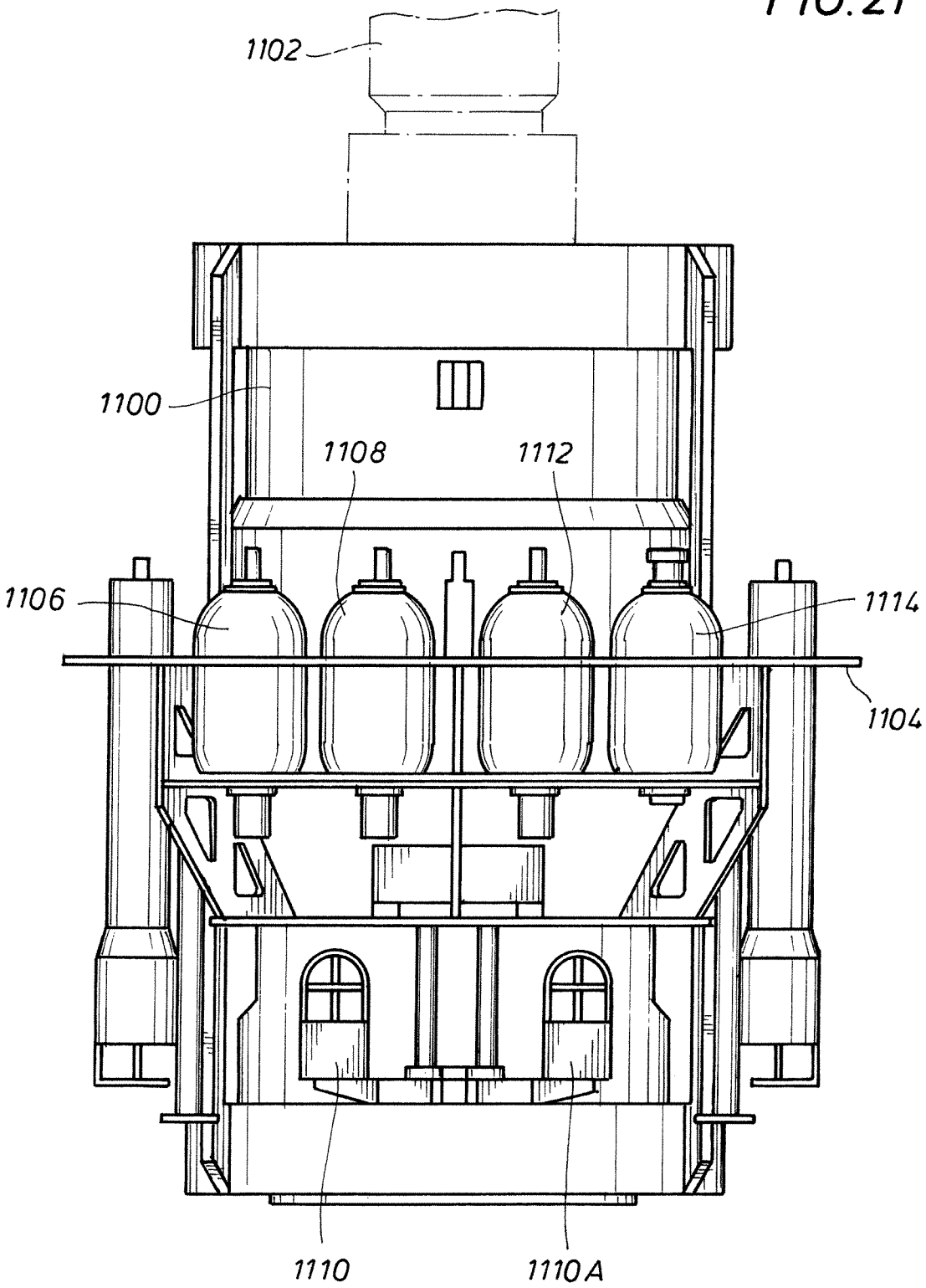
FIG. 21 is the same as FIG. 19 except with the housing rotated 90 degrees about a vertical axis to show three operating accumulators and one receiving accumulator or compensator.

Turning to FIG. 13, RCD 1022 is latched with housing 1020. While in operation, housing 1020 would be disposed subsea with a marine riser or directly with the wellhead or BOP stack if there were no riser. Housing 1020 has an internal latching assembly for latching, the RCD 1022 or other oilfield device. First electro-hydraulic umbilical line 1024 is connected at one end with housing 1020 and may provide for the primary control for the latching assembly in housing 1020. Second electro-hydraulic umbilical line 1026 is connected at one end with a valve pack (not shown) and may also provide control for the latching assembly in housing 1020. Accumulators (1023, 1025) are removably attached to housing 1020 with accumulator clamp ring 1021. There may be four accumulators, such as shown in FIG. 21. Other numbers of accumulators are also contemplated. Returning to FIG. 13, signal device 1031 is in a stowed position below accumulators (1023, 1025). The valve pack may switch between the fluid flowing through second electro-hydraulic umbilical line 1026 and the fluid flowing from accumulators (1023, 1025), as will be discussed in detail below. Umbilical reels (1028, 1030) store respective umbilical lines (1024, 1026). Although an RCD 1022 is shown, it is contemplated that any oilfield device may be latched with the housing 1020, including, but not limited to, protective sleeves, bearing assemblies with no stripper rubbers, stripper rubbers, wireline devices, and any other oilfield devices for use with a wellbore.

Figure 14:
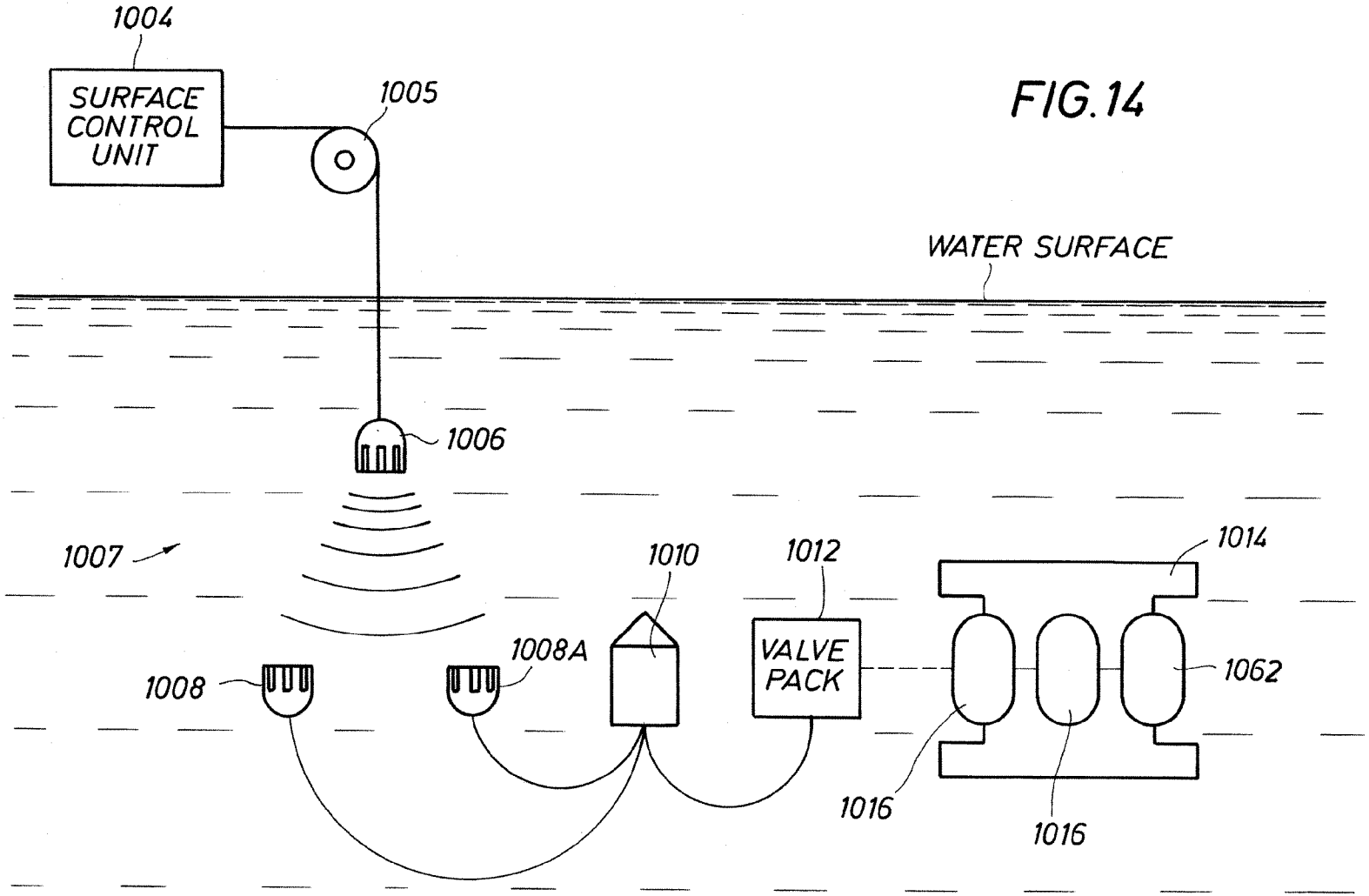
FIG. 14 is a schematic view of an acoustic control system including a surface control unit, a subsea control unit, a first acoustic signal device supported below sea level from a reel, and second and third acoustic signal devices shown in exploded view disposed with a valve pack and a plurality of subsea accumulators positioned with a subsea housing having an internal latching assembly.

In FIG. 14, acoustic control system 1007 may include surface control unit 1004, subsea control unit 1010, first acoustic signal device 1006 and second acoustic signal device 1008. A third acoustic signal device 1008A is also contemplated, as are additional acoustic signal devices. Second and third acoustic signal devices (1008, 1008A), subsea control unit 1010, and valve pack 1012 may be disposed directly with one or more operating accumulators 1016, one or more receiving accumulators or compensators 1062, on housing 1014, but are shown in exploded view in FIG. 14 for clarity. Housing 1014 contains an internal latching assembly to latch with an oilfield device, such as an RCD.

It is contemplated that the subsea components, including second and third acoustic signal devices (1008, 1008A), subsea control unit 1010, valve pack 1012, operating accumulators 1016, and receiving accumulator 1062, may be housed on a frame structure or pod around housing 1014. Second and third acoustic signal devices (1008, 1008A) may be supported on pivoting arms or extensions from the frame structure, although other attachment means are also contemplated. First signal device 1006 may be held below the water surface by reel 1005. First signal device 1006 may transmit acoustic signals as controlled by surface control unit 1004, and second acoustic device 1008 may receive the acoustic signals and transmit them to subsea control unit 1012.

First and second acoustic signal devices (1006, 1008) may be transceivers to provide for two-way communication so that both devices (1006, 1008) may transmit and receive communication signals from each other as controlled by their respective control units (1004, 1010). Devices (1006, 1008) may also be transceivers connected with transducers. Third signal device 1008A may also be a transceiver or a transceiver coupled with a transducer.

Acoustic control systems may be available from Kongsberg Maritime AS of Horten, Norway; Sonardyne Inc. of Houston, Tex.; Nautronix of Aberdeen, Scotland; and/or Oceaneering International Inc. of Houston, Tex., among others. An acoustic actuator may be used in the acoustic control system, such as is available from ORE Offshore of West Wareham, Mass., among others. It is contemplated that acoustic control system 1007 may operate in depths of up to 200 feet (61 m). It is also contemplated that acoustic signal devices (1006, 1008, 1008A) may be sonde devices. Other acoustic transmitting and receiving means as are known in the art are also contemplated. It is also contemplated that alternative optical and/or electromagnetic transmission techniques may be used.

Acoustic control system 1007 allows communication through acoustic signaling between the control unit 1004 above the surface of the water and the subsea control unit 1010. Subsea control unit 1010 may be in electrical communication or connection with valve pack 1012, which may be operable to activate one or more operating accumulators 1016 and release their stored hydraulic fluid. Operating accumulators 1016 may be pre-charged to 44 Barg, although other pressures are also contemplated. Unlike operating accumulators 1016, one or more receiving accumulators or compensators 1062 may not store pressurized hydraulic fluid for operation of the latching assembly in RCD housing 1014, but rather may receive hydraulic fluid exiting the latching assembly.

Valve pack 1012 may also be used to switch from a primary umbilical line system, such as second umbilical line 1026 in FIG. 13, to the secondary acoustic control system. It is also contemplated that the acoustic control system may be the primary system. Operating accumulators 1016 may be remotely or manually charged and/or purged, including by an ROV or diver. Although two operating accumulators 1016 are shown, it is contemplated that there may be only one operating accumulator 1016, or more than two operating accumulators 1016.

Operating accumulators 1016 and receiving accumulator 1064 are disposed with housing 1014, which may be positioned with a marine riser or otherwise with the subsea wellbore, such as with a subsea housing. An RCD or other oilfield device (not shown in FIG. 14) may be latched with the internal latching assembly in housing 1014. The housing 1014 latching assembly (not shown) may be similar to those latching assemblies shown in FIGS. 1 to 12. Housing 1014 may be disposed on a marine riser below the tension lines or tension ring. Operating accumulators 1016 may provide storage of energized hydraulic fluid to operate the latching assembly upon signal from the acoustic control system 1007. It is contemplated that bladder type accumulators may be used. Other types of accumulators are also contemplated, such as piston type. Operating accumulators 1016 may be rechargeable in their subsea position.

Using FIG. 1 for illustrative purposes, after the acoustic control system and latching system of FIG. 14 is disposed with the system of FIG. 1, operating accumulators 1016 may discharge their fluid into the latching assembly to move lower secondary piston 1000 and/or upper secondary piston 1002, and urge their respective adjacent primary pistons (14, 18) upward so as to release their respective retaining members (16, 20) and unlatch the RCD 100 from the housing 12 or marine riser 10. It is also contemplated that accumulators may be used to directly move the primary pistons (14, 18). It is also contemplated that the accumulators may be used to expand active seal 22.

Returning to FIG. 14, housing 1014 with latching assembly may have a bottom flange that may be bolted to the marine riser, subsea housing, wellhead and/or BOP stack. The housing 1014 inside profile may contain a hydraulic latch that is fabricated to receive, retain, and release the RCD or other oilfield device with locking retainer members. The housing 1014 may have lifting eyes for convenience in positioning.

Figure 15:
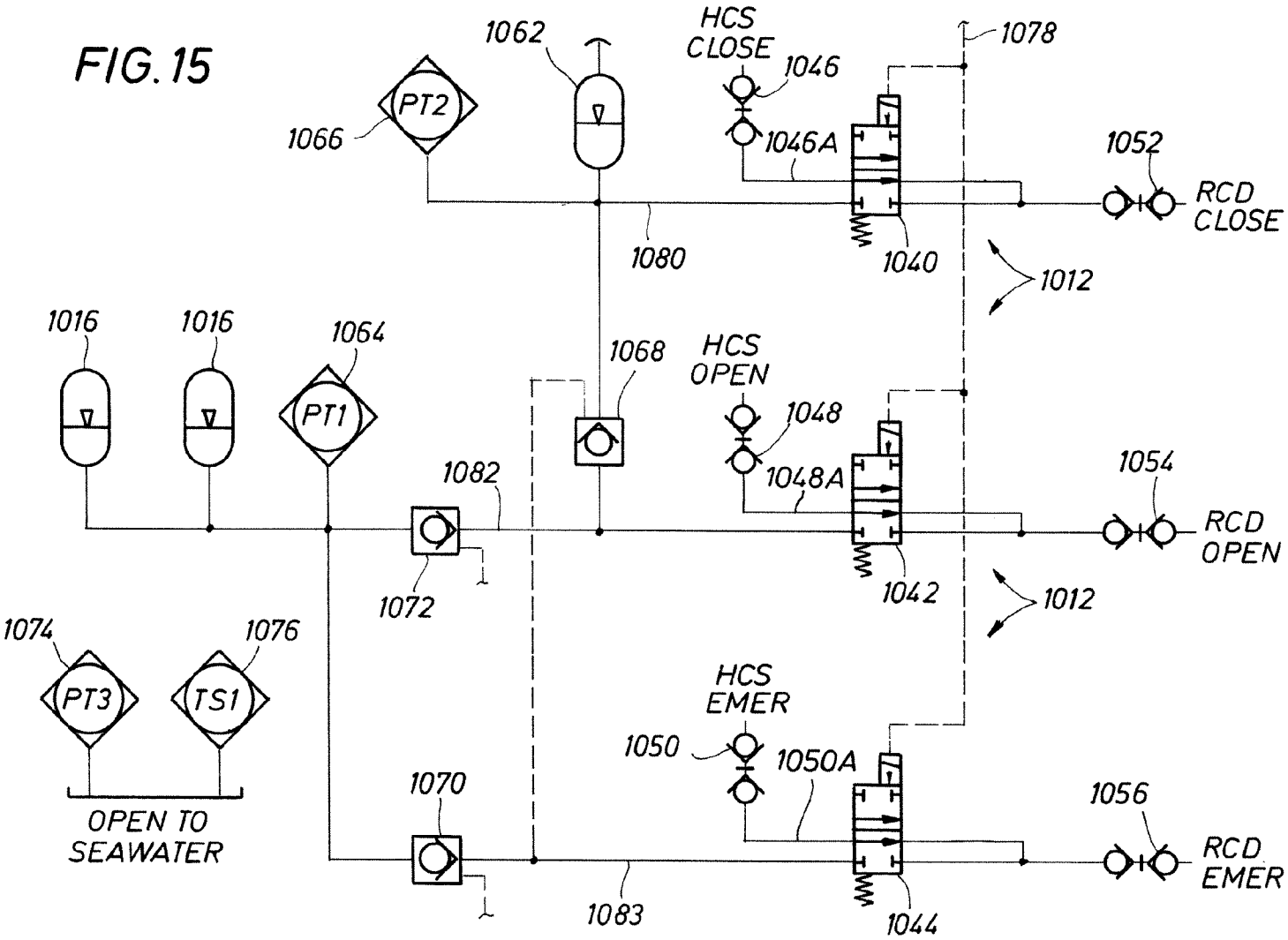
FIG. 15 is a schematic view of the accumulators and valve pack of FIG. 14 disposed with hydraulic lines, check valves, and sensors.

Turning to FIG. 15, an exemplary configuration is shown for a secondary latch operating system and a primary umbilical line system. The secondary system may be operated using the acoustic control system 1007 of FIG. 14. Other embodiments and configurations are also contemplated. Returning to FIG. 15, operating accumulators 1016 are shown in hydraulic fluid communication with valve pack 1012. Operating accumulators 1016 may contain hydraulic fluid under pressure, such as pressurized by Nitrogen gas. Although two operating accumulators 1016 are shown, it is also contemplated that only one operating accumulator 1016 may be used. Operating accumulators 1016 may be periodically charged and/or purged. It is contemplated that a gauge may continuously monitor their pressure(s). The gauge and/or valves on the charge line may be used to charge and/or purge accumulators 1016.

Valve pack 1012 may include first valve 1040, second valve 1042 and third valve 1044, each of which may be a two-position hydraulic valve. Other types of valves are also contemplated. Valves (1040, 1042, 1044) may be controlled by a hydraulic "pilot" line 1078 that is pressurized to move the valve. It is also contemplated that a processor or PLC could control the valves (1040, 1042, 1044) using an electrical line. Remote operation is also contemplated. The valve pack 1012 may contain electric over hydraulic valves, pilot operated control valves, and manual control valves.

The subsea control unit 1010 (as shown in FIG. 14) may primarily direct the operation of the valve pack 1012 through commands sent to it from the surface control unit or console 1004. The subsea control unit 1010 may be attached at the same location as a measurement device or sensor 1064. Other locations for attachment are also contemplated. It is contemplated that measurement devices or sensors (1064, 1066, 1074, 1076) may measure temperature, pressure, flow, and/or other conditions. Sensors (1074, 1076) may be open to seawater. It is contemplated that sensors (1064, 1066) may measure hydraulic pressure and/or seawater pressure, sensor 1076 may measure seawater temperature, and sensor 1074 may measure seawater pressure. It is also contemplated that other temperatures and pressures may be measured, like well pressure.

An electro-hydraulic umbilical line, such as second electro-hydraulic line 1026 shown in FIG. 13, comprising three independent hydraulic lines may extend from the drilling rig or structure to the housing with a latching assembly and/or active seal. A first hydraulic line may be attached with first umbilical input port 1046 connected with first inner umbilical line 1046A, a second hydraulic line may be attached with second umbilical input port 1048 connected with second inner umbilical line 1048A, and a third hydraulic line may be attached with third umbilical input port 1050 connected with third inner umbilical line 1050A. The housing with latching assembly may be attached with first input port 1052, second input port 1054, and third input port 1056. First input port 1052 may be in fluid communication with the cavities or space above the primary piston(s) in the latching assembly, second input port 1054 may be in fluid communication with the cavities or space immediately below the primary piston(s) in the latching assembly, and third input port 1056 may be in fluid communication with the cavities or space below the secondary piston(s) in the latching assembly. Other configurations are also contemplated.

Using FIG. 1 for illustrative purposes, for the primary latching assembly operation, when allowed by first valve 1040, hydraulic fluid from umbilical line may move through first inner umbilical line 1046A through first input port 1052 to the latching assembly for latching or closing the latches by moving the primary pistons (14, 18) downward to the positions shown in FIG. 1. When allowed by second valve 1042, hydraulic fluid from umbilical line may move through second inner umbilical line 1048A through second input port 1054 to the latching assembly for unlatching or opening the latches by moving the primary pistons (14, 18) upward from the positions shown in FIG. 1. When allowed by third valve 1044, hydraulic fluid from umbilical line may move through third input port 1056 to the latching assembly for unlatching or opening the latches by moving the secondary pistons (1000, 1002) upward from the positions shown in FIG. 1. Operation of the secondary pistons (1000, 1002) is generally used for emergency situations when the primary pistons may not be moved.

When the umbilical line is damaged, and the secondary operating system may be required to remove a latched RCD or other oilfield device. A PLC may control valve pack 1012 to close the movement of hydraulic fluid from first, second and third inner umbilical lines (1046A, 1048A, 1050A) and open first accumulator line 1080, second accumulator line 1082, and third accumulator line 1083. As can now be understood, first, second and third valves (1040, 1042, 1044) of the valve pack 1012 may have a first and a second position. The first position may allow operation of the primary system, and the second position may allow operation of the secondary system using the acoustic control system 1007.

Check valves (1068, 1070, 1072) in the hydraulic lines allow flow in the forward direction, and prevent flow in the reverse direction. However, it is contemplated that check valves (1068, 1070, 1072) may be pilot-to-open check valves that do allow flow in the reverse direction when needed by opening the poppet. Other types of check valves are also contemplated. It is also contemplated that there may be no check valve 1072 in second accumulator line 1082.

When allowed by valve pack 1012, operating accumulators 1016 may discharge their stored charged hydraulic fluid through third accumulator line 1083 to move the secondary piston(s), such as secondary pistons (1000, 1002) in FIG. 1. Hydraulic fluid from the latch assembly displaced by the movement of the secondary pistons may move through first accumulator line 1080 and/or check valve 1068 to receiving accumulator or compensator 1062. Other paths are also contemplated. Receiving accumulator 1062, unlike operating accumulators 1016, may not contain pressurized hydraulic fluid. Rather, it may contain seawater, fresh water or other liquid and may be used to receive or catch the hydraulic fluid returns from the latching assembly to prevent their discharge into the environment or sea. It is also contemplated that, if desired, there could be no receiving accumulator 1062.

It is contemplated that the acoustic control system 1007 may be used as a back-up to the primary system, which may be one or more umbilical lines. An electro-hydraulic umbilical reel may be used to store the primary line and supply electric and hydraulic power to the RCD housing. It is also contemplated that there may also be ROV and/or human diver access for system operation. It is contemplated that the system may operate in seawater depths up to 197 feet (60 m). It is contemplated that the system may operate in temperatures ranging from 32° F. (0° C.) to 104° F. (40° C.). It is contemplated that the system opening pressure may be 700 psi (48 bar) or greater when performing an unlatching operation. It is contemplated that the system opening pressure may not exceed 1200 psi (83 bar) when performing an unlatching operation.

It is contemplated that the system flow rate may not be more than 10 gpm (381 pm) or greater when performing an unlatching operation. It is contemplated that the system flow rate may be 0.75 gpm (2.81 bar) or greater to fully unlatch the primary and secondary latches. It is contemplated that system flow volume may be between 0.75 gallons (2.84 liters) and 1.35 gallons (5.11 liters) to unlatch (open) the primary and secondary latches at least once. The operating accumulators 1016 may be rechargeable in their subsea positions. It is contemplated that the system be operable with Weatherford Model 7878 BTR. As alternative embodiments, instead of operating accumulators 1016, or in addition to them, a self contained power source, such as electrical, hydraulic, radio control, or other type, may be used so that when remotely signaled it would release stored energy to cause the primary and secondary unlock circuits of the latching assembly to function.

It is contemplated that fluid returns from the latching assembly when operating with the acoustic control system and latch operating system shown in FIGS. 14 and 15 would not be ejected into the environment, but captured. It is contemplated that a monitoring gauge may be attached with the charge line of the operating accumulators 1016, such as to monitor pressure. The gauge may be used to add or remove hydraulic fluid and to increase or decrease pressure. There may be valves about the accumulator charge line connection and gauge to permit manual charging or purging of the system. The system may be easily attached with the housing.

Figure 16:
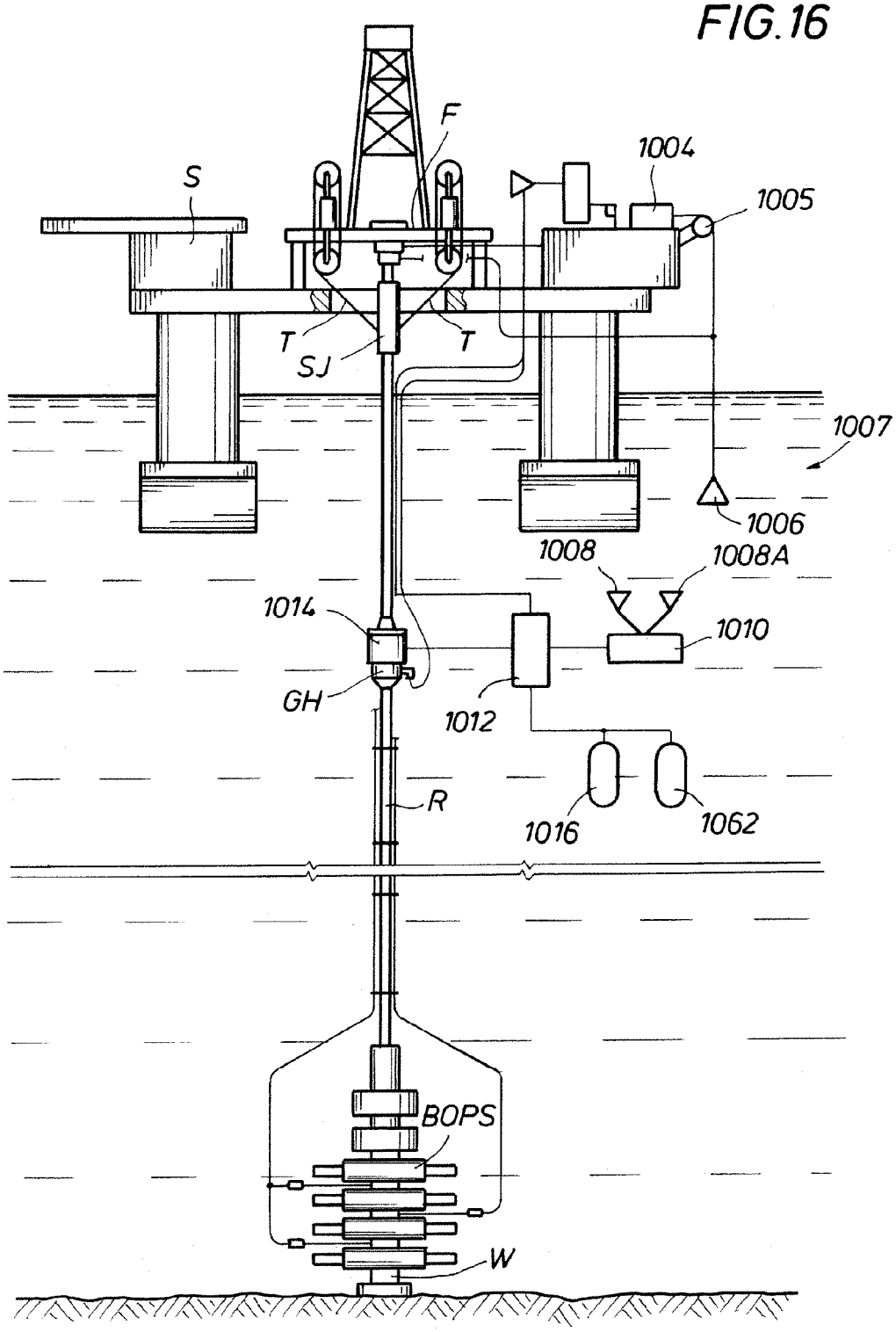
FIG. 16 is a schematic view of the acoustic control system of FIGS. 14 and 15 with the valve pack and accumulators disposed with a semi-submersible floating rig positioned with a marine riser and BOP stack over a wellhead in elevational view.
Figure 17:
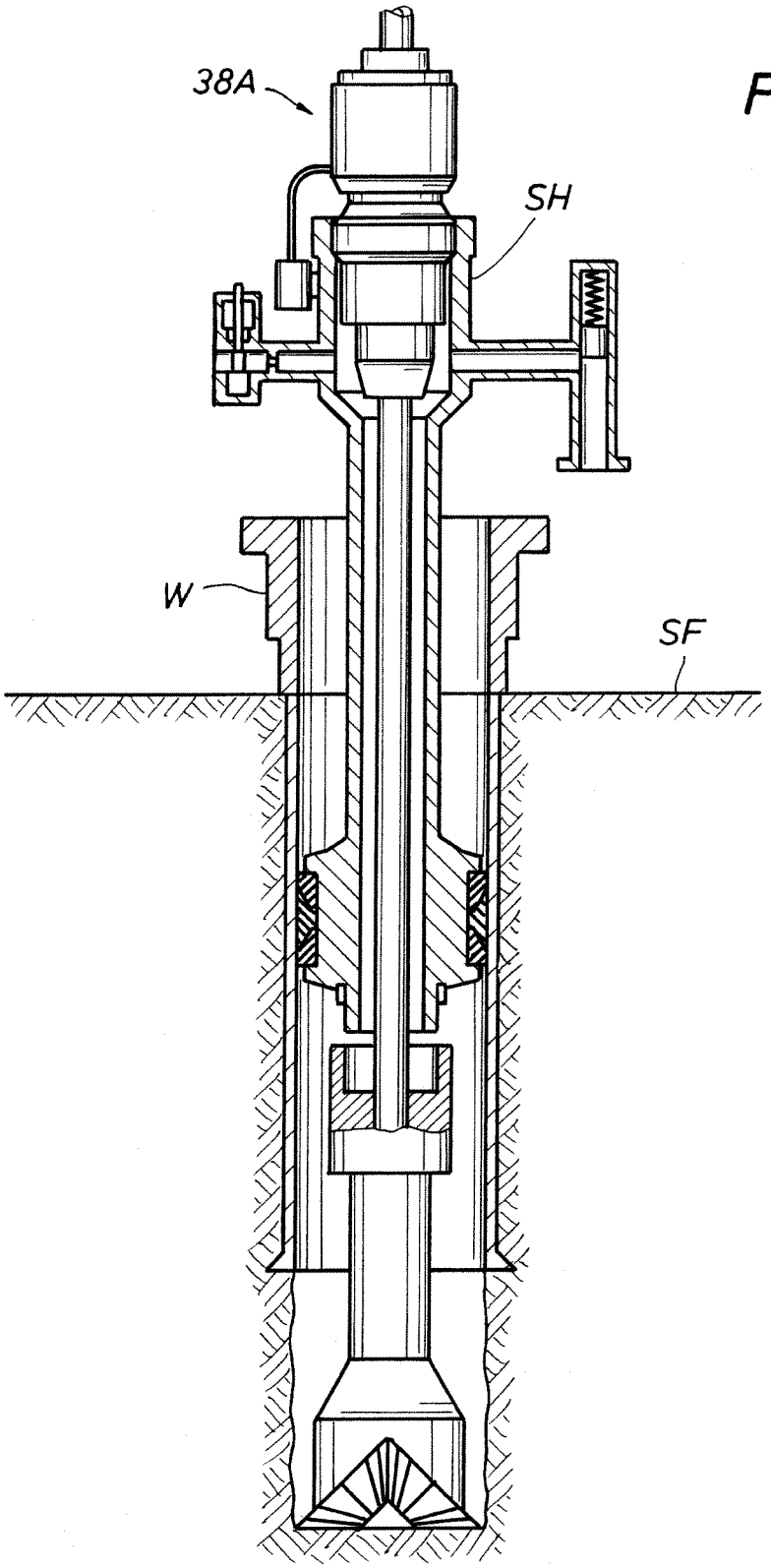
FIG. 17 is a cross-sectional elevational view of an RCD disposed with a subsea housing allowing drilling with no marine riser.
Figure 18:
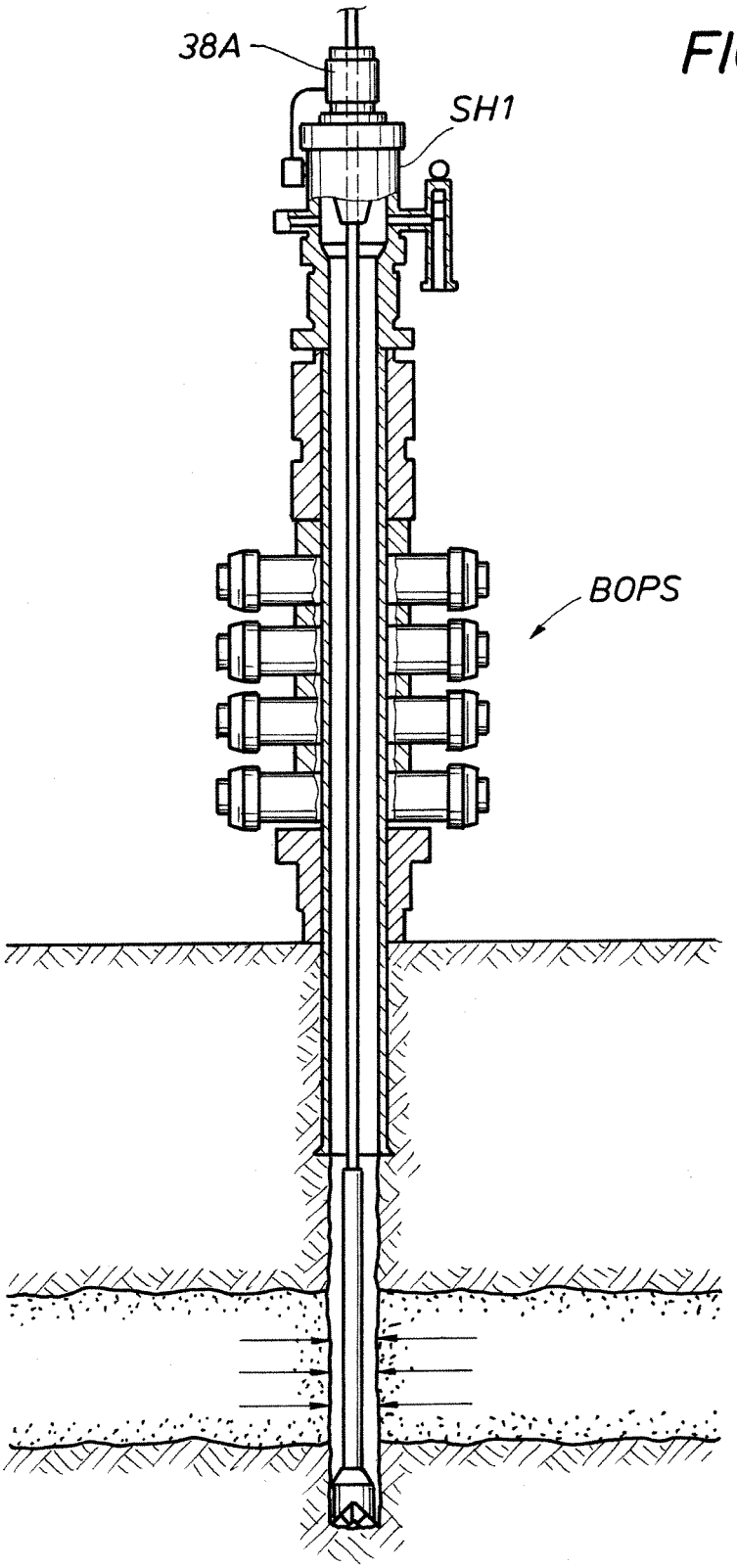
FIG. 18 is a cross-sectional elevational view of an RCD disposed with a subsea housing over a subsea BOP stack allowing drilling with no marine riser.

FIGS. 16 to 18 show some of the environments in which the acoustic control system 1007 and latch operating system of FIGS. 13-15 may be used. Other environments are also contemplated. In FIG. 16, floating drilling rig or structure S is disposed over wellhead W. Subsea BOP stack BOPS is disposed on wellhead W, and marine riser R with gas handler annular BOP GH extends between the BOPS and rig S. Tension lines T are attached with the slip joint SJ near the top of the riser R with a tensioner ring (not shown). A diverter D is below the rig floor F.

Acoustic control system 1007 is positioned with structure S and riser R. An RCD or other oilfield device (not shown) may be latched within housing 1014 positioned with riser R below tension lines T and tension ring adjacent the location of the gas handler annular BOP GH. It is contemplated than a housing 1014 with latched RCD or other oilfield device may be disposed with a frame structure or pod supporting valve pack 1012, accumulators (1016, 1062), subsea control unit 1010, and subsea signal devices (1008, 1008A). Surface equipment including surface control unit 1004, reel 1005, and signal device 1006 may be supported from the rig S.

In FIG. 17, RCD 38A is disposed with a subsea housing SH at the sea floor SF and disposed with the subsea wellhead W. Subsea housing SH and RCD 38A allow for subsea drilling with no marine riser. In FIG. 18, RCD 38A is disposed with a subsea housing SH1 disposed over subsea BOP stack BOPS. Subsea housing SH1 and RCD 38A allow for subsea drilling with no marine riser. The acoustic control system 1007 and latch operating system as shown in FIGS. 13-16 may be disposed with the subsea housings (SH, SH1) of FIGS. 17 and 18 and used for operating a latch assembly for latching and unlatching the RCD 38A and/or for expanding and decreasing an active seal. It is contemplated that the components of the system may be supported on a frame structure or pod.

Figure 19:
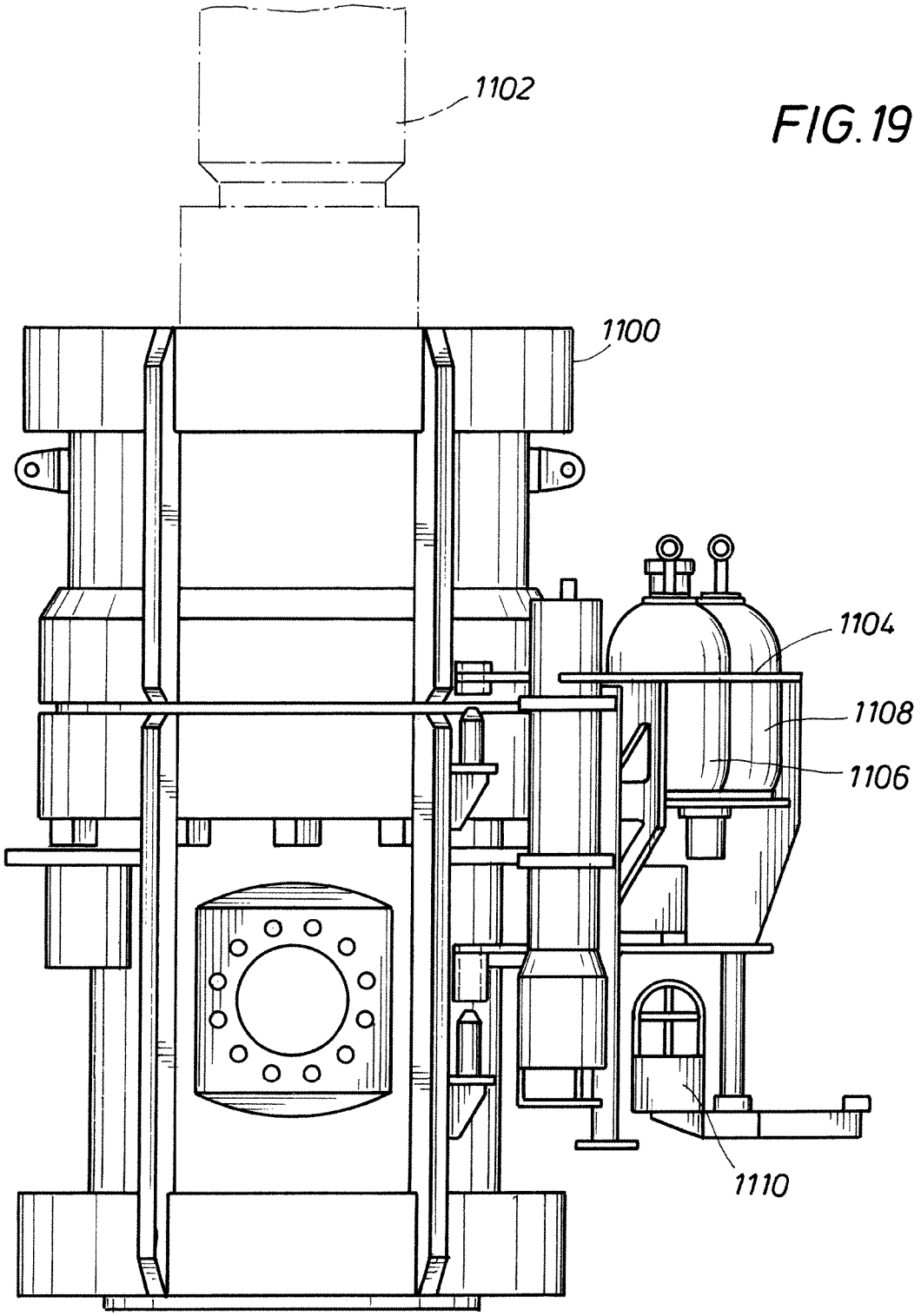
FIG. 19 is an elevational view of an RCD in phantom view latchable with a housing, with accumulators releaseably coupled with the housing with an accumulator clamp ring, and a signal device disposed below the accumulators in a stowed position.
Figure 20:
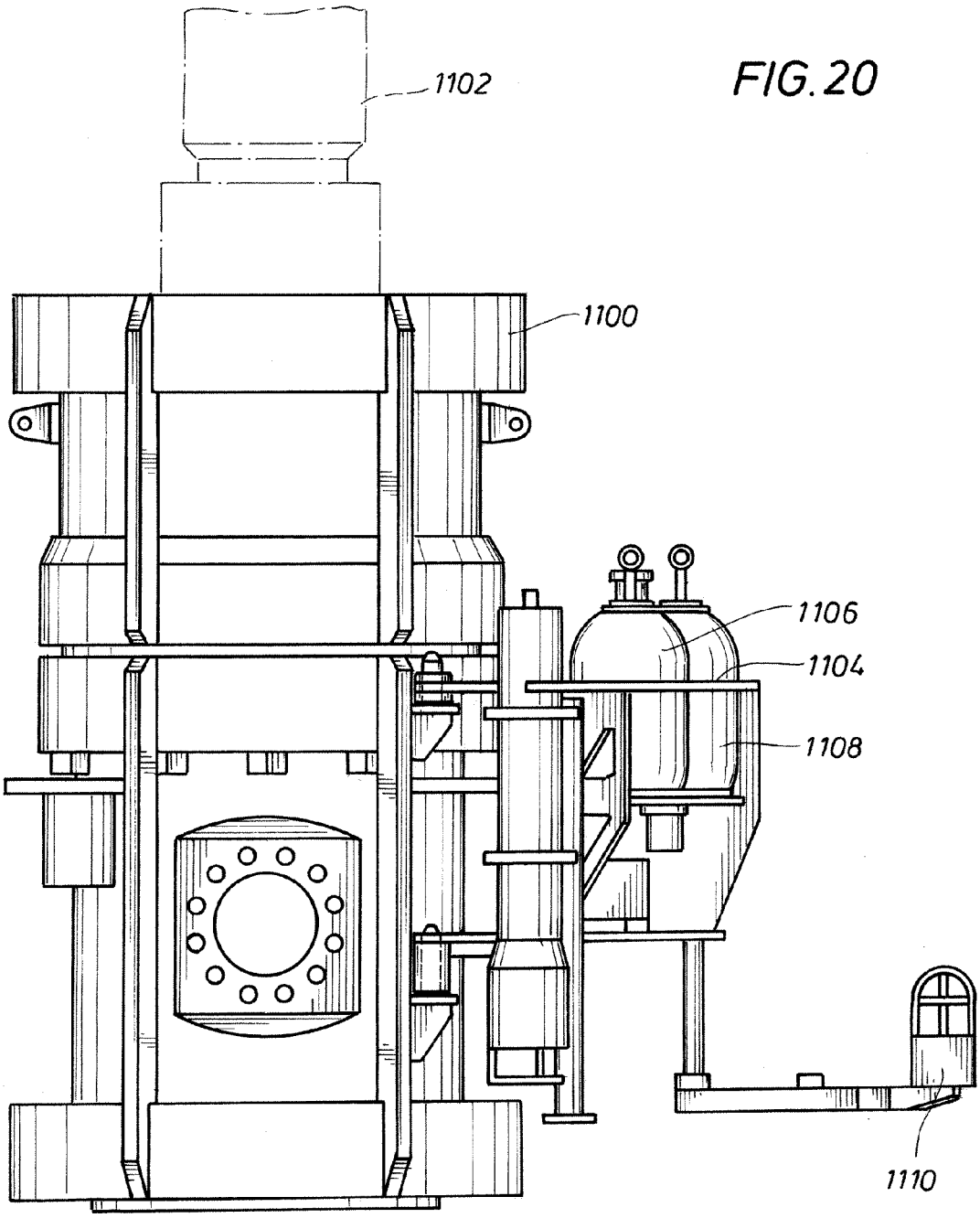
FIG. 20 is the same as FIG. 19 except with the signal device in a deployed position.

Turning to FIG. 19, an RCD 1102 is latched with housing 1100. Although an RCD 1102 is shown, it is contemplated that any oilfield device may be latched with the housing 1100. While in operation, housing 1100 would be disposed subsea with a marine riser or directly with the wellhead or BOP stack if there were no riser. Housing 1100 has an internal latching assembly for latching the RCD 1102 or other oilfield device. Accumulators (1106, 1108) are removably attached to housing 1100 with accumulator clamp ring 1104. There may be four accumulators, such as shown in FIG. 21. As discussed above, other numbers of accumulators are contemplated. Returning to FIG. 19, signal device 1110 is in a stowed position below accumulators (1106, 1108). Accumulators may store a fluid for operation of the internal latching assembly of the housing 1100. In FIG. 20, signal device 1110 has been moved to a deployed position.

Figure 22:
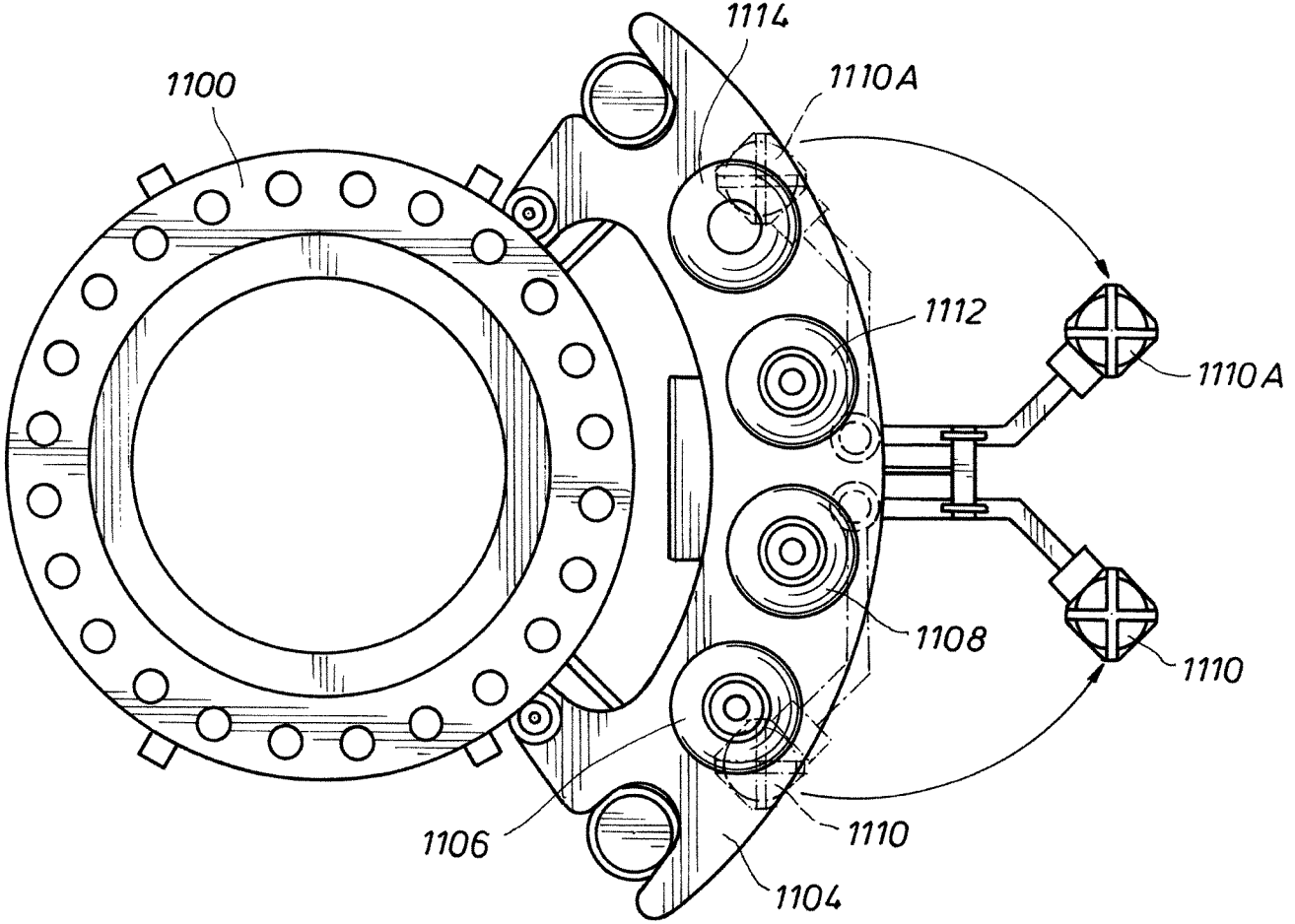
FIG. 22 is a plan view of FIG. 21 with the four accumulators attached with the housing with an accumulator clamp ring, and with the signal device moved from a stowed position, in phantom view, to a deployed position.

In FIG. 21, three operating accumulators (1106, 1108, 1112) are provided for releasing hydraulic fluid to the latching assembly, as discussed above, in housing 1100. A receiving accumulator or compensator 1114 is for receiving hydraulic fluid from the latching assembly in housing 1100. The accumulators (1106, 1108, 1112, 1114) are attached to housing 1100 using accumulator clamp ring 1104. As shown in FIG. 22, the signal device (1110, 1110A) is movable by pivoting from a stowed position (in phantom view) to a deployed position.

Figure 23B:
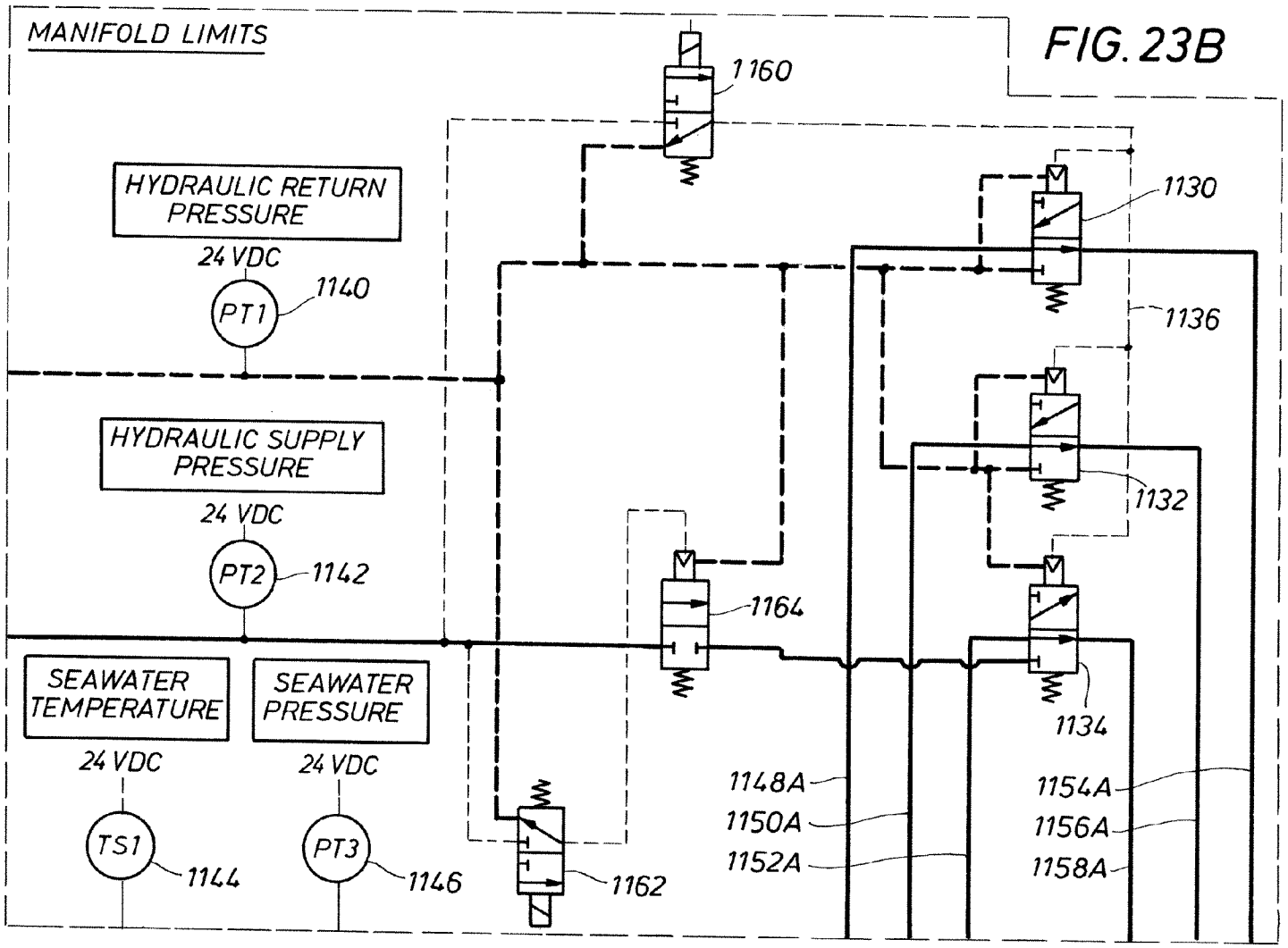
FIG. 23B is a schematic view of the accumulators and valve pack of FIG. 14 disposed with hydraulic lines, check valves, and sensors.

Turning to FIGS. 23A-23B, an exemplary configuration is shown for a secondary latch operating system and a primary umbilical line system. The secondary system may be operated with acoustic control system 1007. Other embodiments and configurations are also contemplated. Operating accumulators (1120, 1122, 1124) are shown in hydraulic fluid communication with manifold or valve pack 1128. Operating accumulators (1120, 1122, 1124) may contain hydraulic fluid under pressure, such as pressurized by Nitrogen gas. Although three operating accumulators are shown in FIGS. 21-23A, it is also contemplated that only one operating accumulator could be used. Operating accumulators may be periodically charged and/or purged. It is contemplated that a gauge may continuously monitor their pressure(s). The gauge and/or valves on the charge line may be used to charge and/or purge accumulators. Accumulator or compensator 1126 may be used to received hydraulic fluid as discussed above.

Manifold or valve pack 1128 may include first valve 1130, second valve 1132 and third valve 1134, each of which may be two-position hydraulic valves. Other types of valves are also contemplated. Valves (1130, 1132, 1134) may be controlled by a hydraulic "pilot" line 1136 that is pressurized to move the respective valve. As best shown in FIG. 23B, the acoustic control system 1007 may use an electric over hydraulic control over valves (1130, 1132, 1134). The valves (1160, 1162, 1164) control the function of both switching from the primary umbilical line system to the secondary latch operating system and performing the emergency unlatch operation by the secondary latch operating system. Valves (1160, 1162) may be electrically controlled by subsea control units (SCU) (1136, 1138) as shown in FIG. 23A. Valve 1164 is pilot-operated by valve 1162.

In particular, activation of valve 1164 will pilot-operate and switch valves (1130, 1132, 1134) from the primary umbilical line system to the secondary latch operating system. This switching allows the emergency unlatching of the latching assembly where valve 1164 is activated by the pilot-operated control valve 1162. Activation of valve 1164 allows pressurized hydraulic fluid from the accumulator(s) (1120, 1122, 1124) to unlatch the RCD or other oilfield device from the housing the secondary latch operating system.

The accumulators (1120, 1122, 1124) may be 10-liter subsea bladder accumulators with a seal subfluid connection, ¼" BSPM gas connection, a C/W lifting eye bolt, SCHRADER valve and cushion ring. Compensator 1126 may be a 10-liter subsea compensator being internally nickel-plated ½" BSP hydraulic fluid connection open seawater connection 207 BARG design pressure and C/W cushion ring. A valve 1166 may be a ⅜" NB subsea manual needle valve C/W ½" OD×0.65" WT 38 mm long tube tail. Coupler 168 may be a ⅜" NB male flange mounted mono coupler universal un-vented C/W 1000 mm tube tail ½"×0.065" WT. Coupler 1170 may be a ⅜" NB female mono coupler universal (un-vented) C/W JIC #8 CHEMRAS seals. Couplings 1172 may be a ¼" NB female stabplate mounted hydraulic coupling universal C/W 17 mm seal-sub back end ¼" UNC holes un-vented. Couplings 1174 may be ¼" NB stabplate mounted male "reduced forge" hydraulic couplings universal #8 JIC un-vented. The valves 1130, 1132 and 1134 may be 2-position, 3-way normally open poppet valve. Valve 1164 may be a 2-position, 2-way normally closed poppet valve. Valves 1160 and 1162 may be 2-position, 3-way normally closed 24 volt DC solenoid valve C/W 3m RAYCHEM Fyling leads. Sensor 1146 may be a ¼" BSP manifold-mounted pressure transducer, 0-1000 BARG. Transducer 1144 could be a ¼" BSP manifold-mounted temperature transducer (seawater temp). Ports 1154, 1156 and 1158 could include a ¼" stabplate coupling male, 569 BARG ½"×0.065" WT×1000 mm tube tail. It is also contemplated that a processor or PLC could control the valves (1130, 1132, 1134) using an electrical line. Remote operation is also contemplated. The valve pack 1128 may contain electric over hydraulic valves, pilot operated control valves, and/or manual control valves.

Subsea control units (1136, 1138) may primarily direct the operation of the valve pack 1128 through commands sent to the subsea control units from a surface control unit or console, such as unit 1004 shown in FIGS. 14 and 16. The subsea control units (1136, 1138) may be attached at the same location as measurement device or sensor 1140. Other locations for attachment are also contemplated. Measurement devices or sensors (1140, 1142, 1144, 1146) may measure temperature, pressure, flow, and/or other conditions. Sensors (1144, 1146) may be open to seawater. It is contemplated that sensors (1140, 1142) may measure hydraulic pressure and/or seawater pressure, sensor 1146 may measure seawater temperature, and sensor 1144 may measure seawater pressure. It is also contemplated that other temperatures and pressures may be measured, like well pressure.

An electro-hydraulic umbilical line, such as second electro-hydraulic line 1026, shown in FIG. 13, containing three independent hydraulic lines may extend from the drilling rig or structure to the housing with a latching assembly or active seal. Referring to both FIGS. 23A and 23B, a first hydraulic line may be attached with first umbilical input port 1148 connected with first inner umbilical line 1148A, a second hydraulic line may be attached with second umbilical input port 1150 connected with second inner umbilical line 1150A, and a third hydraulic line may be attached with third umbilical input port 1152 connected with third inner umbilical line 1152A. The housing with latching assembly may be attached with first input port 1154, second input port 1156, and third input port 1158. First input port 1154 may be in fluid communication with the cavities or space above the primary pistons in the latching assembly, second input port 1156 may be in fluid communication with the cavities or space immediately below the primary pistons in the latching assembly, and third input port 1158 may be in fluid communication with the cavities or space below the secondary pistons in the latching assembly. Other configurations are also contemplated.

As can now be understood, the system may monitor seawater temperature and pressure and stored hydraulic supply and return pressure. The system also provides the ability to remotely control the open and close valves and provides enough stored volume in the accumulators to operate the emergency unlatching in the event of a primary and secondary latch hydraulic failure. The design of the control system may be based on two acoustic subsea control units (SCUs) mounted on the housing that will receive signals from the topside acoustic command unit and operate the directional control valves. The two acoustic subsea control units will also send signals, such as 4-20 mA signals, to the topside acoustic control unit. As best shown in FIG. 23A, two acoustic subsea control units (SCUs) (1136, 1138) may be used but it should be understood that only one SCU may be used to implement the function of the acoustic control system 1007. The design of the system may offer, among other things, (1) a redundant subsea system with two complete sets of electronics with separate replaceable batteries, (2) high availability and reliability based on equipment selection, design principles, (3) low electrical power consumption, and (4) low maintenance.

It is contemplated that the system may operate in seawater up to 197 feet (60 meters) below the surface. The system may operate in a temperature range from 32° F. (0° C.) to 104° F. (40° C.). The system opening pressure may be 700 psi (48 bar) or greater when performing an emergency unlatching (open) operation. The system opening pressure may not exceed 1200 psi (83 bar) when performing an emergency unlatching (open) operation. The system flow rate may not exceed 0.75 gpm (2.81 bar) when performing an emergency unlatching (open) operation. The system flow volume may be between 0.75 gallons (2.84 liters) and 1.35 gallons (5.11 liters) to fully unlatch (open) the primary and the secondary latch pistons.

The foregoing disclosure and description of the invention are illustrative and explanatory thereof, and various changes in the details of the illustrated apparatus and system, and the construction and the method of operation may be made without departing from the spirit of the invention.

The invention claimed is:

1. A system for operating a latching assembly used with an oilfield device, comprising:

the latching assembly disposed in a housing configured to be positioned below a water surface;

a first signal device configured to be disposed below the water surface;

a second signal device coupled with said housing wherein the latching assembly is configured to operate in response to a first signal transmitted wirelessly and remotely from said first signal device through a body of water to said second signal device when said first signal device is spaced apart from and not connected with said housing;

a first accumulator configured to communicate with the latching assembly;

an umbilical line configured to communicate with the latching assembly; and a first valve configured to control fluid communication to the latching assembly from said umbilical line or said first accumulator.

2. The system of claim 1, wherein said first signal is an acoustic signal.

3. The system of claim 1, further comprising:

a first control unit connected with said first signal device; and a second control unit connected with said second signal device and configured to be coupled with said housing, said second signal device configured to receive said first signal from said first signal device to move the latching assembly in response to said first signal.

4. The system of claim 3, further comprising:

said first accumulator configured to contain a hydraulic fluid in fluid communication with the latching assembly and coupled with said housing;

wherein said first accumulator hydraulic fluid communicated to the latching assembly in response to said first signal from said first signal device.

5. The system of claim 1, wherein said housing configured to be disposed with a marine riser.

6. The system of claim 1, wherein said first signal device is a transmitter, and said second signal device is a receiver.

7. The system of claim 6, wherein said first signal device and said second signal device are transceivers.

8. The system of claim 3, wherein said first signal device and said second signal device being operable to transmit and receive signals providing for a two-way wireless communication link between said first control unit and said second control unit.

9. The system of claim 4, further comprising:

a second accumulator coupled with said housing and in fluid communication with the latching assembly to receive hydraulic fluid from the latching assembly.

10. The system of claim 4, further comprising:

said umbilical line configured to communicate a hydraulic fluid to operate the latching assembly; and said first valve in fluid communication with the latching assembly having a first position allowing flow of said umbilical line hydraulic fluid to the latching assembly, and a second position allowing flow of said first accumulator hydraulic fluid to the latching assembly.

11. The system of claim 4, further comprising:

a primary piston in the latching assembly in communication with said first accumulator for communicating said first accumulator hydraulic fluid.

12. The system of claim 11, further comprising:

a secondary piston in the latching assembly in communication with said first accumulator for communicating said first accumulator hydraulic fluid.

13. A method for operating a latching assembly used with an oilfield device latchable with a housing, comprising the steps of:

coupling a second signal device with the housing;

moving said second signal device below a water surface;

moving a first signal device below the water surface without connecting said first signal device with said housing, wherein said first signal device is spaced apart from said housing;

after the moving steps, transmitting a first signal wirelessly and remotely between said first signal device and said second signal device through a body of water;

controlling a valve configured to communicate the latching assembly with a first fluid source or a second fluid source; and moving a piston in the latching assembly in response to said first signal.

14. The method of claim 13, wherein said first signal is an acoustic signal.

15. The method of claim 13, further comprising the step of:

unlatching the oilfield device from the housing after the step of moving the piston.

16. The method of claim 13, further comprising the step of:

latching the oilfield device with the housing after the step of moving the piston.

17. The method of claim 13, wherein said first fluid source is a first accumulator and the step of controlling further comprising the step of:

communicating hydraulic fluid from said first accumulator in response to said first signal, wherein said communicated hydraulic fluid moves said piston in the latching assembly.

18. The method of claim 13, wherein the housing disposed with a marine riser.

19. The method of claim 13, wherein said first signal device and said second signal device are transceivers.

20. The method of claim 13, further comprising a second accumulator and the step of:

communicating hydraulic fluid from the latching assembly to said second accumulator.

21. The method of claim 17, wherein said second fluid source is an umbilical line and the step of controlling further comprising the steps of:

allowing a flow of hydraulic fluid from said umbilical line to the latching assembly;

blocking a flow of hydraulic fluid from said umbilical line to the latching assembly, and allowing flow of hydraulic fluid from said first accumulator to the latching assembly.

22. The method of claim 13, further comprising a secondary piston in the latching assembly.

23. The method of claim 13, further comprising the step of:

before the step of transmitting, pivoting said second signal device from a stowed position coupled with said housing to a deployed position coupled with said housing.

24. A system for operating a latching assembly used with an oilfield device, comprising:

a housing;

a valve coupled with said housing and in fluid communication with the latching assembly;

an umbilical line configured to communicate a fluid and in fluid communication with said valve; and a first accumulator configured to contain a fluid and in fluid communication with said valve, wherein said valve is configured to be moveable between a first position to allow a flow of said umbilical line fluid to operate the latching assembly and a second position to allow a flow of said first accumulator fluid to operate the latching assembly.

25. The system of claim 24, further comprising:

a first signal device configured for transmitting a signal; and a second signal device coupled with said housing configured for receiving said signal from said first signal device, when said first signal device is spaced apart from and not connected with said housing;

wherein said first accumulator configured to allow a flow of said first accumulator hydraulic fluid to the latching assembly in response to a first signal transmitted over a wireless communication link from said first signal device to said second signal device.

26. The system of claim 25, wherein said first signal device is configured to transmit to and receive signals from said second signal device in a body of water, and said second signal device is configured to transmit to and receive signals from said first signal device in a body of water.

27. The system of claim 25, wherein said first signal is an acoustic signal.

28. The system of claim 25, further comprising:

a first control unit configured to be disposed above a body of water; and a second control unit configured to be disposed in the body of water, wherein said first control unit configured to control said first signal device to transmit a first signal wirelessly through the body of water to said second control unit.

29. The system of claim 24, further comprising:

a second accumulator configured to be in fluid communication with the latching assembly for receiving a fluid from the latching assembly.

30. Apparatus for latching an oilfield device, comprising:

a housing having a latching assembly;

a valve coupled with said housing;

a first accumulator coupled with said housing and configured for communicating a fluid from said first accumulator to said latching assembly;

a first signal device; and a second signal device coupled with said housing and configured for receiving a wireless signal from said first signal device when said first signal device is spaced apart from and not connected with said housing to move said valve from a blocking position to an open position to allow flow of said first accumulator fluid to said latching assembly.

31. The apparatus of claim 30, further comprising:

a control unit coupled with said housing and configured for receiving said signal from said second signal device to move said valve.

32. The apparatus of claim 30, further comprising:

a second accumulator coupled with said housing and configured for receiving a fluid from said latching assembly.

33. The apparatus of claim 30, wherein said second signal device comprises a second transducer, and wherein said first signal device comprises a first transducer spaced apart from said housing and said second transducer.

34. The apparatus of claim 33, wherein said second transducer is configured to be pivotable between a stowed position coupled with said housing and a deployed position coupled with said housing.

35. The apparatus of claim 30, further comprising:

a stab plate attached to said housing; and a coupler plate, wherein said stab plate and said coupler plate allow releasable coupling of said first accumulator and said second signal device with said housing.

36. The apparatus of claim 30, further comprising:

an accumulator clamp ring for mounting said first accumulator and said second signal device, and a lifting member configured for lifting said accumulator clamp ring.

37. The apparatus of claim 30, wherein said oilfield device is a rotating control device having a bearing between an inner member rotatable relative to an outer member.

38. The apparatus of claim 30, wherein said first accumulator and said second signal device are releasably coupled to said housing.

39. The apparatus of claim 31, wherein said first accumulator, said second signal device and said control unit are releasably coupled to said housing.

40. Apparatus for use with an oilfield device, comprising:

a subsea component;

a housing for receiving said subsea component;

a valve coupled with said housing;

a first accumulator coupled with said housing and configured for communicating a fluid from said first accumulator to said subsea component;

a first signal device; and a second signal device coupled with said housing and configured for receiving a wireless signal from said first signal device when said first signal device is spaced apart from and not connected with said housing to move said valve from a blocking position to an open position to allow flow of said first accumulator fluid to said subsea component;

wherein said second signal device comprises a second transducer and said first signal device comprises a first transducer spaced apart from said housing and said second transducer; and wherein said second transducer is configured to be movable between a stowed position coupled with said housing and a deployed position coupled with said housing.

41. The apparatus of claim 40, further comprising:

a control unit coupled with said housing and configured for receiving said signal from said second signal device to move said valve.

42. The apparatus of claim 40, further comprising:

a second accumulator coupled with said housing and configured for receiving a fluid from said subsea component.

43. The apparatus of claim 40, wherein said oilfield device is a rotating control device having a bearing between an inner member rotatable relative to an outer member.

* * * * *